United States Patent [19]

Davis et al.

[11] Patent Number: 4,952,328

[45] Date of Patent: Aug. 28, 1990

[54] LUBRICATING OIL COMPOSITIONS

[75] Inventors: Kirk E. Davis, Euclid; Calvin W. Schroeck, Eastlake, both of Ohio

[73] Assignee: The Lubrizol Corporation, Wickliffe, Ohio

[21] Appl. No.: 202,795

[22] Filed: Jun. 3, 1988

Related U.S. Application Data

[63] Continuation-in-part of Ser. No. 199,667, May 25, 1988, abandoned.

[51] Int. Cl.[5] ..... C10M 141/02

[52] U.S. Cl. ..... 252/32.7 E; 252/33.4; 252/39; 252/40; 252/51.5 A; 252/56 R

[58] Field of Search ..... 252/32.7 E, 33.4, 39, 252/40, 51.5 A, 56 R

[56] References Cited

U.S. PATENT DOCUMENTS

| | | | |
|---|---|---|---|
| Re. 26,330 | 1/1968 | Colfer . | |
| Re. 27,331 | 4/1972 | Coleman . | |
| 2,174,110 | 9/1939 | Reed . | |
| 2,202,781 | 5/1940 | Kennedy . | |
| 2,239,974 | 4/1941 | Reed . | |
| 2,319,121 | 5/1943 | Fox . | |
| 2,337,552 | 12/1943 | Henke . | |
| 2,875,221 | 2/1959 | Birnbaum . | |
| 2,911,367 | 11/1959 | Baus et al. | 252/32.7 |
| 2,971,940 | 2/1961 | Fuchsman et al. . | |
| 3,172,892 | 3/1965 | LeSuer et al. . | |
| 3,215,707 | 11/1965 | Rense . | |
| 3,219,666 | 11/1965 | Norman et al. . | |
| 3,231,587 | 1/1966 | Rense . | |
| 3,235,484 | 2/1966 | Colfer . | |
| 3,235,498 | 2/1966 | Waldmann . | |
| 3,272,746 | 9/1966 | Le Suer et al. . | |
| 3,372,116 | 3/1968 | Meinhardt . | |
| 3,385,791 | 5/1968 | Cölyer et al. | 252/32.7 |
| 3,410,798 | 11/1968 | Cohen . | |
| 3,488,284 | 2/1970 | Le Suer et al. . | |
| 3,522,179 | 7/1970 | Le Suer . | |
| 3,562,159 | 2/1971 | Mastin . | |
| 3,576,743 | 4/1971 | Widmer et al. . | |
| 3,595,790 | 7/1971 | Norman et al. . | |
| 3,632,510 | 1/1972 | Le Suer . | |
| 3,798,012 | 3/1974 | LeSuer . | |
| 3,804,763 | 4/1974 | Meinhardt . | |
| 3,912,764 | 10/1975 | Palmer, Jr. . | |
| 3,920,562 | 11/1975 | Foehr | 252/32.7 E |
| 3,933,659 | 1/1976 | Lyle et al. . | |
| 3,948,800 | 4/1976 | Meinhardt . | |
| 3,957,854 | 5/1976 | Miller . | |
| 4,010,106 | 3/1977 | Rothert | 252/32.7 E |
| 4,105,571 | 8/1978 | Shaub et al. | 252/32.7 E |
| 4,110,349 | 8/1978 | Cohen . | |
| 4,113,639 | 9/1978 | Lonstrup et al. . | |
| 4,119,549 | 10/1978 | Davis . | |
| 4,234,435 | 11/1980 | Meinhardt et al. | 252/32.7 E |
| 4,263,150 | 4/1981 | Clason et al. . | |
| 4,289,635 | 9/1981 | Schroeck . | |
| 4,304,678 | 12/1981 | Schick et al. . | |
| 4,308,154 | 12/1981 | Clason et al. . | |
| 4,309,293 | 1/1982 | Braid . | |
| 4,326,972 | 4/1982 | Chamberlin, III | 252/33.3 |
| 4,417,990 | 11/1983 | Clason et al. . | |
| 4,455,243 | 6/1984 | Liston | 252/49.6 |
| 4,466,895 | 8/1984 | Schroeck | 252/32.7 E |
| 4,505,830 | 3/1985 | Vinci . | |
| 4,683,069 | 7/1987 | Brewster et al. . | |

FOREIGN PATENT DOCUMENTS

| | | |
|---|---|---|
| 0092946 | 11/1983 | European Pat. Off. . |
| 0294096 | 12/1988 | European Pat. Off. . |
| 0311319 | 4/1989 | European Pat. Off. . |
| 0317348 | 5/1989 | European Pat. Off. . |
| 0317354 | 5/1989 | European Pat. Off. . |
| 1233858 | 10/1960 | France . |
| 8704454 | 7/1987 | PCT Int'l Appl. . |
| 1481553 | 8/1977 | United Kingdom . |
| 2062672 | 5/1981 | United Kingdom . |
| 2102023 | 1/1983 | United Kingdom . |

OTHER PUBLICATIONS

Ripple, David E., Diesel Lubricants and Methods, Mar. 26, 1987, WO 87/01722.

Exxon, Chemical Patents Inc. Oil-Soluble Dispersant Additives for Fuels and Lubricating Oils, 7/11/85.

*Primary Examiner*—Jacqueline V. Howard

*Attorney, Agent, or Firm*—Joseph P. Fischer; Frederick D. Hunter; Robert A. Franks

[57] ABSTRACT

A lubricating oil formulation is described which is useful in internal combustion engines. More particularly, lubricating oil compositions for internal combustion engines are described with comprises (A) at least about 60% by weight of oil of lubricating viscosity, (B) at least about 2.0% by weight of at least one carboxylic derivative composition produced by reacting (B-1) at least one substituted succinic acylating agent with (B-2) from about 0.70 equivalent up to less than one equivalent, per equivalent of acylating agent, of at least one amine compound characterized by the presence within its structure of at least one HN< group, and wherein said substituted succinic acylating agent consists of substituent groups and succinic groups wherein the substituent groups are derived from a polyalkene, said polyalkene being characterized by an $\overline{M}n$ value of about 1300 to about 5000 and an $\overline{M}w/\overline{M}n$ value of about 1.5 to about 4.5, said acylating agents being characterized by the presence within their structure of an average of at least 1.3 succinic groups for each equivalent weight of substituent groups, and (C) from about 0.01 to about 2% by weight of at least one basic alkali metal salt of sulfonic or carboxylic acid. The oil compositions of the invention also may contain (D) at least one metal dihydrocarbyl dithiophosphate and/or (E) at least one carboxylic ester derivative composition, and/or (F) at least one partial fatty acid ester of a polyhydric alcohol, and/or (G) at least one neutral or basic alkaline earth metal salt of at least one acidic organic compound. In one embodiment, the oil compositions of the present invention contain the above additives and other additives described in this specification in amounts sufficient to enable the oil to meet all the performance requirements of the new API Service Classification identified as SG.

68 Claims, No Drawings

LUBRICATING OIL COMPOSITIONS

CROSS-REFERENCE TO RELATED APPLICATIONS

This application is a continuation-in-part of U.S. Ser. No. 07/199,667 filed on May 27, 1988, now abandoned.

FIELD OF THE INVENTION

This invention relates to lubricating oil compositions. In particular, this invention relates to lubricating oil compositions comprising an oil of lubricating viscosity, a carboxylic derivative composition exhibiting both VI and dispersant properties, and at least one basic alkali metal salt of a sulfonic or carboxylic acid.

BACKGROUND OF THE INVENTION

Lubricating oils which are utilized in internal combustion engines, and in particular, in spark-ignited and diesel engines are constantly being modified and improved to provide improved performance. Various organizations including the SAE (Society of Automotive Engineers), the ASTM (formerly the American Society for Testing and Materials) and the API (American Petroleum Institute) as well as the automotive manufacturers continually seek to improve the performance of lubricating oils. Various standards have been established and modified over the years through the efforts of these organizations. As engines have increased in power output and complexity, the performance requirements have been increased to provide lubricating oils that will exhibit a reduced tendency to deteriorate under conditions of use and thereby to reduce wear and the formation of such undesirable deposits as varnish, sludge, carbonaceous materials and resinous materials which tend to adhere to the various engine parts and reduce the efficiency of the engines.

In general, different classifications of and performance requirements have been established for crankcase lubricants to be used in spark-ignited engines and diesel engines because of the differences in/and the demands placed on, lubricating oils in these applications. Commercially available quality oils designed for spark-ignition engines have been identified and labeled in recent years as "SF" oils, when the oils are capable of satisfying the performance requirements of API Service Classification SF. A new API Service Classification SG has recently been established, and this oil is to be labeled "SG". The oils designated as SG must pass the performance requirements of API Service Classification SG which have been established to insure that these new oils will possess additional desirable properties and performance capabilities in excess of those required for SF oils. The SG oils are to be designed to minimize engine wear and deposits and also to minimize thickening in service. The SG oils are intended to improve engine performance and durability when compared to all previous engine oils marketed for spark-ignition engines. An added feature of SG oils is the inclusion of the requirements of the CC category (diesel) into the SG specification.

In order to meet the performance requirements of SG oils, the oils must successfully pass the following gasoline and diesel engine tests which have been established as standards in the industry: The Ford Sequence VE Test; The Buick Sequence IIIE Test; The Oldsmobile Sequence IID Test; The CRC L-38 Test; and The Caterpillar Single Cylinder Test Engine 1H2. The Caterpillar Test is included in the performance requirements in order to also qualify the oil for the light duty diesel use (diesel performance catetory "CC"). If it is desired to have the SG classification oil also qualify for heavy-duty diesel use, (diesel category "CD") the oil formulation must pass the more stringent performance requirements of the Caterpillar Single Cylinder Test Engine 1G2. The requirements for all of these tests have been established by the industry, and the tests are described in more detail below.

When it is desired that the lubricating oils of the SG classification also exhibit improved fuel economy, the oil must meet the requirements of the Sequence VI Fuel Efficient Engine Oil Dynamometer Test.

A new classification of diesel engine oil also has been established through the joint efforts of the SAE, ASTM and the API, and the new diesel oils will be labeled "CE". The oils meeting the new diesel classification CE will have to be capable of meeting additional performance requirements not found in the present CD category including the Mack T-6, Mack T-7, and the Cummins NTC-400 Tests.

An ideal lubricant for most purposes should possess the same viscosity at all temperatures. Available lubricants, however, depart from this ideal. Materials which have been added to lubricants to minimize the viscosity change with temperature are called viscosity-modifiers, viscosity-improvers, viscosity-index-improvers or VI improvers. In general, the materials which improve the VI characteristics of lubricating oils are oil-soluble organic polymers, and these polymers polymers of various chain length alkyl methacrylates); copolymers of ethylene and propylene; hydrogenated block copolymers of styrene and isoprene; and polyacrylates (i.e., copolymers of various chain length alkyl acrylates).

Other materials have been included in the lubricating oil compositions to enable the oil compositions to meet the various performance requirements, and these include, dispersants, detergents, friction-modifiers, corrosion-inhibitors, etc. Dispersants are employed in lubricants to maintain impurities, particularly those formed during operation of an internal combustion engine, in suspension rather than allowing them to deposit as sludge. Materials have been described in the prior art which exhibit both viscosity-improving and dispersant properties. One type of compound having both properties is comprised of a polymer backbone onto which backbone has been attached one or more monomers having polar groups. Such compounds are frequently prepared by a grafting operation wherein the backbone polymer is reacted directly with a suitable monomer.

Dispersant additives for lubricants comprising the reaction products of hydroxy compounds or amines with substituted succinic acids or their derivatives also have been described in the prior art, and typical dispersants of this type are disclosed in, for example, U.S. Pat. Nos. 3,272,746; 3,522,179; 3,219,666; and 4,234,435. When incorporated into lubricating oils, the compositions described in the '435 patent function primrily as dispersants/detergents and viscosity-index improvers.

SUMMARY OF THE INVENTION

A lubricating oil formulation is described which is useful in internal combustion engines. More particularly, lubricating oil compositions for internal combustion engines are described with comprise (A) at least about 60% by weight of oil of lubricating viscosity, (B)

at least about 2.0% by weight of at least one carboxylic derivative composition produced by reacting at least one substituted succinic acylating agent with from about 0.70 equivalent up to less than one equivalent, per equivalent of acylating agent, of at least one amine compound characterized by the presence within its structure of at least one HN< group, and wherein said substituted succinic acylating agent consists of substituent groups and succinic groups wherein the substituent groups are derived from a polyalkene, said polyalkene being characterized by an $\overline{M}n$ value of about 1300 to about 5000 and an $\overline{M}w/\overline{M}n$ value of about 1.5 to about 4.5, said acylating agents being characterized by the presence within their structure of an average of at least 1.3 succinic groups for each equivalent weight of substituent groups, and (C) from about 0.01 to about 2% by weight of at least one basic alkali metal salt of sulfonic or carboxylic acid. The oil compositions of the invention also may contain (D) at least one metal dihydrocarbyl dithiophosphate and/or (E) at least one carboxylic ester derivative composition, and/or (F) at least one partial fatty acid ester of a polyhydric alcohol, and/or (G) at least one neutral or basic alkaline earth metal salt of at least one acidic organic compound.

In one embodiment, the oil compositions of the present invention contain the above additives and other additives described in the specification in an amount sufficient to enable the oil to meet all the performance requirements of the new API Service Classification identified as "SG".

DESCRIPTION OF THE DRAWING

FIG. 1 is a graph illustrating the relationship of concentration of two dispersants and a polymeric viscosity improver required to maintain a given viscosity.

DESCRIPTION OF THE PREFERRED EMBODIMENTS

The lubricating oil compositions of the present invention comprise, in one embodiment, (A) at least about 60% by weight of oil of lubricating viscosity, (B) at least about 2.0% by weight of at least one carboxylic derivative composition produced by reacting (B-1) at least one substituted succinic acylating agent with (B-2) from about 0.70 equivalent up to less than one equivalent, per equivalent of acylating agent, of at least one amine compound characterized by the presence within its structure of at least one HN< group, and wherein said substituted succinic acylating agent consists of substituent groups and succinic groups wherein the substituent groups are derived from a polyalkene, said polyalkene being characterized by an $\overline{M}n$ value of about 1300 to about 5000 and an $\overline{M}w/\overline{M}n$ value to about 4.5, said acylating agents being characterized by the presence within their structure of an average of at least 1.3 succinic groups for each equivalent weight of substituent groups, and (C) from about 0.01 to about 2% by weight of at least one basic alkali metal salt of sulfonic or carboxylic acid.

Throughout this specification and claims, references to percentages by weight of the various components, except for component (A) which is oil, are on a chemical basis unless otherwise indicated. For example, in the oil compositions of the invention as described in the previous paragraph, the oil composition comprises at least 2.0% by weight of (B) on a chemical basis and from about 0.01 to about 2% by weight of (C) on a chemical basis. Thus, if component (B) is available as a 50% by weight oil solution, at least 4% by weight of the oil solution would be included in the oil composition.

The number of equivalents of the acylating agent depends on the total number of carboxylic functions present. In determining the number of equivalents for the acylating agents, those carboxyl functions which are not capable of reacting as a carboxylic acid acylating agent are excluded. In general, however, there is one equivalent of acylating agent for each carboxy group in these acylating agents. For example, there are two equivalents in an anhydride derived from the reaction of one mole of olefin polymer and one mole of maleic anhydride. Conventional techniques are readily available for determining the number of carboxyl functions (e.g., acid number, saponification number) and, thus, the number of equivalents of the acylating agent can be readily determined by one skilled in the art.

An equivalent weight of an amine or a polyamine is the molecular weight of the amine or polyamine divided by the total number of nitrogens present in the molecule. Thus, ethylene diamine has an equivalent weight equal to one-half of its molecular weight; diethylene triamine has an equivalent weight equal to one-third its molecular weight. The equivalent weight of a commercially available mixture of polyalkylene polyamine can be determined by dividing the atomic weight of nitrogen (14) by the % N contained in the polyamine and multiplying by 100; thus, a polyamine mixture containing 34% N would have an equivalent weight of 41.2. An equivalent weight of ammonia or a monoamine is the molecular weight.

An equivalent weight of polyhydric alcohol is its molecular weight divided by the total number of hydroxyl groups present in the molecule. Thus, an equivalent weight of ethylene glycol is one-half its molecular weight.

An equivalent weight of a hydroxy-substituted amine to be reacted with the acylating agents to form the carboxylic derivative (B) is its molecular weight divided by the total number of nitrogen groups present in the molecule. For the purpose of this invention in preparing component (B), the hydroxyl groups are ignored when calculating equivalent weight. Thus, dimethylethanolamine would have an equivalent weight equal to its molecular weight; ethanolamine would also have an equivalent weight equal to its molecular weight, and diethanolamine has an equivalent weight (nitrogen base) equal to its molecular weight.

The equivalent weight of a hydroxyamine used to form the carboxylic ester derivatives (E) useful in this invention is its molecular weight divided by the number of hydroxyl groups present, and the nitrogen atoms present are ignored. Thus, when preparing esters from, e.g., diethanolamine, the equivalent weight is one-half the molecular weight of diethanolamine.

The terms "substituent" and "acylating agent" or "substituted succinic acylating agent" are to be given their normal meanings. For example, a substituent is an atom or group of atoms that has replaced another atom or group in a molecule as a result of a reaction. The term acylating agent or substituted succinic acylating agent refers to the compound per se and does not include unreacted reactants used to form the acylating agent or substituted succinic acylating agent.

(A) Oil of Lubricating Viscosity.

The oil which is utilized in the preparation of the lubricants of the invention may be based on natural oils, synthetic oils, or mixtures thereof.

Natural oils include animal oils and vegetable oils (e.g., castor oil, lard oil) as well as mineral lubricating oils such as liquid petroleum oils and solvent-treated or acid-treated mineral lubricating oils of the paraffinic, naphthenic or mixed paraffinic-naphthenic types. Oils of lubricating viscosity derived from coal or shale are also useful. Synthetic lubricating oils include hydrocarbon oils and halosubstituted hydrocarbon oils such as polymerized and interpolymerized olefins (e.g., polybutylenes, polypropylenes, propyleneisobutylene copolymers, chlorinated polybutylenes, etc.); poly(1-hexenes), poly(1-octenes), poly(1-decenes), etc. and mixtures thereof; alkylbenzenes (e.g., dodecylbenzenes, tetradecylbenzenes, dinonylbenzenes, di-(2-ethylhexyl)-benzenes, etc.); polyphenyls (e.g., biphenyls, terphenyls, alkylated polyphenyls, etc.); alkylated diphenyl ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc., constitute another class of known synthetic lubricating oils that can be used. These are exemplified by the oils prepared through polymerization of ethylene oxide or propylene oxide, the alkyl and aryl ethers of these polyoxyalkylene polymers.

Another suitable class of synthetic lubricating oils that can be used comprises the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.) Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include those made from $C_5$ to $C_{12}$ monocarboxylic acids and polyols and polyol ethers such as neopentyl glycol, trimethylol propane, pentaerythritol, dipentaerythritol, tripentaerythritol, etc.

Silicon-based oils such as the polyalkyl-, polyaryl-, polyalkoxy-, or polyaryloxy-siloxane oils and silicate oils comprise another useful class of synthetic lubricants (e.g., tetraethyl silicate, tetraisopropyl silicate, tetra-(2-ethylhexyl)silicate, tetra-(4-methylhexyl)silicate, tetra-(p-tert-butylphenyl)silicate, hexyl-(4-methyl-2-pentoxy)disiloxane, poly(methyl)siloxanes, poly(methylphenyl)siloxanes, etc.). Other synthetic lubricating oils include liquid esters of phosphorus-containing acids (e.g., tricresyl phosphate, trioctyl phosphate, diethyl ester of decane phosphonic acid, etc.), polymeric tetrahydrofurans and the like.

Unrefined, refined and refined oils, either natural or synthetic (as well as mixtures of two or more of any of these) of the type disclosed hereinabove can be used in the concentrates of the present invention. Unrefined oils are those obtained directly from a natural or synthetic source without further purification treatment. For example, a shale oil obtained directly from retorting operations, a petroleum oil obtained directly from primary distillation or ester oil obtained directly from an esterification process and used without further treatment would be an unrefined oil. Refined oils are similar to the unrefined oils except they have been further treated in one or more purification steps to improve one or more properties. Many such purification techniques are known to those skilled in the art such as solvent extraction, hydrotreating, secondary distillation, acid or base extraction, filtration, percolation, etc. Rerefined oils are obtained by processes similar to those used to obtain refined oils applied to refined oils which have been already used in service. Such rerefined oils are also known as reclaimed, recycled, or reprocessed oils and often are additionally processed by techniques directed to removal of spent additives and oil breakdown products.

(B) Carboxylic Derivatives.

Component (B) which is utilized in the lubricating oils of the present invention is at least one carboxylic derivative composition produced by reacting (B-1) at least one substituted succinic acylating agent with (B-2) from about 0.70 equivalent up to less than one equivalent, per equivalent of acylating agent, of at least one amine compound containing at least one $HN<$ group, and wherein said acylating agent consists of substituent groups and succinic groups wherein the substituent groups are derived from a polyalkene characterized by an $\overline{M}n$ value of about 1300 to about 5000 and an $\overline{M}w/\overline{M}n$ ratio of about 1.5 to about 4.5, said acylating agents being characterized by the presence within their structure of an average of at least 1.3 succinic groups for each equivalent weight of substituent groups.

The substituted succinic acylating agent (B-1) utilized in the preparation of the carboxylic derivative (B) can be characterized by the presence within its structure of two groups or moieties. The first group or moiety is referred to hereinafter, for convenience, as the "substituent group(s)" and is derived from a polyalkene. The polyalkene from which the substituted groups are derived is characterized by an $\overline{M}n$ value of from about 1300 to about 5000, and an $\overline{M}w/\overline{M}n$ value of at about 1.5 and more generally from about 1.5 to about 4.5 or about 1.5 to about 4.0. The abbreviation $\overline{M}w$ is the conventional symbol representing weight average molecular weight, and $\overline{M}n$ is the conventional symbol representing number average molecular weight. Gel permeation chromatography (GPC) is a method which provides both weight average and number average molecular weights as well as the entire molecular weight distribution of the polymers. For purpose of this invention a series of fractionated polymers of isobutene, polyisobutene, is used as the calibration standard in the GPC.

The techniques for determining $\overline{M}n$ and $\overline{M}w$ values of polymers are well known and are described in numerous books and articles. For example, methods for the determination of Mn and molecular weight distribution of polymers is described in W. W. Yan, J. J. Kirkland and D. D. Bly, "Modern Size Exclusion Liquid Chromatographs", J. Wiley & Sons, Inc., 1979.

The second group or moiety in the acylating agent is referred to herein as the "succinic group(s)". The succinic groups are those groups characterized by the structure

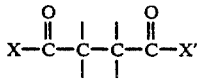

(I)

wherein X and X' are the same or different provided at least one of X and X' is such that the substituted succinic acylating agent can function as carboxylic acylating agents. That is, at least one of X and X' must be such that the substituted acylating agent can form amides or amine salts with amino compounds, and otherwise function as a conventional carboxylic acid acylating agents. Transamidation reactions are considered, for purposes of this invention, as conventional acylating reactions.

Thus, X and/or X' is usually —OH, —O—hydrocarbyl, —O—$M^+$ where $M^+$ represents one equivalent of a metal, ammonium or amine cation, —$NH_2$, —Cl, —Br, and together, X and X' can be —O— so as to form the anhydride. The specific identity of any X or X' group which is not one of the above is not critical so long as its presence does not prevent the remaining group from entering into acylation reactions. Preferably, however, X and X' are each such that both carboxyl functions of the succinic group (i.e., both —C(O)X and —C(O)X' can enter into acylation reactions.

One of the unsatisfied valences in the grouping

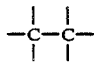

of Formula I forms a carbon-to-carbon bond with a carbon atom in the substituent group. While other such unsatisfied valence may be satisfied by a similar bond with the same or different substituent group, all but the said one such valence is usually satisfied by hydrogen; i.e., —H.

The substituted succinic acylating agents are characterized by the presence within their structure of an average of at least 1.3 succinic groups (that is, groups corresponding to Formula I) for each equivalent weight of substituent groups. For purposes of this invention, the number of equivalent weights of substituent groups is deemed to be the number obtained by dividing the Mn value of the polyalkene from which the substituent is derived into the total weight of the substituent groups present in the substituted succinic acylating agents. Thus, if a substituted succinic acylating agent is characterized by a total weight of substituent group of 40,000, and the $\overline{M}n$ value for the polyalkene from which the substituent groups are derived is 2000, then that substituted succinic acylating agent is characterized by a total of 20 (40,000/2000=20) equivalent weights of substituent groups. Therefore, that particular succinic acylating agent or acylating agent mixture must also be characterized by the presence within its structure of at least 26 succinic groups to meet one of the requirements of the succinic acylating agents used in this invention.

Another requirement for the substituted succinic acylating agents is that the substituent groups must have been derived from a polyalkene characterized by an $\overline{M}w/\overline{M}n$ value of at least about 1.5. The upper limit of $\overline{M}w/\overline{M}n$ will generally be about 4.5. Values of from 1.5 to about 4.0 are particularly useful.

Polyalkenes having the $\overline{M}n$ and $\overline{M}w$ values discussed above are known in the art and can be prepared according to conventional procedures. For example, some of these polyalkenes are described and exemplified in U.S. Pat. No. 4,234,435, and the disclosure of this patent relative to such polyalkenes is hereby incorporated by reference. Several such polyalkenes, especially polybutenes, are commercially available.

In one preferred embodiment, the succinic groups will normally correspond to the formula

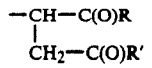

(II)

wherein R and R' are each independently selected from the group consisting of —OH, —Cl, —O-lower alkyl, and when taken together, R and R' are —O—. In the latter case, the succinic group is a succinic anhydride group. All the succinic groups in a particular succinic acylating agent need not be the same, but they can be the same. Preferably, the succinic groups will correspond to

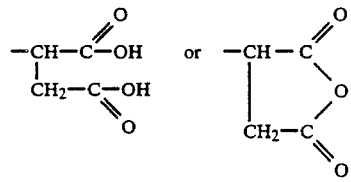

(III)

(A) (B)

and mixtures of (III(A)) and (III(B)). Providing substituted succinic acylating agents wherein the succinic groups are the same or different is within the ordinary skill of the art and can be accomplished through conventional procedures such as treating the substituted succinic acylating agents themselves (for example, hydrolyzing the anhydride to the free acid or converting the free acid to an acid chloride with thionyl chloride) and/or selecting the appropriate maleic or fumaric reactants.

As previously mentioned, the minimum number of succinic groups for each equivalent weight of substituent group in the substituted succinic acylating agent is 1.3. The maximum number generally will not exceed about 4. Generally the minimum will be about 1.4 succinic groups for each equivalent weight of substituent group. A narrower range based on this minimum is at least about 1.4 to about 3.5, and more specifically about 1.4 to about 2.5 succinic groups per equivalent weight of substituent groups.

In addition to preferred substituted succinic groups where the preference depends on the number and identity of succinic groups for each equivalent weight of substituent groups, still further preferences are based on the identity and characterization of the polyalkenes from which the substituent groups are derived.

With respect to the value of $\overline{M}n$ for example, a minimum of about 1300 and a maximum of about 5000 are preferred with an $\overline{M}n$ value in the range of from about 1500 to about 5000 also being preferred. A more preferred $\overline{M}n$ value is one in the range of from about 1500 to about 2800. A most preferred range of $\overline{M}n$ values is from about 1500 to about 2400.

Before proceeding to a further discussion of the polyalkenes from which the substituent groups are derived, it should be pointed out that these preferred characteristics of the succinic acylating agents are intended to be understood as being both independent and dependent. They are intended to be independent in the sense that, for example, a preference for a minimum of 1.4 or 1.5 succinic groups per equivalent weight of substituent groups is not tied to a more preferred value of $\overline{M}n$ or $\overline{M}w/\overline{M}n$. They are intended to be dependent in the sense that, for example, when a preference for a minimum of 1.4 or 1.5 succinic groups is combined with more preferred values of $\overline{M}n$ and/or $\overline{M}w/\overline{M}n$, the combination of preferences does in fact describe still further more preferred embodiments of the invention. Thus, the various parameters are intended to stand alone with respect to the particular parameter being discussed but can also be combined with other parameters to identify further preferences. This same concept is intended to apply throughout the specification with respect to the description of preferred values, ranges, ratios, reactants, and the like unless a contrary intent is clearly demonstrated or apparent.

In one embodiment, when the $\overline{M}n$ of a polyalkene is at the lower end of the range, e.g., about 1300, the ratio of succinic groups to substituent groups derived from said polyalkene in the acylating agent is preferably higher than the ratio when the $\overline{M}n$ is, for example, 1500. Conversely when the $\overline{M}n$ of the polyalkene is higher, e.g., 2000, the ratio may be lower than when the $\overline{M}n$ of the polyalkene is, e.g., 1500.

The polyalkenes from which the substituent groups are derived are homopolymers and interpolymers of polymerizable olefin monomers of 2 to about 16 carbon atoms; usually 2 to about 6 carbon atoms. Thus, pentadiene-1,3 (i.e., piperylene) is deemed to be a terminal olefin for purposes of this invention.

While the polyalkenes from which the substituent groups of the succinic acylating agents are derived generally are hydrocarbon groups, they can contain non-hydrocarbon substituents such as lower alkoxy, lower alkyl mercapto, hydroxy, mercapto, nitro, halo, cyano, carboalkoxy, (where alkoxy is usually lower alkoxy), alkanoyloxy, and the like provided the non-hydrocarbon substituents do not substantially interfere with formation of the substituted succinic acid acylating agents of this invention. When present, such non-hydrocarbon groups normally will not contribute more than about 10% by weight of the total weight of the polyalkenes. Since the polyalkene can contain such non-hydrocarbon substituents, it is apparent that the olefin monomers from which the polyalkenes are made can also contain such substituents. Normally, however, as a matter of practicality and expense, the olefin monomers and the polyalkenes will be free from non-hydrocarbon groups, except chloro groups which usually facilitate the formation of the substituted succinic acylating agents of this invention. (As used herein, the term "lower" when used with a chemical group such as in "lower alkyl" or "lower alkoxy" is intended to describe groups having up to 7 carbon atoms).

Although the polyalkenes may include aromatic groups (especially phenyl groups and lower alkyl- and-/or lower alkoxy-substituted phenyl groups such as para(tert-butyl)phenyl) and cycloaliphatic groups such as would be obtained from polymerizable cyclic olefins or cycloaliphatic substituted-polymerizable acyclic olefins, the polyalkenes usually will be free from such groups. Nevertheless, polyalkenes derived from interpolymers of both 1,3-dienes and styrenes such as butadiene-1,3 and styrene or para-(tert-butyl)styrene are exceptions to this generalization. Again, because aromatic and cycloaliphatic groups can be present, the olefin monomers from which the polyalkenes are prepared can contain aromatic and cycloaliphatic groups.

Some of the substituted succinic acylating agents (B-1) useful in preparing the carboxylic derivative (B) and methods for preparing such substituted succinic acylating agents are known in the art and are described in, for example, U.S. Pat. No. 4,234,435, the disclosure of which is hereby incorporated by reference. The acylating agents described in the '435 patent are characterized as containing substituent groups derived from polyalkenes having an Mn value of about 1300 to about 5000 and an $\overline{M}w/\overline{M}n$ value of about 1.5 to about 4. In addition to the acylating agents described in the '435 patent, the acylating agents useful in the present invention may contain substituent groups drived from polyalkenes having an $\overline{M}w/\overline{M}n$ ratio of up to about 4.5.

There is a general preference for aliphatic, hydrocarbon polyalkenes free from aromatic and cycloaliphatic groups. Within this general preference, there is a further preference for polyalkenes which are derived from the group consisting of homopolymers and interpolymers of terminal hydrocarbon olefins of 2 to about 16 carbon atoms. This further preference is qualified by the proviso that, while interpolymers of terminal olefins are usually preferred, interpolymers optionally containing up to about 40% of polymer units derived from internal olefins of up to about 16 carbon atoms are also within a preferred group. A more preferred class of polyalkenes are those selected from the group consisting of homopolymers and interpolymers of terminal olefins of 2 to about 6 carbon atoms, more preferably 2 to 4 carbon atoms. However, another preferred class of polyalkenes are the latter more preferred polyalkenes optionally containing up to about 25% of polymer units derived from internal olefins of up to about 6 carbon atoms.

Specific examples of terminal and internal olefin monomers which can be used to prepare the polyalkenes according to conventional, well-known polymerization techniques include ethylene; propylene; butene-1; butene-2; isobutene; pentene-1; hexene-1; heptene-1; octene-1; nonene-1; decene-1; pentene-2; propylene-tetramer; diisobutylene; isobutylene trimer; butadiene-1,2; butadiene-1,3; pentadiene-1,2; pentadiene-1,3; pentadiene-1,4; isoprene; hexadiene-1,5; 2-chloro-butadiene-1,3; 2-methyl-heptene-1; 3-cyclohexylbutene-1; 2-methylpentene-1; styrene; 2,4-dichloro styrene; divinylbenzene; vinyl acetate; allyl alcohol; 1-methyl-vinyl acetate; acrylonitrile; ethyl acrylate; methyl methacrylate; ethyl vinyl ether; and methyl vinyl ketone. Of these, the hydrocarbon polymerizable monomers are preferred and of these hydrocarbon monomers, the terminal olefin monomers are particularly preferred.

Specific examples of polyalkenes include polypropylenes, polybutenes, ethylene-propylene copolymers, styrene-isobutene copolymers, isobutene-butadiene-1,3 copolymers, propene-isoprene copolymers, isobutene-chloroprene copolymers, isobutene-(paramethyl)styrene copolymers, copolymers of hexene-1 with hexadiene-1,3, copolymers of octene-1 with hexene-1, copolymers of heptene-1 with pentene-1, copolymers of 3-methyl-butene-1 with octene-1, copolymers of 3,3- dimethyl-pentene-1 with hexene-1, and terpolymers of isobutene, styrene and piperylene. More specific examples of such interpolymers include copolymer of 95% (by weight) of isobutene with 5% (by weight) of styrene; terpolymer of 98% of isobutene with 1% of piperylene and 1% of chloroprene; terpolymer of 95% of isobutene with 2% of butene-1 and 3% of hexene-1; terpolymer of 60% of isobutene with 20% of pentene-1 and 20% of octene-1; copolymer of 80% of hexene-1 and 20% of heptene-1; terpolymer of 90% of isobutene with 2% of cyclohexene and 8% of propylene; and copolymer of 80% of ethylene and 20% of propylene. A preferred source of polyalkenes are the poly(isobutene)s obtained by polymerization of $C_4$ refinery stream having a butene content of about 35 to about 75% by weight and an isobutene content of about 30 to about 60% by weight in the presence of a Lewis acid catalyst such as aluminum trichloride or boron trifluoride. These polybutenes contain predominantly (greater than about 80% of the total repeating units) of isobutene (isobutylene) repeating units of the configuration

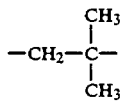

Obviously, preparing polyalkenes as described above which meet the various criteria for Mn and Mw/Mn is within the skill of the art and does not comprise part of the present invention. Techniques readily apparent to those in the art include controlling polymerization temperatures, regulating the amount and type of polymerization initiator and/or catalyst, employing chain terminating groups in the polymerization procedure, and the like. Other conventional techniques such as stripping (including vacuum stripping) a very light end and/or oxidatively or mechanically degrading high molecular weight polyalkene to produce lower molecular weight polyalkenes can also be used.

In preparing the substituted succinic acylating agents (B-1), one or more of the above-described polyalkenes is reacted with one or more acidic reactants selected from the group consisting of maleic or fumaric reactants of the general formula $$X(O)C—CH=CH—C(O)X' \quad (IV)$$

wherein X and X' are as defined hereinbefore in Formula I. Preferably the maleic and fumaric reactants will be one or more compounds corresponding to the formula $$RC(O)—CH=CH—C(O)R' \quad (V)$$

wherein R and R' are as previously defined in Formula II herein. Ordinarily, the maleic or fumaric reactants will be maleic acid, fumaric acid, maleic anhydride, or a mixture of two or more of these. The maleic reactants are usually preferred over the fumaric reactants because the former are more readily available and are, in general, more readily reacted with the polyalkenes (or derivatives thereof) to prepare the substituted succinic acylating agents of the present invention. The especially preferred reactants are maleic acid, maleic anhydride, and mixtures of these. Due to availability and ease of reaction, maleic anhydride will usually be employed.

The one or more polyalkenes and one or more maleic or fumaric reactants can be reacted according to any of several known procedures in order to produce the substituted succinic acylating agents of the present invention. Basically, the procedures are analogous to procedures used to prepare the higher molecular weight succinic anhydrides and other equivalent succinic acylating analogs thereof except that the polyalkenes (or polyolefins) of the prior art are replaced with the particular polyalkenes described above and the amount of maleic or fumaric reactant used must be such that there is an average of at least 1.3 succinic groups for each equivalent weight of the substituent group in the final substituted succinic acylating agent produced.

For convenience and brevity, the term "maleic reactant" is often used hereinafter. When used, it should be understood that the term is generic to acidic reactants selected from maleic and fumaric reactants corresponding to Formulae (IV) and (V) above including a mixture of such reactants.

One procedure for preparing the substituted succinic acylating agents (B-1) is illustrated, in part, in U.S. Pat. No. 3,219,666 (Norman et al) which is expressly incorporated herein by reference for its teachings in regard to preparing succinic acylating agents. This procedure is conveniently designated as the "two-step procedure". It involves first chlorinating the polyalkene until there is an average of at least about one chloro group for each molecular weight of polyalkene. (For purposes of this invention, the molecular weight of the polyalkene is the weight corresponding to the Mn value.) Chlorination involves merely contacting the polyalkene with chlorine gas until the desired amount of chlorine is incorporated into the chlorinated polyalkene. Chlorination is generally carried out at a temperature of about 75° C. to about 125° C. If a diluent is used in the chlorination procedure, it should be one which is not itself readily subject to further chlorination. Poly- and perchlorinated and/or fluorinated alkanes and benzenes are examples of suitable diluents.

The second step in the two-step chlorination procedure is to react the chlorinated polyalkene with the maleic reactant at a temperature usually within the range of about 100° C. to about 200° C. The mole ratio of chlorinated polyalkene to maleic reactant is usually at least about 1:1.3. (In this application, a mole of chlorinated polyalkene is that weight of chlorinated polyalkene corresponding to the $\overline{Mn}$ value of the unchlorinated polyalkene.) However, a stoichiometric excess of maleic reactant can be used, for example, a mole ratio of 1:2. More than one mole of maleic reactant may react per molecule of chlorinated polyalkene. Because of such situations, it is better to describe the ratio of chlorinated polyalkene to maleic reactant in terms of equivalents. (An equivalent weight of chlorinated polyalkene, for purposes of this invention, is the weight corresponding to the $\overline{Mn}$ value divided by the average number of chloro groups per molecule of chlorinated polyalkene while the equivalent weight of a maleic reactant is its molecular weight.) Thus, the ratio of chlorinated polyalkene to maleic reactant will normally be such as to provide at least about 1.3 equivalents of maleic reactant for each mole of chlorinated polyalkene. Unreacted excess maleic reactant may be stripped from the reaction product, usually under vacuum, or reacted during a further stage of the process as explained below.

The resulting polyalkenyl-substituted succinic acylating agent is, optionally, again chlorinated if the desired number of succinic groups are not present in the product. If there is present, at the time of this subsequent chlorination, any excess maleic reactant from the second step, the excess will react as additional chlorine is introduced during the subsequent chlorination. Otherwise, additional maleic reactant is introduced during and/or subsequent to the additional chlorination step. This technique can be repeated until the total number of succinic groups per equivalent weight of substituent groups reaches the desired level.

Another procedure for preparing the substituted succinic acid acylating agents (B-1) utilizes a process described in U.S. Pat. No. 3,912,764 (Palmer) and U.K. Pat. No. 1,440,219, both of which are expressly incorporated herein by reference for their teachings in regard to that process. According to that process, the polyalkene and the maleic reactant are first reacted by heating them together in a "direct alkylation" procedure. When the direct alkylation step is completed, chlorine is introduced into the reaction mixture to promote reaction of the remaining unreacted maleic reactants. According to the patents, 0.3 to 2 or more moles of maleic anhydride are used in the reaction for each mole of olefin polymer; i.e., polyalkene. The direct alkylation step is conducted at temperatures of 180° C. to 250° C. During the chlorine-introducing stage, a temperature of 160° C. to 225° C. is employed. In utilizing this process to prepare the substituted succinic acylating agents, it is necessary to use sufficient maleic reactant and chlorine to incorporate at least 1.3 succinic groups into the final product, i.e., the substituted succinic acylating agent, for each equivalent weight of polyalkene, i.e., reacted polyalkenyl in final product.

Other processes for preparing the acylating agents (B-1) are also described in the prior art. U.S. Pat. No. 4,110,349 (Cohen) describes a two-step process. The disclosure of U.S. Pat. No. 4,110,349 relating to the two-step process for preparing acylating agent is hereby incorporated by reference.

The one preferred process for preparing the substituted succinic acylating agents (B-1) from the standpoint of efficiency, overall economy, and the performance of the acylating agents thus produced, as well as the performance of the derivatives thereof, is the so-called "one-step" process. This process is described in U.S. Pat. Nos. 3,215,707 (Rense) and 3,231,587 (Rense). Both are expressly incorporated herein by reference for their teachings in regard to that process.

Basically, the one-step process involves preparing a mixture of the polyalkene and the maleic reactant containing the necessary amounts of both to provide the desired substituted succinic acylating agents. This means that there must be at least 1.3 moles of maleic reactant for each mole of polyalkene in order that there can be at least 1.3 succinic groups for each equivalent weight of substituent groups. Chlorine is then introduced into the mixture, usually by passing chlorine gas through the mixture with agitation, while maintaining a temperature of at least about 140° C.

A variation on this process involves adding additional maleic reactant during or subsequent to the chlorine introduction but, for reasons explained in U.S. Pat. Nos. 3,215,707 and 3,231,587, this variation is presently not as preferred as the situation where all the polyalkene and all the maleic reactant are first mixed before the introduction of chlorine.

Usually, where the polyalkene is sufficiently fluid at 140° C. and above, there is no need to utilize an additional substantially inert, normally liquid solvent/diluent in the one-step process. However, as explained hereinbefore, if a solvent/diluent is employed, it is preferably one that resists chlorination. Again, the poly- and per-chlorinated and/or -fluorinated alkanes, cycloalkanes, and benzenes can be used for this purpose.

Chlorine may be introduced continuously or intermittently during the one-step process. The rate of introduction of the chlorine is not critical although, for maximum utilization of the chlorine, the rate should be about the same as the rate of consumption of chlorine in the course of the reaction. When the introduction rate of chlorine exceeds the rate of consumption, chlorine is evolved from the reaction mixture. It is often advantageous to use a closed system, including superatmospheric pressure, in order to prevent loss of chlorine and maleic reactant so as to maximize reactant utilization.

The minimum temperature at which the reaction in the one-step process takes place at a reasonable rate is about 140° C. Thus, the minimum temperature at which the process is normally carried out is in the neighborhood of 140° C. The preferred temperature range is usually between about 160° C. and about 220° C. Higher temperatures such as 250° C. or even higher may be used but usually with little advantage. In fact, temperatures in excess of 220° C. are often disadvantageous with respect to preparing the particular acylated succinic compositions of this invention because they tend to "crack" the polyalkenes (that is, reduce their molecular weight by thermal degradation) and/or decompose the maleic reactant. For this reason, maximum temperatures of about 200° C. to about 210° C. are normally not exceeded. The upper limit of the useful temperature in the one-step process is determined primarily by the decomposition point of the components in the reaction mixture including the reactants and the desired products. The decomposition point is that temperature at which there is sufficient decomposition of any reactant or product such as to interfere with the production of the desired products.

In the one-step process, the molar ratio of maleic reactant to chlorine is such that there is at least about one mole of chlorine for each mole of maleic reactant to be incorporated into the product. Moreover, for practical reasons, a slight excess, usually in the neighborhood of about 5% to about 30% by weight of chlorine, is utilized in order to offset any loss of chlorine from the reaction mixture. Larger amounts of excess chlorine may be used but do not appear to produce any beneficial results.

As mentioned previously, the molar ratio of polyalkene to maleic reactant is such that there are at least about 1.3 moles of maleic reactant for each mole of polyalkene. This is necessary in order that there can be at least 1.3 succinic groups per equivalent weight of substituent group in the product. Preferably, however, an excess of maleic reactant is used. Thus, ordinarily about a 5% to about 25% excess of maleic reactant will be used relative to that amount necessary to provide the desired number of succinic groups in the product.

A preferred process for preparing the substituted acylating agents (B-1) comprises heating and contacting at a temperature of at least about 140° C. up to the decomposition temperature, (A) Polyalkene characterized by $\overline{M}n$ value of about 1300 to about 5000 and an $\overline{M}w/\overline{M}n$ value of about 1.5 to about 4.5, (B) One or more acidic reactants of the formula

XC(O)—CH=CH—C(O)X' wherein X and X' are as defined hereinbefore, and (C) Chlorine wherein the mole ratio of (A):(B) is such that there is at least about 1.3 moles of (B) for each mole of (A) wherein the number of moles of (A) is the quotient of the total weight of (A) divided by the value of $\overline{Mn}$ and the amount of chlorine employed is such as to provide at least about 0.2 mole (preferably at least about 0.5 mole) of chlorine for each mole of (B) to be reacted with (A), said substituted acylating compositions being characterized by the presence within their structure of an average of at least 1.3 groups derived from (B) for each equivalent weight of the substituent groups derived from (A).

The terminology "substituted succinic acylating agent(s)" is used herein in describing the substituted succinic acylating agents regardless of the process by which they are produced. Obviously, as discussed in more detail hereinbefore, several processes are available for producing the substituted succinic acylating agents. On the other hand, the terminology "substituted acylating composition(s)", may be used to describe the reaction mixtures produced by the specific preferred processes described in detail herein. Thus, the identity of particular substituted acylating compositions is dependent upon a particular process of manufacture. This is particularly true because, while the products of this invention are clearly substituted succinic acylating agents as defined and discussed above, their structure cannot be represented by a single specific chemical formula. In fact, mixtures of products are inherently present. For purposes of brevity, the terminology "acylating reagent(s)" is often used hereafter to refer, collectively, to both the substituted succinic acylating agents and to the substituted acylating compositions used in this invention.

The acylating reagents described above are intermediates in processes for preparing the carboxylic derivative compositions (B) comprising reacting one or more acylating reagents (B-1) with at least one amino compound (B-2) characterized by the presence within its structure of at least one HN< group.

The amino compound (B-2) characterized by the presence within its structure of at least one HN< group can be a monoamine or polyamine compound. Mixtures of two or more amino compounds can be used in the reaction with one or more acylating reagents of this invention. Preferably, the amino compound contains at least one primary amino group (i.e., $—NH_2$) and more preferably the amine is a polyamine, especially a polyamine containing at least two —NH— groups, either or both of which are primary or secondary amines. The amines may be aliphatic, cycloaliphatic, aromatic, or heterocyclic amines. The polyamines not only result in carboxylic acid derivative compositions which are usually more effective as dispersant/detergent additives, relative to derivative compositions derived from monoamines, but these preferred polyamines result in carboxylic derivative compositions which exhibit more pronounced V.I. improving properties.

The monoamines and polyamines must be characterized by the presence within their structure of at least one HN< group. Therefore, they have at least one primary (i.e., $H_2N—$) or secondary amino (i.e., HN=) group. The amines can be aliphatic, cycloaliphatic, aromatic, or heterocyclic, including aliphatic-substituted cycloaliphatic, aliphatic-substituted aromatic, aliphatic-substituted heterocyclic, cycloaliphatic-substituted aliphatic, cycloaliphatic-substituted heterocyclic, aromatic-substituted aliphatic, aromatic-substituted cycloaliphatic, aromatic-substituted heterocyclic, heterocyclic-substituted aliphatic, heterocyclic-substituted alicyclic, and heterocyclic-substituted aromatic amines and may be saturated or unsaturated. The amines may also contain non-hydrocarbon substituents or groups as long as these groups do not significantly interfere with the reaction of the amines with the acylating reagents of this invention. Such non-hydrocarbon substituents or groups include lower alkoxy, lower alkyl mercapto, nitro, interrupting groups such as —O— and —S— (e.g., as in such groups as $—CH_2—$, $CH_2—X—CH_2CH_2—$ where X is —O— or —S—).

With the exception of the branched polyalkylene polyamine, the polyoxyalkylene polyamines, and the high molecular weight hydrocarbyl-substituted amines described more fully hereafter, the amines ordinarily contain less than about 40 carbon atoms in total and usually not more than about 20 carbon atoms in total.

Aliphatic monoamines include mono-aliphatic and di-aliphatic substituted amines wherein the aliphatic groups can be saturated or unsaturated and straight or branched chain. Thus, they are primary or secondary aliphatic amines. Such amines include, for example, mono- and di-alkyl-substituted amines, mono- and dialkenyl-substituted amines, and amines having one N-alkenyl substituent and one N-alkyl substituent and the like. The total number of carbon atoms in these aliphatic monoamines will, as mentioned before, normally not exceed about 40 and usually not exceed about 20 carbon atoms. Specific examples of such monoamines include ethylamine, diethylamine, n-butylamine, di-n-butylamine, allylamine, isobutylamine, cocoamine, stearylamine, laurylamine, methyllaurylamine, oleylamine, N-methyl-octylamine, dodecylamine, octadecylamine, and the like. Examples of cycloaliphatic-substituted aliphatic amines, aromatic-substituted aliphatic amines, and heterocyclic-substituted aliphatic amines, include 2-(cyclohexyl)-ethylamine, benzylamine, phenethylamine, and 3-(furylpropyl) amine.

Cycloaliphatic monoamines are those monoamines wherein there is one cycloaliphatic substituent attached directly to the amino nitrogen through a carbon atom in the cyclic ring structure. Examples of cycloaliphatic monoamines include cyclohexylamines, cyclopentylamines, cyclohexenylamines, cyclopentylamines, N-ethyl-cyclohexylamine, dicyclohexylamines, and the like. Examples of aliphatic-substituted, aromatic-substituted, and heterocyclic-substituted cycloaliphatic monoamines include propyl-substituted cyclohexylamines, phenyl-substituted cyclopentylamines, and pyranyl-substituted cyclohexylamine.

Aromatic amines include those monoamines wherein a carbon atom of the aromatic ring structure is attached directly to the amino nitrogen. The aromatic ring will usually be a mononuclear aromatic ring (i.e., one derived from benzene) but can include fused aromatic rings, especially those derived from naphthalene. Examples of aromatic monoamines include aniline, di(-paramethylphenyl) amine, naphthylamine, N-(n-butyl-)aniline, and the like. Examples of aliphatic-substituted, cycloaliphatic-substituted, and heterocyclic-substituted aromatic monoamines are para-ethoxyaniline, para-dodecylaniline, cyclohexyl-substituted naphthylamine, and thienyl-substituted aniline.

Polyamines are aliphatic, cycloaliphatic and aromatic polyamines analogous to the above-described monoamines except for the presence within their structure of additional amino nitrogens. The additional amino nitrogens can be primary, secondary or tertiary amino nitrogens. Examples of such polyamines include N-aminopropyl-cyclohexylamines, N,N'-di-n-butyl-paraphenylene diamine, bis-(para-aminophenyl)methane, 1,4-diaminocyclohexane, and the like.

Heterocycic mono- and polyamines can also be used in making the carboxylic derivative compositions (B). As used herein, the terminology "heterocyclic mono- and polyamine(s)" is intended to describe those heterocyclic amines containing at least one primary or secondary amino group and at least one nitrogen as a heteroatom in the heterocyclic ring. However, as long as there is present in the heterocyclic mono- and polyamines at least one primary or secondary amino group, the hetero-N atom in the ring can be a tertiary amino nitrogen; that is, one that does not have hydrogen attached directly to the ring nitrogen. Heterocyclic amines can be saturated or unsaturated and can contain various substituents such as nitro, alkoxy, alkyl mercapto, alkyl, alkenyl, aryl, alkaryl, or aralkyl substituents. Generally, the total number of carbon atoms in the substituents will not exceed about 20. Heterocyclic amines can contain hetero atoms other than nitrogen, especially oxygen and sulfur. Obviously they can contain more than one nitrogen hetero atom. The five- and six-membered heterocyclic rings are preferred.

Among the suitable heterocyclics are aziridines, azetidines, azolidines, tetra- and di-hydro pyridines, pyrroles, indoles, piperidines, imidazoles, di- and tetrahydroimidazoles, piperazines, isoindoles, purines, morpholines, thiomorpholines, N-aminoalkylmorpholines, N-aminoalkylthiomorpholines, N-aminoalkylpiperazines, N,N'-di-aminoalkylpiperazines, azepines, azocines, azonines, azecines and tetra-, di- and perhydro derivatives of each of the above and mixtures of two or more of these heterocyclic amines. Preferred heterocyclic amines are the saturated 5- and 6-membered heterocyclic amines containing only nitrogen, oxygen and/or sulfur in the hetero ring, especially the piperidines, piperazines, thiomorpholines, morpholines, pyrrolidines, and the like. Piperidine, aminoalkyl-substituted piperidines, piperazine, aminoalkyl-substituted morpholines, pyrrolidine, and aminoalkyl-substituted pyrrolidines, are especially preferred. Usually the aminoalkyl substituents are substituted on a nitrogen atom forming part of the hetero ring. Specific examples of such heterocyclic amines include N-aminopropylmorpholine, N-aminoethylpiperazine, and N,N'-di-aminoethylpiperazine.

Hydroxy-substituted mono- and polyamines, analogous to the mono- and polyamines described above are also useful in preparing carboxylic derivative (B) provided they contain at least one primary or secondary amino group. Hydroxy-substituted amines having only tertiary amino nitrogen such as in tri-hydroxyethyl amine, are thus excluded as amine reactants but can be used as alcohols in preparing component (E) as disclosed hereinafter. The hydroxy-substituted amines contemplated are those having hydroxy substituents bonded directly to a carbon atom other than a carbonyl carbon atom; that is, they have hydroxy groups capable of functioning as alcohols. Examples of such hydroxy-substituted amines include ethanolamine, di-(3-hydroxypropyl)-amine, 3-hydroxybutyl-amine, 4-hydroxybutyl-amine, diethanolamine, di-(2-hydroxypropyl)-amine, N-(hydroxypropyl)-propylamine, N-(2-hydroxyethyl)-cyclohexylamine, 3-hydroxycyclopentylamine, parahydroxyaniline, N-hydroxyethyl piperazine, and the like.

Hydrazine and substituted-hydrazine can also be used. At least one of the nitrogens in the hydrazine must contain a hydrogen directly bonded thereto. Preferably there are at least two hydrogens bonded directly to hydrazine nitrogen and, more preferably, both hydrogens are on the same nitrogen. The substituents which may be present on the hydrazine include alkyl, alkenyl, aryl, aralkyl, alkaryl, and the like. Usually, the substituents are alkyl, especially lower alkyl, phenyl, and substituted phenyl such as lower alkoxy substituted phenyl or lower alkyl substituted phenyl. Specific examples of substituted hydrazines are methylhydrazine, N,N-dimethyl-hydrazine, N,N'-dimethylhydrazine, phenylhydrazine, N-phenyl-N'-ethylhydrazine, N-(para-tolyl)-N'-(n-butyl)-hydrazine, N-(para-nitrophenyl)-hydrazine, N-(para-nitrophenyl)-N-methyl-hydrazine, N,N'-di(para-chlorophenol)hydrazine, N-phenyl-N'-cyclohexylhydrazine, and the like.

The high molecular weight hydrocarbyl amines, both mono-amines and polyamines, which can be used are generally prepared by reacting a chlorinated polyolefin having a molecular weight of at least about 400 with ammonia or amine. Such amines are known in the art and described, for example, in U.S. Pat. Nos. 3,275,554 and 3,438,757, both of which are expressly incorporated herein by reference for their disclosure in regard to how to prepare these amines. All that is required for use of these amines is that they possess at least one primary or secondary amino group.

Suitable amines also include polyoxyalkylene polyamines, e.g., polyoxyalkylene diamines and polyoxyalkylene triamines, having average molecular weights ranging from about 200 to 4000 and preferably from about 400 to 2000. Illustrative examples of these polyoxyalkylene polyamines may be characterized by the formulae $$NH_2\text{-Alkylene}(\text{O-Alkylene})_m NH_2 \quad \text{(VI)}$$

wherein m has a value of about 3 to 70 and preferably about 10 to 35.

$$R(\text{Alkylene}(\text{O-Alkylene})_n NH_2)_{3\text{-}6} \quad \text{(VII)}$$

wherein n is such that the total value is from about 1 to 40 with the proviso that the sum of all of the n's is from about 3 to about 70 and generally from about 6 to about 35 and R is a polyvalent saturated hydrocarbon radical of up to 10 carbon atoms having a valence of 3 to 6. The alkylene groups may be straight or branched chains and contain from 1 to 7 carbon atoms and usually from 1 to 4 carbon atoms. The various alkylene groups present within Formulae (VI) and (VII) may be the same or different.

The preferred polyoxyalkylene polyamines include the polyoxyethylene and polyoxypropylene diamines and the polyoxypropylene triamines having average molecular weights ranging from about 200 to 2000. The polyoxyalkylene polyamines are commercially available and may be obtained, for example, from the Jefferson Chemical Company, Inc. under the trade name "Jeffamines D-230, D-400, D-1000, D-2000, T-403, etc.".

U.S. Pat. Nos. 3,804,763 and 3,948,800 are expressly incorporated herein by reference for their disclosure of such polyoxyalkylene polyamines and process for acylating them with carboxylic acid acylating agents which processes can be applied to their reaction with the acylating reagents used in this invention.

The most preferred amines are the alkylene polyamines, including the polyalkylene polyamines. The alkylene polyamines include those conforming to the formula $$R^3-\underset{\underset{R^3}{|}}{N}-(U-\underset{\underset{R^3}{|}}{N})_n-R^3 \qquad \text{(VIII)}$$

wherein n is from 1 to about 10; each $R^3$ is independently a hydrogen atom, a hydrocarbyl group or a hydroxysubstituted or an amino-substituted hydrocarbyl group having up to about 30 atoms, with the proviso that at least one $R^3$ group is a hydrogen atom and U is an alkylene group of about 2 to about 10 carbon atoms. Preferably U is ethylene or propylene. Especially preferred are the alkylene polyamines where each $R^3$ is independently hydrogen or an amino-substituted hydrocarbyl group, with the ethylene polyamines and mixtures of ethylene polyamines being the most preferred. Usually n will have an average value of from about 2 to about 7. Such alkylene polyamines include methylene polyamine, ethylene polyamines, butylene polyamines, propylene polyamines, pentylene polyamines, hexylene polyamines, heptylene polyamines, etc. The higher homologs of such amines and related amino alkyl-substituted piperazines are also included.

Alkylene polyamines useful in preparing the carboxylic derivative compositions (B) include ethylene diamine, triethylene tetramine, propylene diamine, trimethylene diamine, hexamethylene diamine, decamethylene diamine, hexamethylene diamine, decamethylene diamine, octamethylene diamine, di(heptamethylene) triamine, tripropylene tetramine, tetraethylene pentamine, trimethylene diamine, pentaethylene hexamine, di(trimethylene)triamine, N-(2-aminoethyl)piperazine, 1,4-bis(2,aminoethyl)piperazine, and the like. Higher homologs as are obtained by condensing two or more of the above-illustrated alkylene amines are useful, as are mixtures of two or more of any of the afore-described polyamines.

Ethylene polyamines, such as those mentioned above, are especially useful for reasons of cost and effectiveness. Such polyamines are described in detail under the heading "Diamines and Higher Amines" in The Encyclopedia of Chemical Technology, Second Edition, Kirk and Othmer, Volume 7, pages 27–39, Interscience Publishers, Division of John Wiley and Sons, 1965, which is hereby incorporated by reference for the disclosure of useful polyamines. Such compounds are prepared most conveniently by the reaction of an alkylene chloride with ammonia or by reaction of an ethylene imine with a ring-opening reagent such as ammonia, etc. These reactions result in the production of the somewhat complex mixtures of alkylene polyamines, including cyclic condensation products such as piperazines. The mixtures are particularly useful in preparing the carboxylic derivatives (B) of this invention. On the other hand, quite satisfactory products can also be obtained by the use of pure alkylene polyamines.

Other useful types of polyamine mixtures are those resulting from stripping of the above-described polyamine mixtures. In this instance, lower molecular weight polyamines and volatile contaminants are removed from an alkylene polyamine mixture to leave as residue what is often termed "polyamine bottoms". In general, alkylene polyamine bottoms can be characterized as having less than two, usually less than 1% (by weight) material boiling below about 200° C. In the instance of ethylene polyamine bottoms, which are readily available and found to be quite useful, the bottoms contain less than about 2% (by weight) total diethylene triamine (DETA) or triethylene tetramine (TETA). A typical sample of such ethylene polyamine bottoms obtained from the Dow Chemical Company of Freeport, Tex. designated "E-100" showed a specific gravity at 15.6° C. of 1.0168, a percent nitrogen by weight of 33.15 and a viscosity at 40° C. of 121 centistokes. Gas chromatography analysis of such a sample showed it to contain about 0.93% "Light Ends" (most probably DETA), 0.72% TETA, 21.74% tetraethylene pentamine and 76.61% pentaethylene hexamine and higher (by weight). These alkylene polyamine bottoms include cyclic condensation products such as piperazine and higher analogs of diethylene triamine, triethylene tetramine and the like.

These alkylene polyamine bottoms can be reacted solely with the acylating agent, in which case the amino reactant consists essentially of alkylene polyamine bottoms, or they can be used with other amines and polyamines, or alcohols or mixtures thereof. In these latter cases at least one amino reactant comprises alkylene polyamine bottoms.

Hydroxylalkyl alkylene polyamines having one or more hydroxyalkyl substituents on the nitrogen atoms, are also useful in preparing derivatives of the aforedescribed olefinic carboxylic acids. Preferred hydroxylalkyl-substituted alkylene polyamines are those in which the hydroxyalkyl group is a lower hydroxyalkyl group, i.e., having less than eight carbon atoms. Examples of such hydroxyalkyl-substituted polyamines include N-(2-hydroxyethyl)ethylene diamine,N,N-bis(2-hydroxyethyl) ethylene diamine, 1-(2-hydroxyethyl) piperazine, monohydroxypropyl-substituted diethylene triamine, dihydroxypropyl-substituted tetraethylene pentamine, N-(2-hydroxybutyl)tetramethylene diamine, etc. Higher homologs as are obtained by condensation of the above-illustrated hydroxy alkylene polyamines through amino radicals or through hydroxy radicals are likewise useful as (a). Condensation through amino radicals results in a higher amine accompanied by removal of ammonia and condensation through the hydroxy radicals results in products containing ether linkages accompanied by removal of water.

Other polyamines (B-2) which can be reacted with the acylating agents (B-1) are described in, for example, U.S. Pat. Nos. 3,219,666 and 4,234,435, and these patents are hereby incorporated by reference for the disclosures of amines contained therein.

The carboxylic derivative compositions (B) produced from the acylating reagents (B-1) and the amino compounds (B-2) described hereinbefore comprise acylated amines which include amine salts, amides, imides and imidazolines as well as mixtures thereof. To prepare carboxylic acid derivatives from the acylating reagents and the amino compounds, one or more acylating reagents and one or more amino compounds are heated at temperatures in the range of about 80° C. up to the decomposition point (where the decomposition point is as previously defined) but normally at temperatures in the range of about 100° C. up to about 300° C. provided 300° C. does not exceed the decomposition point. Temperatures of about 125° C. to about 250° C. are normally used. The acylating reagent and the amino compound are reacted in amounts sufficient to provide from about one-half equivalent up to less than one equivalent of amino compound per equivalent of acylating reagent.

Because the acylating reagents (B-1) can be reacted with the amino compounds (B-2) in the same manner as the high molecular weight acylating agents of the prior art are reacted with amino compounds, U.S. Pat. Nos. 3,172,892; 3,219,666; 3,272,746; and 4,234,435 are expressly incorporated herein by reference for their disclosures with respect to the procedures applicable to reacting the acylating reagents with the amino compounds as described above. In applying the disclosures of these patents to the acylating reagents, the substituted succinic acylating agents (B-1) described herein can be substituted for the high molecular weight carboxylic acid acylating agents disclosed in these patents on an equivalent basis. That is, where one equivalent of the high molecular weight carboxylic acylating agent disclosed in these incorporated patents is utilized, one equivalent of the acylating reagent of this invention can be used.

In order to produce carboxylic derivative compositions exhibiting viscosity index improving capabilities, it has been found generally necessary to react the acylating reagents with polyfunctional reactants. For example, polyamines having two or more primary and/or secondary amino groups are preferred. Obviously, however, it is not necessary that all of the amino compound reacted with the acylating reagents be polyfunctional. Thus, combinations of mono- and polyfunctional amino compounds be used.

The relative amounts of the acylating agent (B-1) and amino compound (B-2) used to form the carboxylic derivative compositions (B) used in the lubricating oil compositions of the present invention is a critical feature of the carboxylic derivative compositions (B). It is essential that the acylating agent (B-1) be reacted with less than one equivalent of the amino compound (B-2) per equivalent of acylating agent. It has been discovered that the incorporation of carboxylic derivatives prepared from such ratios in the lubricating oil compositions of the present invention results in improved viscosity index characteristics when compared to lubricating oil compositions containing carboxylic derivatives obtained by reacting the same acylating agents with one or more equivalents of amino compounds, per equivalent of acylating agent. In this regard refer to FIG. 1 which is a graph showing the relationship of polymer viscosity level versus two dispersant products of different acylating agent to nitrogen ratios in an SAE 5W-30 formulation. The viscosity of the blend is 10.2 cSt at 100° C. for all levels of dispersant, and the viscosity at −25° C. is 3300 cP at 4% dispersant. The solid line indicates the relative level of viscosity improver required at different concentrations of a prior art dispersant. The dashed line indicates the relative level of viscosity improver required at different concentrations of the dispersant of this invention (component (B) on a chemical basis). The prior art dispersant is obtained by reacting one equivalent of a polyamine with one equivalent of a succinic acylating agent having the characteristics of the acylating agents used to prepare component (B) of this invention. The dispersant of the invention is prepared by reacting 0.833 equivalent of the same polyamine with one equivalent of the same acylating agent.

As can be seen from the graph, oils containing the dispersant used in the present invention require less polymeric viscosity improver to maintain a given viscosity than the dispersant of the prior art, and the improvement is greater at the higher dispersant levels, e.g., at greater than 2% dispersant concentration.

In one embodiment, the acylating agent is reacted with from about 0.70 to about 0.95 equivalent of amino compound, per equivalent of acylating agent. In other embodiments, the lower limit on the equivalents of amino compound may be 0.75 or even 0.80 up to about 0.90 or 0.95 equivalent, per equivalent of acylating agent. Thus narrower ranges of equivalents of acylating agent (B-1) to amino compound (B-2) may be from about 0.70 to 0.90, or 0.75 to 0.90 or 0.75 to 0.85. It appears, at least in some situations, that when the equivalent of amino compound is about 0.75 or less, per equivalent of acylating agent, the effectiveness of the carboxylic derivatives as dispersants is reduced. In one embodiment, the relative amounts of acylating agent and amine are such that the carboxylic derivative preferably contains no free carboxyl groups.

The amount of amine compound (B-2) within these ranges that is reacted with the acylating agent (B-1) may also depend in part on the number and type of nitrogen atoms present. For example, a smaller amount of a polyamine containing one or more —$NH_2$ groups, is required to react with a given acylating agent than a polyamine having the same number of nitrogen atoms but fewer or no —$NH_2$ groups. One —$NH_2$ group can react with two —COOH groups to form an imide. If only secondary nitrogens are present in the amine compound, each —NH group can only react with one —COOH group. Accordingly, the amount of polyamine within the above ranges to be reacted with the acylating agent to form the carboxylic derivatives of the invention can be readily determined from a consideration of the number and type of nitrogen atoms in the polyamine (i.e., —$NH_2$, >NH, and >N—).

In addition to the relative amounts of acylating agent and amino compound used to form the carboxylic derivative composition (B), other critical features of the carboxylic derivative compositions (B) are the $\overline{M}n$ and the $\overline{M}w/\overline{M}n$ values of the polyalkene as well as the presence within the acylating agents of an average of at least 1.3 succinic groups for each equivalent weight of substituent groups. When all of these features are present in the carboxylic derivative compositions (B), the lubricating oil compositions of the present invention exhibit novel and improved properties, and the lubricating oil compositions are characterized by improved performance in combustion engines.

The ratio of succinic groups to the equivalent weight of substituent group present in the acylating agent can be determined from the saponification number of the reacted mixture corrected to account for unreacted polyalkene present in the reaction mixture at the end of the reaction (generally referred to as filtrate or residue in the following examples). Saponification number is determined using the ASTM D-94 procedure. The formula for calculating the ratio from the saponification number is as follows:

$$\text{Ratio} = \frac{(\text{Mn})(\text{Sap No., corrected})}{112{,}200 - 98(\text{Sap No., corrected})}$$

The corrected saponification number is obtained by dividing the saponification number by the percent of the polyalkene that has reacted. For example, if 10% of the polyalkene did not react and the saponification number of the filtrate or residue is 95, the corrected saponification number is 95 divided by 0.90 or 105.5.

The preparation of the acylating agents and the carboxylic acid derivative compositions (B) is illustrated by the following examples. These examples illustrate presently preferred embodiments for obtaining the desired acylating agents and carboxylic acid derivative compositions sometimes referred to in the examples as "residue" or "filtrate" without specific determination or mention of other materials present or the amounts thereof. In the following examples, and elsewhere in the specification and claims, all percentages and parts are by weight unless otherwise clearly indicated.

Acylating Agents:

Example 1

A mixture of 510 parts (0.28 mole) of polyisobutene ($\overline{M}n=1845$; $\overline{M}w=5325$) and 59 parts (0.59 mole) of maleic anhydride is heated to 110° C. This mixture is heated to 190° C. in 7 hours during which 43 parts (0.6 mole) of gaseous chlorine is added beneath the surface. At 190°-192° C. an additional 11 parts (0.16 mole) of chlorine is added over 3.5 hours. The reaction mixture is stripped by heating at 190°-193° C. with nitrogen blowing for 10 hours. The residue is the desired polyisobutene-substituted succinic acylating agent having a saponification equivalent number of 87 as determined by ASTM procedure D-94.

Example 2

A mixture of 1000 parts (0.495 mole) of polyisobutene ($\overline{M}n=2020$; $\overline{M}w=6049$) and 115 parts (1.17 moles) of maleic anhydride is heated to 110° C. This mixture is heated to 184° C. in 6 hours during which 85 parts (1.2 moles) of gaseous chlorine is added beneath the surface. At 184°-189° C. an additional 59 parts (0.83 mole) of chlorine is added over 4 hours. The reaction mixture is stripped by heating at 186°-190° C. with nitrogen blowing for 26 hours. The residue is the desired polyisobutene-substituted succinic acylating agent having a saponification equivalent number of 87 as determined by ASTM procedure D-94.

Example 3

A mixture of 3251 parts of polyisobutene chloride, prepared by the addition of 251 parts of gaseous chlorine to 3000 parts of polyisobutene ($\overline{M}n=1696$; $\overline{M}w=-6594$) at 80° C. in 4.66 hours, and 345 parts of maleic anhydride is heated to 200° C. in 0.5 hour. The reaction mixture is held at 200°-224° C. for 6.33 hours, stripped at 210° C. under vacuum and filtered. The filtrate is the desired polyisobutene-substituted succinic acylating agent having a saponification equivalent number of 94 as determined by ASTM procedure D-94.

Example 4

A mixture of 3000 parts (1.63 moles) of polyisobutene ($\overline{M}n=1845$; $\overline{M}w=5325$) and 344 parts (3.51 moles) of maleic anhydride is heated to 140° C. This mixture is heated to 201° C. in 5.5 hours during which 312 parts (4.39 moles) of gaseous chlorine is added beneath the surface. The reaction mixture is heated at 201°-236° C. with nitrogen blowing for 2 hours and stripped under vacuum at 203° C. The reaction mixture is filtered to yield the filtrate as the desired polyisobutene-substituted succinic acylating agent having a saponification equivalent number of 92 as determined by ASTM procedure D-94.

Example 5

A mixture of 3000 parts (1.49 moles) of polyisobutene ($\overline{M}n=2020$; $\overline{M}w=6049$) and 364 parts (3.71 moles) of maleic anhydride is heated at 220° C. for 8 hours. The reaction mixture is cooled to 170° C. At 170°-190° C., 105 parts (1.48 moles) of gaseous chlorine is added beneath the surface in 8 hours. The reaction mixture is heated at 190° C. with nitrogen blowing for 2 hours and then stripped under vacuum at 190° C. The reaction mixture is filtered to yield the filtrate as the desired polyisobutene-substituted succinic acylating agent.

Example 6

A mixture of 800 parts of a polyisobutene falling within the scope of the claims of the present invention and having an $\overline{M}n$ of about 2000, 646 parts of mineral oil and 87 parts of maleic anhydride is heated to 179° C. in 2.3 hours. At 176°-180° C., 100 parts of gaseous chlorine is added beneath the surface over a 19-hour period. The reaction mixture is stripped by blowing with nitrogen for 0.5 hour at 180° C. The residue is an oil-containing solution of the desired polyisobutene-substituted succinic acylating agent.

Example 7

The procedure for Example 1 is repeated except the polyisobutene ($\overline{M}n=1845$; $\overline{M}w=5325$) is replaced on an equimolar basis by polyisobutene ($\overline{M}n=1457$; $\overline{M}w=5808$).

Example 8

The procedure for Example 1 is repeated except the polyisobutene ($\overline{M}n=1845$; $\overline{M}w=5325$) is replaced on an equimolar basis by polyisobutene ($\overline{M}n=2510$; $\overline{M}w=5793$).

Example 9

The procedure for Example 1 is repeated except the polyisobutene ($\overline{M}n=1845$; $\overline{M}w=5325$) is replaced on an equimolar basis by polyisobutene ($\overline{M}n=3220$; $\overline{M}w=5660$).

Carboxylic Derivative Compositions (B):

Example B-1

A mixture is prepared by the addition of 8.16 parts (0.20 equivalent) of a commercial mixture of ethylene polyamines having from about 3 to about 10 nitrogen atoms per molecule to 113 parts of mineral oil and 161 parts (0.25 equivalent) of the substituted succinic acylating agent prepared in Example 1 at 138° C. The reaction mixture is heated to 150° C. in 2 hours and stripped by blowing with nitrogen. The reaction mixture is filtered to yield the filtrate as an oil solution of the desired product.

Example B-2

A mixture is prepared by the addition of 45.6 parts (1.10 equivalents) of a commercial mixture of ethylene polyamines having from about 3 to 10 nitrogen atoms per molecule to 1067 parts of mineral oil and 893 parts (1.38 equivalents) of the substituted succinic acylating agent prepared in Example 2 at 140°-145° C. The reaction mixture is heated to 155° C. in 3 hours and stripped by blowing with nitrogen. The reaction mixture is filtered to yield the filtrate as an oil solution of the desired product.

Example B-3

A mixture is prepared by the addition of 18.2 parts (0.433 equivalent) of a commercial mixture of ethylene polyamines having from about 3 to 10 nitrogen atoms per molecule to 392 parts of mineral oil and 348 parts (0.52 equivalent) of the substituted succinic acylating agent prepared in Example 2 at 140° C. The reaction mixture is heated to 150° C. in 1.8 hours and stripped by blowing with nitrogen. The reaction mixture is filtered to yield the filtrate as an oil solution (55% oil) of the desired product.

Examples B-4 through B-17 are prepared by following the general procedure set forth in Example B-1.

| Example Number | Amine Reactant(s) | Equivalent Ratio of Acylating Agent To Reactants | Percent Diluent |
|---|---|---|---|
| B-4 | Pentaethylene hexamine[a] | 4:3 | 40% |
| B-5 | Tris(2-aminoethyl) amine | 5:4 | 50% |
| B-6 | Imino-bis-propyl-amine | 8:7 | 40% |
| B-7 | Hexamethylene diamine | 4:3 | 40% |
| B-8 | 1-(2-Aminoethyl)-2-methyl-2-imidazoline | 5:4 | 40% |
| B-9 | N-aminopropyl-pyrrolidone | 8:7 | 40% |

[a]A commercial mixture of ethylene polyamines corresponding in empirical formula to pentaethylene hexamine.
[b]A commercial mixture of ethylene polyamines corresponding in empirical formula to diethylene triamine.
[c]A commercial mixture of ethylene polyamines corresponding in empirical formula to triethylene tetramine.

| Example Number | Amine Reactant(s) | Equivalent Ratio of Acylating Agent To Reactants | Percent Diluent |
|---|---|---|---|
| B-10 | N,N-dimethyl-1,3-Propane diamine | 5:4 | 40% |
| B-11 | Ethylene diamine | 4:3 | 40% |
| B-12 | 1,3-Propane diamine | 4:3 | 40% |
| B-13 | 2-Pyrrolidinone | 5:4 | 20% |
| B-14 | Urea | 5:4 | 50% |
| B-15 | Diethylenetri-amine[b] | 5:4 | 50% |
| B-16 | Triethylene-amine[c] | 4:3 | 50% |
| B-17 | Ethanolamine | 4:3 | 45% |

[a]A commercial mixture of ethylene polyamines corresponding in empirical formula to pentaethylene hexamine.
[b]A commercial mixture of ethylene polyamines corresponding in empirical formula to diethylene triamine.
[c]A commercial mixture of ethylene polyamines corresponding in empirical formula to triethylene tetramine.

Example B-18

An appropriate size flask fitted with a stirrer, nitrogen inlet tube, addition funnel and Dean-Stark trap/-condenser is charged with a mixture of 2483 parts acylating agent (4.2 equivalents) as described in Example 3, and 1104 parts oil. This mixture is heated to 210° C. while nitrogen was slowly bubbled through the mixture. Ethylene polyamine bottoms (134 parts, 3.14 equivalents) are slowly added over about one hour at this temperature. The temperature is maintained at about 210° C. for 3 hours and then 3688 parts oil is added to decrease the temperature to 125° C. After storage at 138° C. for 17.5 hours, the mixture is filtered through diatomaceous earth to provide a 65% oil solution of the desired acylated amine bottoms.

Example B-19

A mixture of 3660 parts (6 equivalents) of a substituted succinic acylating agent prepared as in Example 1 in 4664 parts of diluent oil is prepared and heated at about 110° C. whereupon nitrogen is blown through the mixture. To this mixture there are then added 210 parts (5.25 equivalents) of a commercial mixture of ethylene polyamines containing from about 3 to about 10 nitrogen atoms per molecule over a period of one hour and the mixture is maintained at 110° C. for an additional 0.5 hour. After heating for 6 hours at 155° C. while removing water, a filtrate is added and the reaction mixture is filtered a about 150° C. The filtrate is the oil solution of the desired product.

Example B-20

The general procedure of Example B-19 is repeated with the exception that 0.8 equivalent of the substituted succinic acylating agent of Example 1 is reacted with 0.67 equivalent of the commercial mixture of ethylene polyamines. The product obtained in this manner is an oil solution of the product containing 55% diluent oil.

Example B-21

The general procedure of Example B-19 is repeated except that the polyamines used in this example is an equivalent amount of a alkylene polyamine mixture comprising 80% of ethylene polyamine bottoms from Union Carbide and 20% of a commercial mixture of ethylene polyamines corresponding in empirical formula to diethylene triamine. This polyamine mixture is characterized as having an equivalent weight of about 43.3.

Example B-22

The general procedure of Example B-20 is repeated except that the polyamines utilized in this example comprise a mixture of 80 parts by weight of ethylene polyamine bottoms available from Dow and 20 parts by weight of diethylenetriamine. This mixture of amines has an equivalent weight of about 41.3.

Example B-23

A mixture of 444 parts (0.7 equivalent) of a substituted succinic acylating agent prepared as in Example 1 and 563 parts of mineral oil is prepared and heated to 140° C. whereupon 22.2 parts of an ethylene polyamine mixture corresponding in empirical formula to triethylene tetramine (0.58 equivalent) are added over a period of one hour as the temperature is maintained at 140° C. The mixture is blown with nitrogen as it is heated to 150° C. and maintained at this temperature for 4 hours while removing water. The mixture then is filtered through a filter aid at about 135° C., and the filtrate is an oil solution of the desired product comprising about 55% of mineral oil.

Example B-24

A mixture of 422 parts (0.7 equivalent) of the substituted succinic acylating agent prepared as in Example 1 and 188 parts of mineral oil is prepared and heated to 210° C. whereupon 22.1 parts (0.53 equivalent) of a commercial mixture of ethylene polyamine bottoms from Dow are added over a period of one hour blowing with nitrogen. The temperature then is increased to about 210°-216° C. and maintained at this temperature for 3 hours. Mineral oil (625 parts) is added and the mixture is maintained at 135° C. for about 17 hours whereupon the mixture is filtered and the filtrate is an oil solution of the desired product (65% oil).

Example B-25

The general procedure of Example B-24 is repeated except that the polyamine used in this example is a commercial mixture of ethylene polyamines having from about 3 to 10 nitrogen atoms per molecule (equivalent weight of 42).

Example B-26

A mixture is prepared of 414 parts (0.71 equivalent) of a substituted succinic acylating agent prepared as in Example 1 and 183 parts of mineral oil. This mixture is heated to 210° C. whereupon 20.5 parts (0.49 equivalent) of a commercial mixture of ethylene polyamines having from about 3 to 10 nitrogen atoms per molecule are added over a period of about one hour as the temperature is increased to 210°-217° C. The reaction mixture is maintained at this temperature for 3 hours while blowing with nitrogen, and 612 parts of mineral oil are added. The mixture is maintained at 145°-135° C. for about one hour, and at 135° C. for 17 hours. The mixture is filtered while hot, and the filtrate is an oil solution of the desired product (65% oil).

Example B-27

A mixture of 414 parts (0.71 equivalent) of a substituted succinic acylating agent prepared as in Example 1 and 184 parts of mineral oil is prepared and heated to about 80° C. whereupon 22.4 parts (0.534 equivalent) of melamine are added. The mixture is heated to 160° C. over a period of about 2 hours and maintained at this temperature for 5 hours. After cooling overnight, the mixture is heated to 170° C. over 2.5 hours and to 215° C. over a period of 1.5 hours. The mixture is maintained at about 215° C. for about 4 hours and at about 220° C. for 6 hours. After cooling overnight, the reaction mixture is filtered at 150° C. through a filter aid. The filtrate is an oil solution of the desired product (30% mineral oil).

Example B-28

A mixture of 414 parts (0.71 equivalent) of the substituted acylating agent prepared in Example 1 and 184 parts of mineral oil is heated to 210° C. whereupon 21 parts (0.53 equivalent) of a commercial mixture of ethylene polyamine corresponding in empirical formula to tetraethylene pentamine are added over a period of 0.5 hour as the temperature is maintained at about 210°-217° C. Upon completion of the addition of the polyamine, the mixture is maintained at 217° C. for 3 hours while blowing with nitrogen. Mineral oil is added (613 parts) and the mixture is maintained at about 135° C. for 17 hours and filtered. The filtrate is an oil solution of the desired product (65% mineral oil).

Example B-29

A mixture of 414 parts (0.71 equivalent) of the substituted acylating agent prepared in Example 1 and 183 parts of mineral oil is prepared and heated to 210° C. whereupon 18.3 parts (0.44 equivalent) of ethylene amine bottoms (Dow) are added over a period of one hour while blowing with nitrogen. The mixture is heated to about 210°-217° C. in about 15 minutes and maintained at this temperature for 3 hours. An additional 608 parts of mineral oil are added and the mixture is maintained at about 135° C. for 17 hours. The mixture is filtered at 135° C. through a filter aid, and the filtrate is an oil solution of the desired product (65% oil).

Example B-30

The general procedure of Example B-29 is repeated except that the ethylene amine bottoms are replaced by an equivalent amount of a commercial mixture of ethylene polyamines having from about 3 to 10 nitrogen atoms per molecule.

Example B-31

A mixture of 422 parts (0.70 equivalent) of the substituted acylating agent of Example 1 and 190 parts of mineral oil is heated to 210° C. whereupon 26.75 parts (0.636 equivalent) of ethylene amine bottoms (Dow) are added over one hour while blowing with nitrogen. After all of the ethylene amine is added, the mixture is maintained at 210°-215° C. for about 4 hours, and 632 parts of mineral oil are added with stirring. This mixture is maintained for 17 hours at 135° C. and filtered through a filter aid. The filtrate is an oil solution of the desired product (65% oil).

Example B-32

A mixture of 468 parts (0.8 equivalent) of the substituted succinic acylating agent of Example 1 and 908.1 parts of mineral oil is heated to 142° C. whereupon 28.63 parts (0.7 equivalent) of ethylene amine bottoms (Dow) are added over a period of 1.5-2 hours. The mixture was stirred an additional 4 hours at about 142° C. and filtered. The filtrate is an oil solution of the desired product (65% oil).

Example B-33

A mixture of 2653 parts of the substituted acylating agent of Example 1 and 1186 parts of mineral oil is heated to 210° C. whereupon 154 parts of ethylene amine bottoms (Dow) are added over a period of 1.5 hours as the temperature is maintained between 210°-215° C. The mixture is maintained at 215°-220° C. for a period of about 6 hours. Mineral oil (3953 parts) is added at 210° C. and the mixture is stirred for 17 hours with nitrogen blowing at 135°-128° C. The mixture is filtered hot through a filter aid, and the filtrate is an oil solution of the desired product (65% oil).

(C) Alkali Metal Salt:

Component (C) of the lubricating oil compositions of this invention is at least one basic alkali metal salt of at least one sulfonic or carboxylic acid. This component is among those art-recognized metal-containing compositions variously referred to by such names as "basic", "superbased" and "overbased" salts or complexes. The method for their preparation is commonly referred to as "overbasing". The term "metal ratio" is often used to define the quantity of metal in these salts or complexes relative to the quantity of organic anion, and is defined as the ratio of the number of equivalents of metal to the number of equivalents of metal which would be present in a normal salt based upon the usual stoichiometry of the compounds involved.

A general description of some of the alkali metal salts useful as component (C) is contained in U.S. Pat. No. 4,326,972 (Chamberlin). This patent is hereby incorporated by reference for its disclosure of useful alkali metal salts and methods of preparing said salts.

The alkali metals present in the basic alkali metal salts (C) include principally lithium, sodium and potassium, with sodium and potassium being preferred.

The sulfonic acids which are useful in preparing component (C) include those represented by the formulae $$R_xT(SO_3H)_y \quad \text{(IX)}$$

and $$R'(SO_3H)_r \quad \text{(X)}$$

In these formulae, R' is an aliphatic or aliphatic-substituted cycloaliphatic hydrocarbon or essentially hydrocarbon group free from acetylenic unsaturation and containing up to about 60 carbon atoms. When R' is aliphatic, it usually contains at least about 15 carbon atoms; when it is an aliphatic-substituted cycloaliphatic group, the aliphatic substituents usually contain a total of at least about 12 carbon atoms. Examples of R' are alkyl, alkenyl and alkoxyalkyl radicals, and aliphatic-substituted cycloaliphatic groups wherein the aliphatic substituents are alkyl, alkenyl, alkoxy, alkoxyalkyl, carboxyalkyl and the like. Generally, the cycloaliphatic nucleus is derived from a cycloalkane or a cycloalkene such as cyclopentane, cyclohexane, cyclohexene or cyclopentene. Specific examples of R' are cetylcyclohexyl, laurylcyclohexyl, cetyloxyethyl, octadecenyl, and groups derived from petroleum, saturated and unsaturated paraffin wax, and olefin polymers including polymerized monoolefins and diolefins containing about 2–8 carbon atoms per olefinic monomer unit. R' can also contain other substituents such as phenyl, cycloalkyl, hydroxy, mercapto, halo, nitro, amino, nitroso, lower alkoxy, lower alkylmercapto, carboxy, carbalkoxy, oxo or thio, or interrupting groups such as —NH—, —O— or —S—, as long as the essentially hydrocarbon character thereof is not destroyed.

R in Formula IX is generally a hydrocarbon or essentially hydrocarbon group free from acetylenic unsaturation and containing from about 4 to about 60 aliphatic carbon atoms, preferably an aliphatic hydrocarbon group such as alkyl or alkenyl. It may also, however, contain substituents or interrupting groups such as those enumerated above provided the essentially hydrocarbon character thereof is retained. In general, any non-carbon atoms present in R' or R do not account for more than 10% of the total weight thereof.

T is a cyclic nucleus which may be derived from an aromatic hydrocarbon such as benzene, naphthalene, anthracene or biphenyl, or from a heterocyclic compound such as pyridine, indole or isoindole. Ordinarily, T is an aromatic hydrocarbon nucleus, especially a benzene or naphthalene nucleus.

The subscript x is at least 1 and is generally 1–3. The subscripts r and y have an average value of about 1–2 per molecule and are generally also 1.

The sulfonic acids are generally petroleum sulfonic acids or synthetically prepared alkaryl sulfonic acids. Among the petroleum sulfonic acids, the most useful products are those prepared by the sulfonation of suitable petroleum fractions with a subsequent removal of acid sludge, and purification. Synthetic alkaryl sulfonic acids are prepared usually from alkylated benzenes such as the Friedel-Crafts reaction products of benzene and polymers such as tetrapropylene. The following are specific examples of sulfonic acids useful in preparing the salts (C). It is to be understood that such examples serve also to illustrate the salts of such sulfonic acids useful as component (C). In other words, for every sulfonic acid enumerating, it is intended that the corresponding basic alkali metal salts thereof are also understood to be illustrated. (The same applies to the lists of carboxylic acid materials listed below.) Such sulfonic acids include mahogany sulfonic acids, bright stock sulfonic acids, petrolatum sulfonic acids, mono- and polywax-substituted naphthalene sulfonic acids, cetylchlorobenzene sulfonic acids, cetylphenol sulfonic acids, cetylphenol disulfide sulfonic acids, cetoxycapryl benzene sulfonic acids, dicetyl thianthrene sulfonic acids, dilauryl beta-naphthol sulfonic acids, dicapryl nitronaphthalene sulfonic acids, saturated paraffin wax sulfonic acids, unsaturated paraffin wax sulfonic acids, hydroxy-substituted paraffin wax sulfonic acids, tetraisobutylene sulfonic acids, tetra-amylene sulfonic acids, chloro-substituted paraffin wax sulfonic acids, nitroso-substituted paraffin wax sulfonic acids, petroleum naphthene sulfonic acids, cetylcyclopentyl sulfonic acids, lauryl cyclohexyl sulfonic acids, mono- and polywax-substituted cyclohexyl sulfonic acids, dodecylbenzene sulfonic acids, "dimer alkylate" sulfonic acids, and the like.

Alkyl-substituted benzene sulfonic acids wherein the alkyl group contains at least 8 carbon atoms including dodecyl benzene "bottoms" sulfonic acids are particularly useful. The latter are acids derived from benzene which has been alkylated with propylene tetramers or isobutene trimers to introduce 1, 2, 3, or more branched-chain $C_{12}$ substituents on the benzene ring. Dodecyl benzene bottoms, principally mixtures of mono and di-dodecyl benzenes, are available as by-products from the manufacture of household detergents. Similar products obtained from alkylation bottoms formed during manufacture of linear alkyl sulfonates (LAS) are also useful in making the sulfonates used in this invention.

The production of sulfonates from detergent manufacture by-products by reaction with, e.g., $SO_3$, is well known to those skilled in the art. See, for example, the article "Sulfonates" in Kirk-Othmer "Encyclopedia of Chemical Technology", Second Edition, Vol. 19, pp. 291 et seq. published by John Wiley & Sons, N.Y. (1969).

Other descriptions of basic sulfonate salts which can be incorporated into the lubricating oil compositions of this invention as component (C), and techniques for making them can be found in the following U.S. Pat. Nos.: 2,174,110; 2,202,781; 2,239,974; 2,319,121; 2,337,552; 3,488,284; 3,595,790; and 3,798,012. These are hereby incorporated by reference for their disclosures in this regard.

Suitable carboxylic acids from which useful alkali metal salts can be prepared include aliphatic, cycloaliphatic and aromatic mono- and polybasic carboxylic acids free from acetylenic unsaturation, including naphthenic acids, alkyl- or alkenyl-substituted cyclopentanoic acids, alkyl- or alkenyl-substituted cyclohexanoic acids, and alkyl- or alkenyl-substituted aromatic carboxylic acids. The aliphatic acids generally contain from about 8 to about 50, and preferably from about 12 to about 25 carbon atoms. The cycloaliphatic and aliphatic carboxylic acids are preferred, and they can be saturated or unsaturated. Specific examples include 2-ethylhexanoic acid, linolenic acid, propylene tetramer-substituted maleic acid, behenic acid, isostearic acid, pelargonic acid, capric acid, palmitoleic acid, linoleic acid, lauric acid, oleic acid, ricinoleic acid, undecyclic acid, dioctylcyclopentanecarboxylic acid, myristic acid, dilauryldecahydronaphthalene-carboxylic acid, stearyloctahydroindenecarboxylic acid, palmitic acid, alkyl- and alkenylsuccinic acids, acids formed by oxidation of petrolatum or of hydrocarbon waxes, and commercially available mixtures of two or more carboxylic acids such as tall oil acids, rosin acids, and the like.

The equivalent weight of the acidic organic compound is its molecular weight divided by the number of acidic groups (i.e., sulfonic acid or carboxy groups) present per molecule.

In one preferred embodiment, the alkali metal salts (C) are basic alkali metal salts having metal ratios of at least about 2 and more generally from about 4 to about 40, preferably from about 6 to about 30 and especially from about 8 to about 25.

In another and preferred embodiment, the basic salts (C) are oil-soluble dispersions prepared by contacting for a period of time sufficient to form a stable dispersion, at a temperature between the solidification temperature of the reaction mixture and its decomposition temperature:

(C-1) at least one acidic gaseous material selected from the group consisting of carbon dioxide, hydrogen sulfide and sulfur dioxide, with (C-2) a reaction mixture comprising (C-2-a) at least one oil-soluble sulfonic acid, or derivative thereof susceptible to overbasing;

(C-2-b) at least one alkali metal or basic alkali metal compound;

(C-2-c) at least one lower aliphatic alcohol, alkyl phenol, or sulfurized alkyl phenol; and (C-2-d) at least one oil-soluble carboxylic acid or functional derivative thereof. When (C-2-c) is an alkyl phenol or a sulfurized alkyl phenol, component (C-2-d) is optional. A satisfactory basic sulfonic acid salt can be prepared with or without the carboxylic acid in the mixture (C-2).

Reagent (C-1) is at least one acidic gaseous material which may be carbon dioxide, hydrogen sulfide or sulfur dioxide; mixtures of these gases are also useful. Carbon dioxide is preferred.

As mentioned above, component (C-2) generally is a mixture containing at least four components of which component (C-2-a) is at least one oil-soluble sulfonic acid as previously defined, or a derivative thereof susceptible to overbasing. Mixtures of sulfonic acids and/or their derivatives may also be used. Sulfonic acid derivatives susceptible to overbasing include their metal salts, especially the alkaline earth, zinc and lead salts; ammonium salts and amine salts (e.g., the ethylamine, butylamine and ethylene polyamine salts); and esters such as the ethyl, butyl and glycerol esters.

Component (C-2-b) is at least one alkali metal or a basic compound thereof. Illustrative of basic alkali metal compounds are the hydroxides, alkoxides (typically those in which the alkoxy group contains up to 10 and preferably up to 7 carbon atoms), hydrides and amides. Thus, useful basic alkali metal compounds include sodium hydroxide, potassium hydroxide, lithium hydroxide, sodium propoxide, lithium methoxide, potassium ethoxide, sodium butoxide, lithium hydride, sodium hydride, potassium hydride, lithium amide, sodium amide and potassium amide. Especially preferred are sodium hydroxide and the sodium lower alkoxides (i.e., those containing up to 7 carbon atoms). The equivalent weight of component (C-2-b) for the purpose of this invention is equal to its molecular weight, since the alkali metals are monovalent.

Component (C-2-c) may be at least one lower aliphatic alcohol, preferably a monohydric or dihydric alcohol. Illustrative alcohols are methanol, ethanol, 1-propanol, 1-hexanol, isopropanol, isobutanol, 2-pentanol, 2,2-dimethyl-1-propanol, ethylene glycol, 1-3-propanediol and 1,5-pentanediol. The alcohol also may be a glycol ether such as Methyl Cellosolve. Of these, the preferred alcohols are methanol, ethanol and propanol, with methanol being especially preferred.

Component (C-2-c) also may be at least one alkyl phenol or sulfurized alkyl phenol. The sulfurized alkyl phenols are preferred, especially when (C-2-b) is potassium or one of its basic compounds such as potassium hydroxide. As used herein, the term "phenol" includes compounds having more than one hydroxy group bound to an aromatic ring, and the aromatic ring may be a benzyl or naphthyl ring. The term "alkyl phenol" includes mono- and di-alkylated phenols in which each alkyl substituent contains from about 6 to about 100 carbon atoms, preferably about 6 to about 50 carbon atoms.

Illustrative alkyl phenols include heptylphenols, octylphenols, decylphenols, dodecylphenols, polypropylene ($\overline{M}n$ of about 150)-substituted phenols, polyisobutene ($\overline{M}n$ of about 1200)-substituted phenols, cyclohexyl phenols.

Also useful are condensation products of the above-described phenols with at least one lower aldehyde or ketone, the term "lower" denoting aldehydes and ketones containing not more than 7 carbon atoms. Suitable aldehydes include formaldehyde, acetaldehyde, propionaldehyde, the butyraldehydes, the valeraldehydes and benzaldehyde. Also suitable are aldehyde-yielding reagents such as paraformaldehyde, trioxane, methylol, Methyl Formcel and paraldehyde. Formaldehyde and the formalde- hyde-yielding reagents are especially preferred.

The sulfurized alkylphenols include phenol sulfides, disulfides or polysulfides. The sulfurized phenols can be derived from any suitable alkylphenol by technique known to those skilled in the art, and many sulfurized phenols are commercially available. The sulfurized alkylphenols may be prepared by reacting an alkylphenol with elemental sulfur and/or a sulfur monohalide (e.g., sulfur monochloride). This reaction may be conducted in the presence of excess base to result in the salts of the mixture of sulfides, disulfides or polysulfides that may be produced depending upon the reaction conditions. It is the resulting product of this reaction which is used in the preparation of component (C-2) in the present invention. U.S. Pat. Nos. 2,971,940 and 4,309,293 disclose various sulfurized phenols which are illustrative of component (C-2-c), and such disclosures of these patents are hereby incorporated by reference.

The following non-limiting examples illustrate the preparation of alkylphenols and sulfurized alkylphenols useful as component (C-2-c).

Example 1-C

While maintaining a temperature of 55° C., 100 parts phenol and 68 parts sulfonated polystyrene catalyst (marketed as Amberlyst-15 by Rohm and Haas Company) are charged to a reactor equipped with a stirrer, condenser, thermometer and subsurface gas inlet tube. The reactor contents are then heated to 120° C. while nitrogen blowing for 2 hours. Propylene tetramer (1232 parts) is charged, and the reaction mixture is stirred at 120° C. for 4 hours. Agitation is stopped, and the batch is allowed to settle for 0.5 hour. The crude supernatant reaction mixture is filtered and vacuum stripped until a maximum of 0.5% residual propylene tetramer remains.

Example 2-C

Benzene (217 parts) is added to phenol (324 parts, 3.45 moles) at 38° C. and the mixture is heated to 47° C. Boron trifluoride (8.8 parts, 0.13 mole) is blown into the mixture over a one-half hour period at 38°-52° C. Polyisobutene (1000 parts, 1.0 mole) derived from the polymerization of C4 monomers predominating in isobutylene is added to the mixture at 52°-58° C. over a 3.5 hour period. The mixture is held at 52° C. for 1 additional hour. A 26% solution of aqueous ammonia (15 parts) is added and the mixture is heated to 70° C. over a 2-hour period. The mixture is then filtered and the filtrate is the desired crude polyisobutene-substituted phenol. This intermediate is stripped by heating 1465 parts to 167° C. and the pressure is reduced to 10 mm. as the material is heated to 218° C. in a 6-hour period. A 64% yield of stripped polyisobutene-substituted phenol ($\overline{M}n=885$) is obtained as the residue.

Example 3-C

A reactor equipped with a stirrer, condenser, thermometer and subsurface addition tube is charged with 1000 parts of the reaction product of Example 1-C. The temperature is adjusted to 48°-49° C. and 319 parts sulfur dichloride is added while the temperature is kept below 60° C. The batch is then heated to 88°-93° C. while nitrogen blowing until the acid number (using bromphenol blue indicator) is less than 4.0. Diluent oil (400 parts) is then added, and the mixture is mixed thoroughly.

Example 4-C

Following the procedure of Example 3-C, 1000 parts of the reaction product of Example 1-C is reacted with 175 parts of sulfur dichloride. The reaction product is diluted with 400 parts diluent oil.

Example 5-C

Following the procedure of Example 3-C, 1000 parts of the reaction product of Example 1-C is reacted with 319 parts of sulfur dichloride. Diluent oil (788 parts) is added to the reaction product, and the materials are mixed thoroughly.

Example 6-C

Following the procedure of Example 4-C, 1000 parts of the reaction product of Example 2-C are reacted with 44 parts of sulfur dichloride to produce the sulfurized phenol.

Example 7-C

Following the procedure of Example 5-C, 1000 parts of the reaction product of Example 2-C are reacted with 80 parts of sulfur dichloride.

The equivalent weight of component (C-2-c) is its molecular weight divided by the number of hydroxy groups per molecule.

Component (C-2-d) is at least one oil-soluble carboxylic acid as previously described, or functional derivative thereof. Especially suitable carboxylic acids are those of the formula $R^5(COOH)_n$, wherein n is an integer from 1 to 6 and is preferably 1 or 2 and $R^5$ is a saturated or substantially saturated aliphatic radical (preferably a hydrocarbon radical) having at least 8 aliphatic carbon atoms. Depending upon the value of n, $R^5$ will be a monovalent to hexavalent radical.

$R^5$ may contain non-hydrocarbon substituents provided they do not alter substantially its hydrocarbon character. Such substituents are preferably present in amounts of not more than about 20% by weight. Exemplary substituents include the non-hydrocarbon substituents enumerated hereinabove with reference to component (C-2a). $R^5$ may also contain olefinic unsaturation up to a maximum of about 5% and preferably not more than 2% olefinic linkages based upon the total number of carbon- to-carbon covalent linkages present. The number of carbon atoms in $R^5$ is usually about 8-700 depending upon the source of $R^5$. As discussed below, a preferred series of carboxylic acids and derivatives is prepared by reacting an olefin polymer or halogenated olefin polymer with an alpha,beta-unsaturated acid or its anhydride such as acrylic, methacrylic, maleic or fumaric acid or maleic anhydride to form the corresponding substituted acid or derivative thereof. The $R^5$ groups in these products have a number average molecular weight from about 150 to about 10,000 and usually from about 700 to about 5000, as determined, for example, by gel permeation chromatography.

The monocarboxylic acids useful as component (C-2-d) have the formula $R^5COOH$. Examples of such acids are caprylic, capric, palmitic, stearic, isostearic, linoleic and behenic acids. A particularly preferred group of monocarboxylic acids is prepared by the reaction of a halogenated olefin polymer, such as a chlorinated polybutene, with acrylic acid or methacrylic acid.

Suitable dicarboxylic acids include the substituted succinic acids having the formula $$\begin{array}{l} R^6CHCOOH \\ \quad\;\; | \\ \quad\;\; CH_2COOH \end{array}$$

wherein $R^6$ is the same as $R^5$ as defined above. $R^6$ may be an olefin polymer-derived group formed by polymerization of such monomers as ethylene, propylene, 1-butene, isobutene, 1-pentene, 2-pentene, 1-hexene and 3-hexene. $R^6$ may also be derived from a high molecular weight substantially saturated petroleum fraction. The hydrocarbon-substituted succinic acids and their derivatives constitute the most preferred class of carboxylic acids for use as component (C-2-d).

The above-described classes of carboxylic acids derived from olefin polymers, and their derivatives, are well known in the art, and methods for their preparation as well as representative examples of the types useful in the present invention are described in detail in a number of U.S. Patents.

Functional derivatives of the above-discussed acids useful as component (C-2-d) include the anhydrides, esters, amides, imides, amidines and metal or ammonium salts. The reaction products of olefin polymer-substituted succinic acids and mono- or polyamines, particularly polyalkylene polyamines, having up to about 10 amino nitrogens are especially suitable. These reaction products generally comprise mixtures of one or more of amides, imides and amidines. The reaction products of polyethylene amines containing up to about 10 nitrogen atoms and polybutene-substituted succinic anhydride wherein the polybutene radical comprises principally isobutene units are particularly useful. Included in this group of functional derivatives are the compositions prepared by post-treating the amine-anhydride reaction product with carbon disulfide, boron compounds, nitriles, urea, thiourea, guanidine, alkylene oxides or the like. The half-amide, half-metal salt and half-ester, half-metal salt derivatives of such substituted succinic acids are also useful.

Also useful are the esters prepared by the reaction of the substituted acids or anhydrides with a mono- or polyhydroxy compound, such as an aliphatic alcohol or a phenol. Preferred are the esters of olefin polymer-substituted succinic acids or anhydrides and polyhydric aliphatic alcohols containing 2–10 hydroxy groups and up to about 40 aliphatic carbon atoms. This class of alcohols includes ethylene glycol, glycerol, sorbitol, pentaerythritol, polyethylene glycol, diethanolamine, triethanolamine, N,N'-di(hydroxyethyl)ethylene diamine and the like. When the alcohol contains reactive amino groups, the reaction product may comprise products resulting from the reaction of the acid group with both the hydroxy and amino functions. Thus, this reaction mixture can include half-esters, half-amides, esters, amides, and imides.

The ratios of equivalents of the constituents of reagent (C-2) may vary widely. In general, the ratio of component (C-2-b) to (C-2-a) is at least about 4:1 and usually not more than about 40:1, preferably between 6:1 and 30:1 and most preferably between 8:1 and 25:1. While this ratio may sometimes exceed 40:1, such an excess normally will serve no useful purpose.

The ratio of equivalents of component (C-2-c) to component (C-2-a) is between about 1:20 and 80:1, and preferably between about 2:1 and 50:1. As mentioned above, when component (C-2-c) is an alkyl phenol or sulfurized alkyl phenol, the inclusion of the carboxylic acid (C-2-d) is optional. When present in the mixture, the ratio of equivalents of component (C-2-d) to component (C-2-a) generally is from about 1:1 to about 1:20 and preferably from about 1:2 to about 1:10.

Up to about a stoichiometric amount of acidic material (C-1) is reacted with (C-2). In one embodiment, the acidic material is metered into the (C-2) mixture and the reaction is rapid. The rate of addition of (C-1) is not critical, but may have to be reduced if the temperature of the mixture rises too rapidly due to the exothermicity of the reaction.

When (C-2-c) is an alcohol, the reaction temperature is not critical. Generally, it will be between the solidification temperature of the reaction mixture and its decomposition temperature (i.e., the lowest decomposition temperature of any component thereof). Usually, the temperature will be from about 25° C. to about 200° C. and preferably from about 50° C. to about 150° C. Reagents (C-1) and (C-2) are conveniently contacted at the reflux temperature of the mixture. This temperature will obviously depend upon the boiling points of the various components; thus, when methanol is used as component (C-2-c), the contact temperature will be at or below the reflux temperature of methanol.

When reagent (C-2-c) is an alkyl phenol or a sulfurized alkyl phenol, the temperature of the reaction must be at or above the water-diluent azeotrope temperature so that the water formed in the reaction can be removed.

The reaction is ordinarily conducted at atmospheric pressure, although superatmospheric pressure often expedites the reaction and promotes optimum utilization of reagent (C-1). The process can also be carried out at reduced pressure but, for obvious practical reasons, this is rarely done.

The reaction is usually conducted in the presence of a substantially inert, normally liquid organic diluent such as a low viscosity lubricating oil, which functions as both the dispersing and reaction medium. This diluent will comprise at least about 10% of the total weight of the reaction mixture. Ordinarily it will not exceed about 80% by weight, and it is preferably about 30–70% thereof.

Upon completion of the reaction, any solids in the mixture are preferably removed by filtration or other conventional means. Optionally, readily removable diluents, the alcoholic promoters, and water formed during the reaction can be removed by conventional techniques such as distillation. It is usually desirable to remove substantially all water from the reaction mixture since the presence of water may lead to difficulties in filtration and to the formation of undesirable emulsions in fuels and lubricants. Any such water present is readily removed by heating at atmospheric or reduced pressure or by azeotropic distillation. In one preferred embodiment, when basic potassium sulfonates are desired as component (C), the potassium salt is prepared using carbon dioxide and the sulfurized alkylphenols as component (C-2-c). The use of the sulfurized phenols results in basic salts of higher metal ratios and the formation of more uniform and stable salts.

The chemical structure of component (C) is not known with certainty. The basic salts or complexes may be solutions or, more likely, stable dispersions. Alternatively, they may be regarded as "polymeric salts" formed by the reaction of the acidic material, the oil-soluble acid being overbased, and the metal compound. In view of the above, these compositions are most conveniently defined by reference to the method by which they are formed.

The above-described procedures for preparing alkali metal salts of sulfonic acids having a metal ratio of at least about 2 and preferably a metal ratio between about 4 to 40 using alcohols as component (C-2-c) is described in more detail in U.S. Pat. No. 4,326,972 which has been incorporated by reference for the disclosures of such processes. The preparation of oil-soluble dispersions of alkali metal sulfonates useful as component (C) in the lubricating oil compositions of this invention is illustrated in the following examples.

Example C-1

To a solution of 790 parts (1 equivalent) of an alkylated benzenesulfonic acid and 71 parts of polybutenyl succinic anhydride (equivalent weight about 560) containing predominantly isobutene units in 176 parts of mineral oil is added 320 parts (8 equivalents) of sodium hydroxide and 640 parts (20 equivalents) of methanol.

The temperature of the mixture increases to 89° C. (reflux) over 10 minutes due to exotherming. During this period, the mixture is blown with carbon dioxide at 4 cfh. (cubic feet/hr.). Carbonation is continued for about 30 minutes as the temperature gradually decreases to 74° C. The methanol and other volatile materials are stripped from the carbonated mixture by blowing nitrogen through it at 2 cfh. while the temperature is slowly increased to 150° C. over 90 minutes. After stripping is completed, the remaining mixture is held at 155°-165° C. for about 30 minutes and filtered to yield an oil solution of the desired basic sodium sulfonate having a metal ratio of about 7.75. This solution contains 12.4% oil.

Example C-2

Following the procedure of Example C-1, a solution of 780 parts (1 equivalent) of an alkylated benzenesulfonic acid and 119 parts of the polybutenyl succinic anhydride in 442 parts of mineral oil is mixed with 800 parts (20 equivalents) of sodium hydroxide and 704 parts (22 equivalents) of methanol. The mixture is blown with carbon dioxide at 7 cfh. for 11 minutes as the temperature slowly increases to 97° C. The rate of carbon dioxide flow is reduced to 6 cfh. and the temperature decreases slowly to 88° C. over about 40 minutes. The rate of carbon dioxide flow is reduced to 5 cfh. for about 35 minutes and the temperature slowly decreases to 73° C. The volatile materials are stripped by blowing nitrogen through the carbonated mixture at 2 cfh. for 105 minutes as the temperature is slowly increased to 160° C. After stripping is completed, the mixture is held at 160° C. for an additional 45 minutes and then filtered to yield an oil solution of the desired basic sodium sulfonate having a metal ratio of about 19.75. This solution contains 18.7% oil.

Example C-3

Following the procedure of Example C-1, a solution of 3120 parts (4 equivalents) of an alkylated benzenesulfonic acid and 284 parts of the polybutenyl succinic anhydride in 704 parts of mineral oil is mixed with 1280 parts (32 equivalents) of sodium hydroxide and 2560 parts (80 equivalents) of methanol. The mixture is blown with carbon dioxide at 10 cfh. for 65 minutes as the temperature increases to 90° C. and then slowly decreases to 70° C. The volatile material is stripped by blowing nitrogen at 2 cfh. for 2 hours as the temperature is slowly increased to 160° C. After stripping is completed, the mixture is held at 160° C. for 0.5 hour, and then filtered to yield an oil solution of the desired basic sodium sulfonate having a metal ratio of about 7.75. This solution contains 12.35% oil content.

Example C-4

Following the procedure of Example C-1, a solution of 3200 parts (4 equivalents) of an alkylated benzenesulfonic acid and 284 parts of the polybutenyl succinic anhydride in 623 parts of mineral oil is mixed with 1280 parts (32 equivalents) of sodium hydroxide and 2560 parts (80 equivalents) of methanol. The mixture is blown with carbon dioxide at 10 cfh. for about 77 minutes. During this time the temperature increases to 92° C. and then gradually drops to 73° C. The volatile materials are stripped by blowing with nitrogen gas at 2 cfh. for about 2 hours as the temperature of the reaction mixture is slowly increased to 160° C. The final traces of volatile material are vacuum stripped and the residue is held at 170° C. and then filtered to yield a clear oil solution of the desired sodium salt, having a metal ratio of about 7.72. This solution has an oil content of 11%.

Example C-5

Following the procedure of Example C-1, a solution of 780 parts (1 equivalent) of an alkylated benzenesulfonic sulfonic acid and 86 parts of the polybutenyl succinic anhydride in 254 parts of mineral oil is mixed with 480 parts (12 equivalents) of sodium hydroxide and 640 parts (20 equivalents) of methanol. The reaction mixture is blown with carbon dioxide at 6 cfh. for about 45 minutes. During this time the temperature increases to 95° C. and then gradually decreases to 74° C. The volatile material is stripped by blowing with nitrogen gas at 2 cfh. for about one hour as the temperature is increased to 160° C. After stripping is complete the mixture is held at 160° C. for 0.5 hour and then filtered to yield an oil solution of the desired sodium salt, having a metal ratio of 11.8. The oil content of this solution is 14.7%.

Example C-6

Following the procedure of Example C-1, a solution of 3120 parts (4 equivalents) of an alkylated benzenesulfonic acid and 344 parts of the polybutenyl succinic anhydride in 1016 parts of mineral oil is mixed with 1920 parts (48 equivalents) of sodium hydroxide and 2560 parts (80 equivalents) of methanol. The mixture is blown with carbon dioxide at 10 cfh. for about 2 hours. During this time the temperature increases to 96° C. and then gradually drops to 74° C. The volatile materials are stripped by blowing with nitrogen gas at 2 cfh. for about 2 hours as the temperature is increased from 74° C. to 160° C. by external heating. The stripped mixture is heated for an additional hour at 160° C. and filtered. The filtrate is vacuum stripped to remove a small amount of water, and again filtered to give a solution of the desired sodium salt, having a metal ratio of about 11.8. The oil content of this solution is 14.7%.

Example C-7

Following the procedure of Example C-1, a solution of 2800 parts (3.5 equivalents) of an alkylated benzenesulfonic acid and 302 parts of the polybutenyl succinic anhydride in 818 parts of mineral oil is mixed with 1680 parts (42 equivalents) of sodium hydroxide and 2240 parts (70 equivalents) of methanol. The mixture is blown with carbon dioxide for about 90 minutes at 10 cfh. During this period, the temperature increases to 96° C. and then slowly drops to 76° C. The volatile materials are stripped by blowing with nitrogen at 2 cfh. as the temperature is slowly increased from 76° C. to 165° C. by external heating. Water is removed by vacuum stripping. Upon filtration, an oil solution of the desired basic sodium salt is obtained. It has a metal ratio of about 10.8 and the oil content is 13.6%.

Example C-8

Following the procedure of Example C-1, a solution of 780 parts (1 equivalent) of an alkylated benzenesulfonic acid and 103 parts of the polybutenyl succinic anhydride in 350 parts of mineral oil is mixed with 640 parts (16 equivalents) of sodium hydroxide and 640 parts (20 equivalents) of methanol. This mixture is blown with carbon dioxide for about one hour at 6 cfh. During this period, the temperature increases to 95° C. and then gradually decreases to 75° C. The volatile material is stripped by blowing with nitrogen. During stripping, the temperature initially drops to 70° C. over 30 minutes and then slowly rises to 78° C. over 15 minutes. The mixture is then heated to 155° C. over 80 minutes. The stripped mixture is heated for an additional 30 minutes at 155°-160° C. and filtered. The filtrate is an oil solution of the desired basic sodium sulfonate, having a metal ratio of about 15.2. It has an oil content of 17.1%.

Example C-9

Following the procedure of Example C-1, a solution of 2400 parts (3 equivalents) of an alkylated benzenesulfonic acid and 308 parts of the polybutenyl succinic anhydride in 991 parts of mineral oil is mixed with 1920 parts (48 equivalents) of sodium hydroxide and 1920 parts (60 equivalents) of methanol. This mixture is blown with carbon dioxide at 10 cfh. for 110 minutes, during which time the temperature rises to 98° C. and then slowly decreases to 76° C. over about 95 minutes. The methanol and water are stripped by blowing with nitrogen at 2 cfh. as the temperature of the mixture slowly increases to 165° C. The last traces of volatile material are vacuum stripped and the residue is filtered to yield an oil solution of the desired sodium salt having a metal ratio of 15.1. The solution has an oil content of 16.1%.

Example C-10

Following the procedure of Example C-1, a solution of 780 parts (1 equivalent) of an alkylated benzenesulfonic acid and 119 parts of the polybutenyl succinic anhydride in 442 parts of mineral oil is mixed well with 800 parts (20 equivalents) of sodium hydroxide and 640 parts (20 equivalents) of methanol. This mixture is blown with carbon dioxide for about 55 minutes at 8 cfh. During this period, the temperature of the mixture increases to 95° C. and then slowly decreases to 67° C. The methanol and water are stripped by blowing with nitrogen at 2 cfh. for about 40 minutes while the temperature is slowly increased to 160° C. After stripping, the temperature of the mixture is maintained at 160°-165° C. for about 30 minutes. The product is then filtered to give a solution of the corresponding sodium sulfonate having a metal ratio of about 16.8. This solution contains 18.7% oil.

Example C-11

Following the procedure of Example C-1, 836 parts (1 equivalent) of a sodium petroleum sulfonate (sodium "Petronate") in an oil solution containing 48% oil and 63 parts of the polybutenyl succinic anhydride is heated to 60° C. and treated with 280 parts (7 equivalents) of sodium hydroxide and 320 parts (10 equivalents) of methanol. The reaction mixture is blown with carbon dioxide at 4 cfh. for about 45 minutes. During this time, the temperature increases to 85° C. and then slowly decreases to 74° C. The volatile material is stripped by blowing with nitrogen at 2 cfh. while the temperature is gradually increased to 160° C. After stripping is completed, the mixture is heated an additional 30 minutes at 160° C. and then is filtered to yield the sodium salt in solution. The product has a metal ratio of 8.0 and an oil content of 22.2%.

Example C-12

Following the procedure of Example C-11, 1256 parts (1.5 equivalents) of the sodium petroleum sulfonate in an oil solution containing 48% oil and 95 parts of polybutenyl succinic anhydride is heated to 60° C. and treated with 420 parts (10.5 equivalents) of sodium hydroxide and 960 parts (30 equivalents) of methanol. The mixture is blown with carbon dioxide at 4 cfh. for 60 minutes. During this time, the temperature is increased to 90° C. and then slowly decreases to 70° C. The volatile materials are stripped by blowing with nitrogen and slowly increasing the temperature to 160° C. After stripping, the reaction mixture is allowed to stand at 160° C. for 30 minutes and then is filtered to yield an oil solution of sodium sulfonate having a metal ratio of about 8.0. The oil content of the solution is 22.2%.

Example C-13

A mixture of 584 parts (0.75 mole) of a commercial dialkyl aromatic sulfonic acid, 144 parts (0.37 mole) of a sulfurized tetrapropenyl phenol prepared as in Example 3-C, 93 parts of a polybutenyl succinic anhydride as used in Example C-1, 500 parts of xylene and 549 parts of oil is prepared and heated with stirring to 70° C. whereupon 97 parts of potassium hydroxide are added. The mixture is heated to 145° C. while azeotroping water and xylene. Additional potassium hydroxide (368 parts) is added over 10 minutes and heating is continued at about 145°-150° C. whereupon the mixture is blown with carbon dioxide at 1.5 cfh. for about 110 minutes. The volatile materials are stripped by blowing with nitrogen and slowly increasing the temperature to about 160° C. After stripping, the reaction mixture is filtered to yield an oil solution of the desired potassium sulfonate having a metal ratio of about 10. Additional oil is added to the reaction product to provide an oil content of the final solution of 39%.

Example C-14

A mixture of 705 parts (0.75 mole) of a commercially available mixture of straight and branched chain alkyl aromatic sulfonic acid, 98 parts (0.37 mole) of a tetrapropenyl phenol prepared as in Example 1-C, 97 parts of a polybutenyl succinic anhydride as used in Example C-1, 750 parts of xylene, and 133 parts of oil is prepared and heated with stirring to about 50° C whereupon 65 parts of sodium hydroxide dissolved in 100 parts of water are added. The mixture is heated to about 145° C. while removing an azeotrope of water and xylene. After cooling the reaction mixture overnight, 279 parts of sodium hydroxide are added. The mixture is heated to 145° C. and blown with carbon dioxide at about 2 cfh. for 1.5 hours. An azeotrope of water and xylene is removed. A second increment of 179 parts of sodium hydroxide is added as the mixture is stirred and heated to 145° C. whereupon the mixture is blown with carbon dioxide at a rate of 2 cfh. for about 2 hours. Additional oil (133 parts) is added to the mixture after 20 minutes. A xylene:water azeotrope is removed and the residue is stripped to 170° C. at 50 mm. Hg. The reaction mixture is filtered through a filter aid and the filtrate is the desired product containing 17.01% sodium and 1.27% sulfur.

Example C-15

A mixture of 386 parts (0.75 mole) of a commercially available primary branched chain monoalkyl aromatic sulfonic acid, 58 parts (0.15 mole) of a sulfurized tetrapropenyl phenol prepared as in Example 3-C, 926 grams of oil and 700 grams of xylene is prepared, heated to a temperature of 70° C. whereupon 97 parts of potassium hydroxide are added over a period of 15 minutes. The mixture is heated to 145° C. while removing water. An additional 368 parts of potassium hydroxide are added over 10 minutes, and the stirred mixture is heated to 145° C. whereupon the mixture is blown with carbon dioxide at 1.5 cfh. for about 2 hours. The mixture is stripped to 150° C. and finally at 150° C. at 50 mm. Hg. The residue is filtered, and the filtrate is the desired product.

The lubricating oil compositions of the present invention comprise (A) at least about 60% by weight of an oil of lubricating viscosity, at least about 2% by weight of the carboxylic derivative compositions (B) described above, and from about 0.01 to about 2% by weight of at least one basic alkali metal salt of a sulfonic or carboxylic acid (C) as described above. More often the lubricating compositions of this invention will contain at least 70% to 80% of oil. The amount of component (B) included in the lubricating oil compositions of the present invention may vary over a wide range provided that the oil composition contains at least about 2% by weight (on a chemical, oil-free basis) of the carboxylic derivative composition (B). In other embodiments, the oil compositions of the present invention may contain at least about 2.5% by weight or even at least about 3% by weight of the carboxylic derivative composition (B). In one embodiment, the lubricating oil compositions of this invention may contain up to 10% by weight and even up to 15% by weight of component (B). The carboxylic derivative composition (B) provides the lubricating oil compositions of the present invention with desirable VI and dispersant properties.

(D) Metal Dihydrocarbyl Dithiophosphate:

In another embodiment, the oil compositions of the present invention also contain (D) at least one metal dihydrocarbyl dithiophosphate characterized by the formula

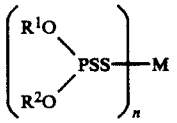

(XI)

wherein $R^1$ and $R^2$ are each independently hydrocarbyl groups containing from 3 to about 13 carbon atoms, M is a metal, and n is an integer equal to the valence of M.

Generally, the oil compositions of the present invention will contain varying amounts of one or more of the above-identified metal dithiophosphates such as from about 0.01 to about 2% by weight, and more generally from about 0.01 to about 1% by weight based on the weight of the total oil composition. The metal dithiophosphates are added to the lubricating oil compositions of the invention to improve the anti-wear and antioxidant properties of the oil compositions.

The hydrocarbyl groups $R^1$ and $R^2$ in the dithiophosphate of Formula XI may be alkyl, cycloalkyl, aralkyl or alkaryl groups, or a substantially hydrocarbon group of similar structure. By "substantially hydrocarbon" is meant hydrocarbons which contain substituent groups such as ether, ester, nitro, or halogen which do not materially affect the hydrocarbon character of the group.

Illustrative alkyl groups include isopropyl, isobutyl, n-butyl, sec-butyl, the various amyl groups, n-hexyl, methylisobutyl carbinyl, heptyl, 2-ethylhexyl, diisobutyl, isooctyl, nonyl, behenyl, decyl, dodecyl, tridecyl, etc. Illustrative lower alkylphenyl groups include butylphenyl, amylphenyl, heptylphenyl, etc. Cycloalkyl groups likewise are useful and these include chiefly cyclohexyl and the lower alkyl-cyclohexyl radicals. Many substituted hydrocarbon groups may also be used, e.g., chloropentyl, dichlorophenyl, and dichlorodecyl.

The phosphorodithioic acids from which the metal salts useful in this invention are prepared are well known. Examples of dihydrocarbyl phosphorodithioic acids and metal salts, and processes for preparing such acids and salts are found in, for example, U.S. Pat. Nos. 4,263,150; 4,289,635; 4,308,154; and 4,417,990. These patents are hereby incorporated by reference for such disclosures.

The phosphorodithioic acids are prepared by the reaction of phosphorus pentasulfide with an alcohol or phenol or mixtures of alcohols. The reaction involves four moles of the alcohol or phenol per mole of phosphorus pentasulfide, and may be carried out within the temperature range from about 50° C. to about 200° C. Thus the preparation of O,O-di-n-hexyl phosphorodithioic acid involves the reaction of phosphorus pentasulfide with four moles of n-hexyl alcohol at about 100° C. for about two hours. Hydrogen sulfide is liberated and the residue is the defined acid. The preparation of the metal salt of this acid may be effected by reaction with metal oxide. Simply mixing and heating these two reactants is sufficient to cause the reaction to take place and the resulting product is sufficiently pure for the purposes of this invention.

The metal salts of dihydrocarbyl dithiophosphates which are useful in this invention include those salts containing Group I metals, Group II metals, aluminum, lead, tin, molybdenum, manganese, cobalt, and nickel. The Group II metals, aluminum, tin, iron, cobalt, lead, molybdenum, manganese, nickel and copper are among the preferred metals. Zinc and copper are especially useful metals. Examples of metal compounds which may be reacted with the acid include lithium oxide, lithium hydroxide, sodium hydroxide, sodium carbonate, potassium hydroxide, potassium carbonate, silver oxide, magnesium oxide, magnesium hydroxide, calcium oxide, zinc hydroxide, strontium hydroxide, cadmium oxide, cadmium hydroxide, barium oxide, aluminum oxide, iron carbonate, copper hydroxide, lead hydroxide, tin butylate, cobalt hydroxide, nickel hydroxide, nickel carbonate, etc.

In some instances, the incorporation of certain ingredients such as small amounts of the metal acetate or acetic acid in conjunction with the metal reactant will facilitate the reaction and result in an improved product. For example, the use of up to about 5% of zinc acetate in combination with the required amount of zinc oxide facilitates the formation of a zinc phosphorodithioate.

In one preferred embodiment, the alkyl groups $R^1$ and $R^2$ are derived from secondary alcohols such as isopropyl alcohol, secondary butyl alcohol, 2-pentanol, 2-methyl-4-pentanol, 2-hexanol, 3-hexanol, etc.

Especially useful metal phosphorodithioates can be prepared from phosphorodithioic acids which in turn are prepared by the reaction of phosphorus pentasulfide with mixtures of alcohols. In addition, the use of such mixtures enables the utilization of cheaper alcohols which in themselves may not yield oil-soluble phosphorodithioic acids. Thus a mixture of isopropyl and hexyl alcohols can be used to produce a very effective, oil-soluble metal phosphorodithioate. For the same reason mixtures of phosphorodithioic acids can be reacted with the metal compounds to form less expensive, oil-soluble salts.

The mixtures of alcohols may be mixtures of different primary alcohols, mixtures of different secondary alcohols or mixtures of primary and secondary alcohols. Examples of useful mixtures include: n-butanol and n-octanol; n-pentanol and 2-ethyl-l-hexanol; isobutanol and n-hexanol; isobutanol and isoamyl alcohol; isopropanol and 2-methyl-4-pentanol; isopropanol and sec-butyl alcohol; isopropanol and isooctyl alcohol; etc. Particularly useful alcohol mixtures are mixtures of secondary alcohols containing at least about 20 mole percent of isopropyl alcohol, and in a preferred embodiment, at least 40 mole percent of isopropyl alcohol.

The following examples illustrate the preparation of metal phosphorodithioates prepared from mixtures of alcohols.

Example D-1

A phosphorodithioic acid is prepared by reacting a mixture of alcohols comprising 6 moles of 4-methyl-2-pentanol and 4 moles of isopropyl alcohol with phosphorus pentasulfide. The phosphorodithioic acid then is reacted with an oil slurry of zinc oxide. The amount of zinc oxide in the slurry is about 1.08 times the theoretical amount required to completely neutralize the phosphorodithioic acid. The oil solution of the zinc phosphorodithioate obtained in this manner (10% oil) contains 9.5% phosphorus, 20.0% sulfur and 10.5% zinc.

Example D-2

A phosphorodithioic acid is prepared by reacting finely powdered phosphorus pentasulfide with an alcohol mixture containing 11.53 moles (692 parts by weight) of isopropyl alcohol and 7.69 moles (1000 parts by weight) of isooctanol. The phosphorodithioic acid obtained in this manner has an acid number of about 178–186 and contains 10.0% phosphorus and 21.0% sulfur. This phosphorodithioic acid is then reacted with an oil slurry of zinc oxide. The quantity of zinc oxide included in the oil slurry is 1.10 times the theoretical equivalent of the acid number of the phosphorodithioic acid. The oil solution of the zinc salt prepared in this manner contains 12% oil, 8.6% phosphorus, 18.5% sulfur and 9.5% zinc.

Example D-3

A phosphorodithioic acid is prepared by reacting a mixture of 1560 parts (12 moles) of isooctyl alcohol and 180 parts (3 moles) of isopropyl alcohol with 756 parts (3.4 moles) of phosphorus pentasulfide. The reaction is conducted by heating the alcohol mixture to about 55° C. and thereafter adding the phosphorus pentasulfide over a period of 1.5 hours while maintaining the reaction temperature at about 60°–75° C. After all of the phosphorus pentasulfide is added, the mixture is heated and stirred for an additional hour at 70°–75° C., and thereafter filtered through a filter aid.

Zinc oxide (282 parts, 6.87 moles) is charged to a reactor with 278 parts of mineral oil. The above-prepared phosphorodithioic acid (2305 parts, 6.28 moles) is charged to the zinc oxide slurry over a period of 30 minutes with an exotherm to 60° C. The mixture then is heated to 80° C. and maintained at this temperature for 3 hours. After stripping to 100° C. and 6 mm.Hg., the mixture is filtered twice through a filter aid, and the filtrate is the desired oil solution of the zinc salt containing 10% oil, 7.97% zinc (theory 7.40); 7.21% phosphorus (theory 7.06); and 15.64% sulfur (theory 14.57).

Example D-4

Isopropyl alcohol (396 parts, 6.6 moles) and 1287 parts (9.9 moles) of isooctyl alcohol are charged to a reactor and heated with stirring to 59° C. Phosphorus pentasulfide (833 parts, 3.75 moles) is then added under a nitrogen sweep. The addition of the phosphorus pentasulfide is completed in about 2 hours at a reaction temperature between 59°–63° C. The mixture then is stirred at 45°–63° C. for about 1.45 hours and filtered. The filtrate is the desired phosphorodithioic acid.

A reactor is charged with 312 parts (7.7 equivalents) of zinc oxide and 580 parts of mineral oil. While stirring at room temperature, the above-prepared phosphorodithioic acid (2287 parts, 6.97 equivalents) is added over a period of about 1.26 hours with an exotherm to 54° C. The mixture is heated to 78° C. and maintained at 78°–85° C. for 3 hours. The reaction mixture is vacuum stripped to 100° C. at 19 mm.Hg. The residue is filtered through a filter aid, and the filtrate is an oil solution (19.2% oil) of the desired zinc salt containing 7.86% zinc, 7.76% phosphorus and 14.8% sulfur.

Example D-5

The general procedure of Example D-4 is repeated except that the mole ratio of isopropyl alcohol to isooctyl alcohol is 1:1. The product obtained in this manner is an oil solution (10% oil) of the zinc phosphorodithioate containing 8.96% zinc, 8.49% phosphorus and 18.05% sulfur.

Example D-6

A phosphorodithioic acid is prepared in accordance with the general procedure of Example D-4 utilizing an alcohol mixture containing 520 parts (4 moles) of isooctyl alcohol and 360 parts (6 moles) of isopropyl alcohol with 504 parts (2.27 moles) of phosphorus pentasulfide. The zinc salt is prepared by reacting an oil slurry of 116.3 parts of mineral oil and 141.5 parts (3.44 moles) of zinc oxide with 950.8 parts (3.20 moles) of the above-prepared phosphorodithioic acid. The product prepared in this manner is an oil solution (10% mineral oil) of the desired zinc salt, and the oil solution contains 9.36% zinc, 8.81% phosphorus and 18.65% sulfur.

Example D-7

A mixture of 520 parts (4 moles) of isooctyl alcohol and 559.8 parts (9.33 moles) of isopropyl alcohol is prepared and heated to 60° C. at which time 672.5 parts (3.03 moles) of phosphorus pentasulfide are added in portions while stirring. The reaction then is maintained at 60°–65° C. for about one hour and filtered. The filtrate is the desired phosphorodithioic acid.

An oil slurry of 188.6 parts (4 moles) of zinc oxide and 144.2 parts of mineral oil is prepared, and 1145 parts of the above-prepared phosphorodithioic acid are added in portions while maintaining the mixture at about 70° C. After all of the acid is charged, the mixture is heated at 80° C. for 3 hours. The reaction mixture then is stripped of water to 110° C. The residue is filtered through a filter aid, and the filtrate is an oil solution (10% mineral oil) of the desired product containing 9.99% zinc, 19.55% sulfur and 9.33% phosphorus.

Example D-8

A phosphorodithioic acid is prepared by the general procedure of Example D-4 utilizing 260 parts (2 moles) of isooctyl alcohol, 480 parts (8 moles) of isopropyl alcohol, and 504 parts (2.27 moles) of phosphorus pentasulfide. The phosphorodithioic acid (1094 parts, 3.84 moles) is added to an oil slurry containing 181 parts (4.41 moles) of zinc oxide and 135 parts of mineral oil over a period of 30 minutes. The mixture is heated to 80° C. and maintained at this temperature for 3 hours. After stripping to 100° C. and 19 mm.Hg., the mixture is filtered twice through a filter aid, and the filtrate is an oil solution (10% mineral oil) of the zinc salt containing 10.06% zinc, 9.04% phosphorus, and 19.2% sulfur.

Additional specific examples of metal phosphorodithioates useful as component (D) in the lubricating oils of the present invention are listed in the following table. Examples D-9 to D-14 are prepared from single alcohols, and Examples D-15 to D-19 are prepared from alcohol mixtures following the general procedure of Example D-1.

TABLE

Component D: Metal Phosphorodithioates

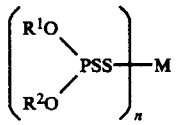

| Example | $R^1$ | $R^2$ | M | n |
|---|---|---|---|---|
| D-9 | n-nonyl | n-nonyl | Ba | 2 |
| D-10 | cyclohexyl | cyclohexyl | Zn | 2 |
| D-11 | isobutyl | isobutyl | Zn | 2 |
| D-12 | hexyl | hexyl | Ca | 2 |
| D-13 | n-decyl | n-decyl | Zn | 2 |
| D-14 | 4-methyl-2-pentyl | 4-methyl-2-pentyl | Cu | 2 |
| D-15 | (n-butyl + dodecyl) (1:1)w | | Zn | 2 |
| D-16 | (isopropyl + isooctyl) (1:1)w | | Ba | 2 |
| D-17 | (isopropyl + 4-methyl-2 pentyl) + (40:60)m | | Cu | 2 |
| D-18 | (isobutyl + isoamyl) (65:35)m | | Zn | 2 |
| D-19 | (isopropyl + sec-butyl) (40:60)m | | Zn | 2 |

Another class of the phosphorodithioate additives contemplated for use in the lubricating composition of this invention comprises the adducts of the metal phosphorodithioates described above with an epoxide. The metal phosphorodithioates useful in preparing such adducts are for the most part the zinc phosphorodithioates. The epoxides may be alkylene oxides or arylalkylene oxides. The arylalkylene oxides are exemplified by styrene oxide, p-ethylstyrene oxide, alpha-methylstyrene oxide, 3-beta-naphthyl-1,1,3-butylene oxide, m-dodecylstyrene oxide and p-chlorostyrene oxide. The alkylene oxides include principally the lower alkylene oxides in which the alkylene radical contains 8 or less carbon atoms. Examples of such lower alkylene oxides are ethylene oxide, propylene oxide, 1,2-butene oxide, trimethylene oxide, tetramethylene oxide, butadiene monoepoxide, 1,2-hexene oxide, and epichlorohydrin. Other epoxides useful herein include, for example, butyl 9,10-epoxystearate, epoxidized soya bean oil, epoxidized tung oil, and epoxidized copolymer of styrene with butadiene.

The adduct may be obtained by simply mixing the metal phosphorodithioate and the epoxide. The reaction is usually exothermic and may be carried out within wide temperature limits from about 0° C. to about 300° C. Because the reaction is exothermic, it is best carried out by adding on reactant, usually the epoxide, in small increments to the other reactant in order to obtain convenient control of the temperature of the reaction. The reaction may be carried out in a solvent such as benzene, mineral oil, naphtha, or n-hexene.

The chemical structure of the adduct is not known. For the purpose of this invention adducts obtained by the reaction of one mole of the phosphorodithioate with from about 0.25 mole to 5 moles, usually up to about 0.75 mole or about 0.5 mole of a lower alkylene oxide, particularly ethylene oxide and propylene oxide, have been found to be especially useful and therefore are preferred.

The preparation of such adducts is more specifically illustrated by the following examples.

Example D-21

A reactor is charged with 2365 parts (3.33 moles) of the zinc phosphorodithioate prepared in Example D-2, and while stirring at room temperature, 38.6 parts (0.67 mole) of propylene oxide are added with an exotherm of from 24°-31° C. The mixture is maintained at 80°-90° C. for 3 hours and then vacuum stripped to 101° C. at 7 mm. Hg. The residue is filtered using a filter aid, and the filtrate is an oil solution (11.8% oil) of the desired salt containing 17.1% sulfur, 8.17% zinc and 7.44% phosphorus.

Example D-22

To 394 parts (by weight) of zinc dioctylphosphorodithioate having a phosphorus content of 7% there is added at 75°-85° C., 13 parts of propylene oxide (0.5 mole per mole of the zinc phosphorodithioate) throughout a period of 20 minutes. The mixture is heated at 82°-85° C. for one hour and filtered. The filtrate (399 parts) is found to contain 6.7% of phosphorus, 7.4% of zinc, and 4.1% of sulfur.

In one embodiment, the metal dihydrocarbyl dithiophosphates which are utilized as component (D) in the lubricating oil compositions of the present invention will be characterized as having at least one of the hydrocarbyl groups ($R^1$ or $R^2$) attached to the oxygen atoms through a secondary carbon atom. In one preferred embodiment, both of the hydrocarbyl groups $R^1$ and $R^2$ are attached to the oxygen atoms of the dithiophosphate through secondary carbon atoms. In a further embodiment, the dihydrocarbyl dithiophosphoric acids used in the preparation of the metal salts are obtained by reacting phosphorus pentasulfide with a mixture of aliphatic alcohols wherein at least 20 mole percent of the mixture is isopropyl alcohol. More generally, such mixtures will contain at least 40 mole percent of isopropyl alcohol. The other alcohols in the mixtures may be either primary or secondary alcohols. In some applications, such as in passenger car crankcase oils, metals phosphorodithioates derived from a mixture of isopropyl and another secondary alcohol (e.g., 2-methyl-4-pentanol) appear to provide improved results. In diesel applications, improved results (i.e., wear) are obtained when the phosphorodithioic acid is prepared from a mixture of isopropyl alcohol and a primary alcohol such as isooctyl alcohol.

Another class of the phosphorodithioate additives (D) contemplated as useful in the lubricating compositions of the invention comprises mixed metal salts of (a) at least one phosphorodithioic acid of Formula XI as defined and exemplified above, and (b) at least one aliphatic or alicyclic carboxylic acid. The carboxylic acid may be a monocarboxylic or polycarboxylic acid, usually containing from 1 to about 3 carboxy groups and preferably only 1. It may contain from about 2 to about 40, preferably from about 2 to about 20 carbon atoms, and advantageously about 5 to about 20 carbon atoms. The preferred carboxylic acids are those having the formula $R^3COOH$, wherein $R^3$ is an aliphatic or alicyclic hydrocarbon-based radical preferably free from acetylenic unsaturation. Suitable acids include the butanoic, pentanoic, hexanoic, octanoic, nonanoic, decanoic, dodecanoic, octadecanoic and eicosanoic acids, as well as olefinic acids such as oleic, linoleic, and linolenic acids and linoleic acid dimer. For the most part, $R^3$ is a saturated aliphatic group and especially a branched alkyl group such as the isopropyl or 3-heptyl group. Illustrative polycarboxylic acids are succinic, alkyl- and alkenylsuccinic, adipic, sebacic and citric acids.

The mixed metal salts may be prepared by merely blending a metal salt of a phosphorodithioic acid with a metal salt of a carboxylic acid in the desired ratio. The ratio of equivalents of phosphorodithioic to carboxylic acid salts is between about 0.5:1 to about 400:1. Preferably, the ratio is between about 0.5:1 and about 200:1. Advantageously, the ratio can be from about 0.5:1 to about 100:1, preferably from about 0.5:1 to about 50:1, and more preferably from about 0.5:1 to about 20:1. Further, the ratio can be from about 0.5:1 to about 4.5:1, preferably about 2.5:1 to about 4.25:1. For this purpose, the equivalent weight of a phosphorodithioic acid is its molecular weight divided by the number of —PSSH groups therein, and that of a carboxylic acid is its molecular weight divided by the number of carboxy groups therein.

A second and preferred method for preparing the mixed metal salts useful in this invention is to prepare a mixture of the acids in the desired ratio and to react the acid mixture with a suitable metal base. When this method of preparation is used, it is frequently possible to prepare a salt containing an excess of metal with respect to the number of equivalents of acid present; thus, mixed metal salts containing as many as 2 equivalents and especially up to about 1.5 equivalents of metal per equivalent of acid may be prepared. The equivalent of a metal for this purpose is its atomic weight divided by its valence.

Variants of the above-described methods may also be used to prepare the mixed metal salts useful in this invention. For example, a metal salt of either acid may be blended with an acid of the other, and the resulting blend reacted with additional metal base.

Suitable metal bases for the preparation of the mixed metal salts include the free metals previously enumerated and their oxides, hydroxides, alkoxides and basic salts. Examples are sodium hydroxide, potassium hydroxide, magnesium oxide, calcium hydroxide, zinc oxide, lead oxide, nickel oxide and the like.

The temperature at which the mixed metal salts are prepared is generally between about 30° C. and about 150° C., preferably up to about 125° C. If the mixed salts are prepared by neutralization of a mixture of acids with a metal base, it is preferred to employ temperatures above about 50° C. and especially above about 75° C. It is frequently advantageous to conduct the reaction in the presence of a substantially inert, normally liquid organic diluent such as naphtha, benzene, xylene, mineral oil or the like. If the diluent is mineral oil or is physically and chemically similar to mineral oil, it frequently need not be removed before using the mixed metal salt as an additive for lubricants or functional fluids.

U.S. Pat. Nos. 4,308,154 and 4,417,970 describe procedures for preparing these mixed metal salts and disclose a number of examples of such mixed salts. Such disclosures of these patents are hereby incorporated by reference.

The preparation of the mixed salts is illustrated by the following examples. All parts and percentages are by weight.

Example D-23

A mixture of 67 parts (1.63 equivalents) of zinc oxide and 48 parts of mineral oil is stirred at room temperature and a mixture of 401 parts (1 equivalent) of di-(2-ethylhexyl) phosphorodithioic acid and 36 parts (0.25 equivalent) of 2-ethylhexanoic acid is added over 10 minutes. The temperature increases to 40° C. during the addition. When addition is complete, the temperature is increased to 80° C. for 3 hours. The mixture is then vacuum stripped at 100° C. to yield the desired mixed metal salt as a 91% solution in mineral oil.

Example D-24

Following the procedure of Example D-23, a product is prepared from 383 parts (1.2 equivalents) of a dialkyl phosphorodithioic acid containing 65% isobutyl and 35% amyl groups, 43 parts (0.3 equivalent) of 2-ethylhexanoic acid, 71 parts (1.73 equivalents) of zinc oide and 47 parts of mineral oil. The resulting mixed metal salt, obtained as a 90% solution in mineral oil, contains 11.07% zinc.

(E) Carboxylic Ester Derivative Compositions:

The lubricating oil compositions of the present invention also may contain (E) at least one carboxylic ester derivative composition produced by reacting (E-1) at least one substituted succinic acylating agent with (E-2) at least one alcohol or phenol of the general formula $$R^3(OH)_m \qquad \text{(XII)}$$

wherein $R^3$ is a monovalent or polyvalent organic group joined to the —OH groups through a carbon bond, and m is an integer of from 1 to about 10. The carboxylic ester derivatives (E) are included in the oil compositions to provide additional dispersancy, and in some applications, the ratio of carboxylic derivative (B) to carboxylic ester (E) present in the oil affects the properties of the oil compositions such as the anti-wear properties.

The substituted succinic acylating agents (E-1) which are reacted with the alcohols or phenols to form the carboxylic ester derivatives (E) are identical to acylating agents (B-1) used in the preparation of the carboxylic derivatives (B) described above with one exception. The polyalkene from which the substituent is derived is characterized as having a number average molecular weight of at least about 700. Number average molecular weights of from about 700 to about 5000 are preferred. In one preferred embodiment, the substituent groups of the acylating agent are derived from polyalkenes which are characterized by an $\overline{M}n$ value of about 1300 to 5000 and an $\overline{M}w/\overline{M}n$ value of about 1.5 to about 4.5. The acylating agents of this embodiment are identical to the acylating agents described earlier with respect to the preparation of the carboxylic derivative compositions useful as component (B) described above. Thus, any of the acylating agents described in regard to the preparation of component (B) above, can be utilized in the preparation of the carboxylic ester derivative compositions useful as component (E). When the acylating agents used to prepare the carboxylic ester (E) are the same as those acylating agents used for preparing component (B), the carboxylic ester component (E) will also be characterized as a dispersant having VI properties. Also combinations of component (B) and these preferred types of component (E) used in the oils of the invention provide superior anti-wear characteristics to the oils of the invention. However, other substituted succinic acylating agents also can be utilized in the preparation of the carboxylic ester derivative compositions which are useful as component (E) in the present invention.

The carboxylic ester derivative compositions (E) are those of the above-described succinic acylating agents with hydroxy compounds which may be aliphatic compounds such as monohydric and polyhydric alcohols or aromatic compounds such as phenols and naphthols. The aromatic hydroxy compounds from which the esters may be derived are illustrated by the following specific examples: phenol, beta-naphthol, alpha-naphthol, cresol, resorcinol, catechol, p,p'-dihydroxybiphenyl, 2-chlorophenol, 2,4-dibutylphenol, etc.

The alcohols from which the esters may be derived preferably contain up to about 40 aliphatic carbon atoms. They may be monohydric alcohols such as methanol, ethanol, isooctanol, dodecanol, cyclohexanol, cyclopentanol, behenyl alcohol, hexatriacontanol, neopentyl alcohol, isobutyl alcohol, benzyl alcohol, beta-phenylethyl alcohol, 2-methylcyclohexanol, beta-chloroethanol, monomethyl ether of ethylene glycol, monobutyl ether of ethylene glycol, monopropyl ether of diethylene glycol, monododecyl ether of triethylene glycol, mono-oleate of ethylene glycol, monostearate of diethylene glycol, secpentyl alcohol, tert-butyl, alcohol, 5-bromo-dodecanol, nitrooctadecanol and dioleate of glycerol. The polyhydric alcohols preferably contain from 2 to about 10 hydroxy groups. They are illustrated by, for example, ethylene glycol, diethylene glycol, triethylene glycol, tetraethylene glycol, dipropylene glycol, tripropylene glycol, dibutylene glycol, tributylene glycol, and other alkylene glycols in which the alkylene group contains from 2 to about 8 carbon atoms. Other useful polyhydric alcohols include glycerol, monooleate of glycerol, monostearate of glycerol, monomethyl ether of glycerol, pentaerythritol, 9,10-dihydroxy stearic acid, 1,2-butanediol, 2,3-hexanediol, 2,4-hexanediol, pinacol, erythritol, arabitol, sorbitol, mannitol, 1,2-cyclo-hexanediol, and xylylene glycol.

An especially preferred class of polyhydric alcohols are those having at least three hydroxyl groups, some of which have been esterified with a monocarboxylic acid having from about 8 to about 30 carbon atoms such as octanoic acid, oleic acid, stearic acid, linoleic acid, dodecanoic acid, or tall oil acid. Examples of such partially esterified polyhydric alcohols are the monooleate of sorbitol, distearate of sorbitol, monooleate of glycerol, monostearate of glycerol, di-dodecanoate of erythritol.

The esters may also be derived from unsaturated alcohols such as allyl alcohol, cinnamyl alcohol, propargyl alcohol, 1-cyclohexene-3-ol, and oleyl alcohol. Still other classes of the alcohols capable of yielding the and amino-alcohols including, for example, the oxy-alkylene-, oxy-arylene-, amino-alkylene-, and amino-arylene- substituted alcohols having one or more oxy-alkylene, amino-alkylene or amino-arylene oxy-arylene groups. They are exemplified by Cellosolve, Carbitol, phenoxyethanol, mono(heptylphenyl-oxypropylene)-substituted glycerol, poly(styrene oxide), aminoethanol, 3-amino ethylpentanol, di(hydroxyethyl) amine, p-aminophenol, tri(hydroxypropyl)amine, N-hydroxyethyl ethylene diamine, N,N,N',N'-tetrahydroxytrimethylene diamine, and the like. For the most part, the ether-alcohols having up to about 150 oxy-alkylene groups in which the alkylene group contains from 1 to about 8 carbon atoms are preferred.

The esters may be diesters of succinic acids or acidic esters, i.e., partially esterified succinic acids; as well as partially esterified polyhydric alcohols or phenols, i.e., esters having free alcoholic or phenolic hydroxyl groups. Mixtures of the above-illustrated esters likewise are contemplated within the scope of this invention.

A suitable class of esters for use in the lubricating compositions of this invention are those diesters of succinic acid and an alcohol having up to about 9 aliphatic carbon atoms and having at least one substituent selected from the class consisting of amino and carboxy groups wherein the hydrocarbon substituent of the succinic acid is a polymerized butene substituent having a number average molecular weight of from about 700 to about 5000.

The esters (E) may be prepared by one of several known methods. The method which is preferred because of convenience and the superior properties of the esters it produces, involves the reaction of a suitable alcohol or phenol with a substantially hydrocarbon-substituted succinic anhydride. The esterification is usually carried out at a temperature above about 100° C., preferably between 150° C. and 300° C. The water formed as a by-product is removed by distillation as the esterification proceeds.

In most cases the carboxylic ester derivatives are a mixture of esters, the precise chemical composition and the relative proportions of which in the product are difficult to determine. Consequently, the product of such reaction is best described in terms of the process by which it is formed.

A modification of the above process involves the replacement of the substituted succinic anhydride with the corresponding succinic acid. However, succinic acids readily undergo dehydration at temperatures above about 100° C. and are thus converted to their anhydrides which are then esterified by the reaction with the alcohol reactant. In this regard, succinic acids appear to be the substantial equivalent of their anhydrides in the process.

The relative proportions of the succinic reactant and the hydroxy reactant which are to be used depend to a large measure upon the type of the product desired and the number of hydroxyl groups present in the molecule of the hydroxy reactant. For instance, the formation of a half ester of a succinic acid, i.e., one in which only one of the two acid groups is esterified, involves the use of one mole of a monohydric alcohol for each mole of the substituted succinic acid reactant, whereas the formation of a diester of a succinic acid involves the use of two moles of the alcohol for each mole of the acid. On the other hand, one mole of a hexahydric alcohol may combine with as many as six moles of a succinic acid to form an ester in which each of the six hydroxyl groups of the alcohol is esterified with one of the two acid groups of the succinic acid. Thus, the maximum proportion of the succinic acid to be used with a polyhydric alcohol is determined by the number of hydroxyl groups present in the molecule of the hydroxy reactant. In one embodiment, esters obtained by the reaction of equimolar amounts of the succinic acid reactant and hydroxy reactant are preferred.

In some instances it is advantageous to carry out the esterification in the presence of a catalyst such as sulfuric acid, pyridine hydrochloride, hydrochloric acid, benzene sulfonic acid, p-toluene sulfonic acid, phosphoric acid, or any other known esterification catalyst. The amount of the catalyst in the reaction may be as little as 0.01% (by weight of the reaction mixture), more often from about 0.1% to about 5%.

The esters (E) may be obtained by the reaction of a substituted succinic acid or anhydride with an epoxide or a mixture of an epoxide and water. Such reaction is similar to one involving the acid or anhydride with a glycol. For instance, the ester may be prepared by the reaction of a substituted succinic acid with one mole of ethylene oxide. Similarly, the ester may be obtained by the reaction of a substituted succinic acid with two moles of ethylene oxide. Other epoxides which are commonly available for use in such reaction include, for example, propylene oxide, styrene oxide, 1,2-butylene oxide, 2,3-butylene oxide, epichlorohydrin, cyclohexene oxide, 1,2-octylene oxide, epoxidized soybean oil, methyl ester of 9,10-epoxy-stearic acid, and butadiene monoepoxide. For the most part, the epoxides are the alkylene oxides in which the alkylene group has from 2 to about 8 carbon atoms; or the epoxidized fatty acid esters in which the fatty acid group has up to about 30 carbon atoms and the ester group is derived from a lower alcohol having up to about 8 carbon atoms.

In lieu of the succinic acid or anhydride, a substituted succinic acid halide may be used in the processes illustrated above for preparing the esters. Such acid halides may be acid dibromides, acid dichlorides, acid monochlorides, and acid monobromides. The substituted succinic anhydrides and acids can be prepared by, for example, the reaction of maleic anhydride with a high molecular weight olefin or a halogenated hydrocarbon such as is obtained by the chlorination of an olefin polymer described previously. The reaction involves merely heating the reactants at a temperature preferably from about 100° C. to about 250° C. The product from such a reaction is an alkenyl succinic anhydride. The alkenyl group may be hydrogenated to an alkyl group. The anhydride may be hydrolyzed by treatment with water or steam to the corresponding acid. Another method useful for preparing the succinic acids or anhydrides involves the reaction of itaconic acid or anhydride with an olefin or a chlorinated hydrocarbon at a temperature usually within the range from about 100° C. to about 250° C. The succinic acid halides can be prepared by the reaction of the acids or their anhydrides with a halogenation agent such as phosphorus tribromide, phosphorus pentachloride, or thionyl chloride. These and other methods of preparing the carboxylic esters (E) are well known in the art and need not be illustrated in further detail here. For example, see U.S. Pat. No. 3,522,179 which is hereby incorporated by reference for its disclosure of the preparation of carboxylic ester compositions useful as component (E). The preparation of carboxylic ester derivative compositions from acylating agents wherein the substituent groups are derived from polyalkenes characterized by an $\overline{Mn}$ of at least about 1300 up to about 5000 and an $\overline{Mw}/\overline{Mn}$ ratio of from 1.5 to about 4 is described in U.S. Pat. No. 4,234,435 which is hereby incorporated by reference. The acylating agents described in the '435 patent are also characterized as having within their structure an average of at least 1.3 succinic groups for each equivalent weight of substituent groups.

The following examples illustrate the esters (E) and the processes for preparing such esters.

Example E-1

A substantially hydrocarbon-substituted succinic anhydride is prepared by chlorinating a polyisobutene having a number average molecular weight of 1000 to a chlorine content of 4.5% and then heating the chlorinated polyisobutene with 1.2 molar proportions of maleic anhydride at a temperature of 150°-220° C. A mixture of 874 grams (1 mole) of the succinic anhydride and 104 grams (1 mole) of neopentyl glycol is maintained at 240°-250° C./30 mm for 12 hours. The residue is a mixture of the esters resulting from the esterification of one and both hydroxy groups of the glycol.

Example E-2

The dimethyl ester of the substantially hydrocarbon-substituted succinic anhydride of Example E-1 is prepared by heating a mixture of 2185 grams of the anhydride, 480 grams of methanol, and 1000 cc of toluene at 50°-65° C. while hydrogen chloride is bubbled through the reaction mixture for 3 hours. The mixture is then heated at 60°-65° C. for 2 hours washed with water, dried and filtered. The filtrate is heated at 150° C./60 mm to remove volatile components. The residue is the desired dimethyl ester.

Example E-3

The substantially hydrocarbon-substituted succinic anhydride of Example E-1 is partially esterified with an ether-alcohol as follows. A mixture of 550 grams (0.63 mole) of the anhydride and 190 grams (0.32 mole) of a commercial polyethylene glycol having a molecular weight of 600 is heated at 240°-250° C. for 8 hours at atmospheric pressure and 12 hours at a pressure of 30 mm. Hg until the acid number of the reaction mixture is reduced to about 28. The residue is the desired acidic ester.

Example E-4

A mixture of 926 grams of a polyisobutene-substituted succinic anhydride having an acid number of 121, 1023 grams of mineral oil, and 124 grams (2 moles per mole of the anhydride) of ethylene glycol is heated at 50°-170° C. while hydrogen chloride is bubbled through the reaction mixture for 1.5 hours. The mixture is then heated to 250° C./30 mm and the residue is purified by washing with aqueous sodium hydroxide followed by washing with water, then dried and filtered. The filtrate is a 50% oil solution of the desired ester.

Example E-5

A mixture of 438 grams of the polyisobutene-substituted succinic anhydride prepared as is described in Example E-1 and 333 grams of a commercial polybutylene glycol having a molecular weight of 1000 is heated for 10 hours at 150°-160° C. The residue is the desired ester.

Example E-6

A mixture of 645 grams of the substantially hydrocarbon-substituted succinic anhydride prepared as is described in Example E-1 and 44 grams of tetramethylene glycol is heated at 100°-130° C. for 2 hours. To this mixture there is added 51 grams of acetic anhydride (esterification catalyst) and the resulting mixture is heated under reflux at 130°-160° C. for 2.5 hours. Thereafter the volatile components of the mixture are distilled by heating the mixture to 196°-270° C./30 mm and then at 240° C./0.15 mm for 10 hours. The residue is the desired acidic ester.

Example E-7

A mixture of 456 grams of a polyisobutene-substituted succinic anhydride prepared as is described in Example E-1 and 350 grams (0.35 mole) of the monophenyl ether of a polyethylene glycol having a molecular weight of 1000 is heated at 150°-155° C. for 2 hours. The product is the desired ester.

Example E-8

A dioleyl ester is prepared as follows: a mixture of 1 mole of a polyisobutene-substituted succinic anhydride prepared as in Example E-1, 2 moles of a commercial oleyl alcohol, 305 grams of xylene, and 5 grams of p-toluene sulfonic acid (esterification catalyst) is heated at 150°-173° C. for 4 hours whereupon 18 grams of water is collected as the distillate. The residue is washed with water and the organic layer dried and filtered. The filtrate is heated to 175° C./20 mm and the residue is the desired ester.

Example E-9

An ether-alcohol is prepared by the reaction of 9 moles of ethylene oxide with 0.9 mole of a polyisobutene-substituted phenol in which the polyisobutene substituent has a number average molecular weight of 1000. A substantially hydrocarbon-substituted succinic acid ester of this ether-alcohol is prepared by heating a xylene solution of an equimolar mixture of the two reactants in the presence of a catalytic amount of p-toluene sulfonic acid at 157° C.

E-10

A substantially hydrocarbon-substituted succinic anhydride is prepared as is described in Example E-1 except that a copolymer of 90 weight percent of isobutene and 10 weight percent of piperylene having a number average molecular weight of 66,000 is used in lieu of the polyisobutene. The anhydride has an acid number of about 22. An ester is prepared by heating a toluene solution of an equimolar mixture of the above anhydride and a commercial alkanol consisting substantially of $C_{12-14}$ alcohols at the reflux temperature for 7 hours while water is removed by azeotropic distillation. The residue is heated at 150° C./3 mm to remove volatile components and diluted with mineral oil. A 50% oil solution of the ester is obtained.

Example E-11

A mixture of 3225 parts (5.0 equivalents) of the polyisobutene-substituted succinic acylating agent prepared in Example 2, 289 parts (8.5 equivalents) of pentaerythritol and 5204 parts of mineral oil is heated at 224°-235° C. for 5.5 hours. The reaction mixture is filtered at 130° C. to yield an oil solution of the desired product.

The carboxylic ester derivatives which are described above resulting from the reaction of an acylating agent with a hydroxy-containing compound such as an alcohol or a phenol may be further reacted with an amine (E-3), and particularly polyamines in the manner described previously for the reaction of the acylating agent (B-1) with amines (B-2) in preparing component (B). Any of the amines identified above as (B-2) can be used as amine (E-3). In one embodiment, the amount of amine (E-3) which is reacted with the ester is an amount such that there is at least about 0.01 equivalent of the amine for each equivalent of acylating agent initially employed in the reaction with the alcohol. Where the acylating agent has been reacted with the alcohol in an amount such that there is at least one equivalent of alcohol for each equivalent of acylating agent, this small amount of amine is sufficient to react with minor amounts of non-esterified carboxyl groups which may be present. In one preferred embodiment, the amine-modified carboxylic acid esters utilized as component (E) are prepared by reacting about 1.0 to 2.0 equivalents, preferably about 1.0 to 1.8 equivalents of hydroxy compounds, and up to about 0.3 equivalent, preferably about 0.02 to about 0.25 equivalent of polyamine per equivalent of acylating agent.

In another embodiment, the carboxylic acid acylating agent (E-1) may be reacted simultaneously with both the alcohol (E-2) and the amine (E-3). There is generally at least about 0.01 equivalent of the alcohol and at least 0.01 equivalent of the amine although the total amount of equivalents of the combination should be at least about 0.5 equivalent per equivalent of acylating agent. These carboxylic ester derivative compositions which are useful as component (E) are known in the art, and the preparation of a number of these derivatives is described in, for example, U.S. Pat. Nos. 3,957,854 and 4,234,435 which are hereby incorporated by reference. The following specific examples illustrate the preparation of the esters wherein both alcohols and amines are reacted with the acylating agent.

Example E-12

A mixture of 334 parts (0.52 equivalent) of the polyisobutene-substituted succinic acylating agent prepared in Example E-2, 548 parts of mineral oil, 30 parts (0.88 equivalent) of pentaerythritol and 8.6 parts (0.0057 equivalent) of Polyglycol 112-2 demulsifier from Dow Chemical Company is heated at 150° C. for 2.5 hours. The reaction mixture is heated to 210° C. in 5 hours and held at 210° C. for 3.2 hours. The reaction mixture is cooled to 190° C. and 8.5 parts (0.2 equivalent) of a commercial mixture of ethylene polyamines having an average of about 3 to about 10 nitrogen atoms per molecule are added. The reaction mixture is stripped by heating at 205° C. with nitrogen blowing for 3 hours, then filtered to yield the filtrate as an oil solution of the desired product.

Example E-13

A mixture is prepared by the addition of 14 parts of aminopropyl diethanolamine to 867 parts of the oil solution of the product prepared in Example E-11 at 190°-200° C. The reaction mixture is held at 195° C. for 2.25 hours, then cooled to 120° C. and filtered. The filtrate is an oil solution of the desired product.

Example E-14

A mixture is prepared by the addition of 7.5 parts of piperazine to 867 parts of the oil solution of the product prepared in Example E-11 at 190° C. The reaction mixture is heated at 190°-205° C. for 2 hours, then cooled to 130° C. and filtered. The filtrate is an oil solution of the desired product.

Example E-15

A mixture of 322 parts (0.5 equivalent) of the polyisobutene-substituted succinic acylating agent prepared in Example E-2, 68 parts (2.0 equivalents) of pentaerythritol and 508 parts of mineral oil is heated at 204°-227° C. for 5 hours. The reaction mixture is cooled to 162° C. and 5.3 parts (0.13 equivalent) of a commercial ethylene polyamine mixture having an average of about 3 to 10 nitrogen atoms per molecule is added. The reaction mixture is heated at 162°-163° C. for one hour, then cooled to 130° C. and filtered. The filtrate is an oil solution of the desired product.

Example E-16

The procedure for Example E-15 is repeated except the 5.3 parts (0.13 equivalent) of ethylene polyamine is replaced by 21 parts (0.175 equivalent) of tris(hydroxymethyl)aminomethane.

Example E-17

A mixture of 1480 parts of the polyisobutene-substituted succinic acylating agent prepared in Example E-6, 115 parts (0.53 equivalent) of a commercial mixture of $C_{12-18}$ straight-chain primary alcohols, 87 parts (0.594 equivalent) of a commercial mixture of $C_{8-10}$ straight-chain primary alcohols, 1098 parts of mineral oil and 400 parts of toluene is heated to 120° C. At 120° C., 1.5 parts of sulfuric acid are added and the reaction mixture is heated to 160° C. and held for 3 hours. To the reaction mixture are then added 158 parts (2.0 equivalents) of n-butanol and 1.5 parts of sulfuric acid. The reaction mixture is heated at 160° C. for 15 hours, and 12.6 parts (0.088 equivalent) of aminopropyl morpholine are added. The reaction mixture is held at 160° C. for an additional 6 hours, stripped at 150° C. under vacuum and filtered to yield an oil solution of the desired product.

Example E-18

A mixture of 1869 parts of a polyisobutenyl-substituted succinic anhydride having an equivalent weight of about 540 (prepared by reacting chlorinated polyisobutene characterized by a number average molecular weight of 1000 and a chlorine content of 4.3%), an equimolar quantity of maleic anhydride and 67 parts of diluent oil is heated to 90° C. while blowing nitrogen gas through the mass. Then a mixture of 132 parts of a polyethylenepolyamine mixture having an average composition corresponding to that of tetraethylene pentamine and characterized by a nitrogen content of about 36.9% and an equivalent weight of about 38, and 33 parts of a triol demulsifier is added to the preheated oil and acylating agent over a period of about 0.5 hour. The triol demulsifier has a number average molecular weight of about 4800 and is prepared by reacting propylene oxide with glycerol and thereafter reacting that product with ethylene oxide to form a product where —$CH_2CH_2O$— groups make up about 18% by weight of the demulsifier's average molecular weight. An exothermic reaction takes place causing the temperature to rise to about 120° C. Thereafter the mixture is heated to 170° C. and maintained at that temperature for about 4.5 hours. Additional oil (666 parts) is added and the product filtered. The filtrate is an oil solution of a desired ester-containing composition.

Example E-19

(a) A mixture comprising 1885 parts (3.64 equivalents) of the acylating agent described in Example E-18, 248 parts (7.28 equivalents) of pentaerythritol, and 64 parts (0.03 equivalent) of a polyoxyalkylene diol demulsifier having a number average molecular weight of about 3800 and consisting essentially of a hydrophobic base of $$—CH(CH_3)CH_2O—$$

units with hydrophylic terminal portions of —$CH_2C$—$H_2O$— units, the latter comprising approximately 10% by weight of the demulsifier are heated from room temperature to 200° C. over a one hour period while blowing the mass with nitrogen gas. The mass is then maintained at a temperature of about 200°-210° C. for an additional period of about 8 hours while continuing the nitrogen blowing.

(b) To the ester-containing composition produced according to (a) above, there are added over a 0.3 hour period (while maintaining a temperature of 200°-210° C. and nitrogen blowing) 39 parts (0.95 equivalent) of a polyethylenepolyamine mixture having an equivalent weight of about 41.2. The resulting mass is then maintained at a temperature of about 206°-210° C. for 2 hours during which time the nitrogen blowing is continued. Subsequently, 1800 parts of low viscosity mineral oil are added as a diluent and the resulting mass filtered at a temperature of about 110°-130° C. The filtrate is a 45% oil solution of the desired ester-containing composition.

Example E-20

(a) An ester-containing composition is prepared by heating a mixture of 3215 parts (6.2 equivalents) of a polyisobutenyl-substituted succinic anhydride as described in Example E-18, 422 parts (12.4 equivalents) of pentaerythritol, 55 parts (0.029 equivalent) of the polyoxyalkylene diol described in Example E-19, and 55 parts (0.034 equivalent) of a triol demulsifier having a number average molecular weight of about 4800 prepared by first reacting propylene oxide with glycerol and thereafter reacting that product with ethylene oxide to produce a product where —$CH_2CH_2O$— groups make up about 18% by weight of the demulsifiers average molecular weight to a temperature of about 200°-210° C. with nitrogen blowing for about 6 hours. The resulting reaction mixture is an ester-containing composition.

(b) Subsequently, 67 parts (1.63 equivalents) of a polyethylenepolyamine mixture having an equivalent weight of about 41.2 are added to the composition produced according to (a) over a 0.6 hour period while maintaining a temperature of about 200°-210° C. with nitrogen blowing. The resulting mass is then heated an additional 2 hours at a temperature of about 207°-215° C., with continued nitrogen blowing and subsequently 2950 parts of low viscosity mineral diluent oil are added to the reaction mass. Upon filtration, there is obtained a 45% oil solution of an ester- and amine-containing composition.

Example E-21

(a) A mixture comprising 3204 parts (6.18 equivalents) of the acylating agent of Example E-18 above, 422 parts (12.41 equivalents) of pentaerythritol, 109 parts (0.068 equivalent) of the triol of Example E-20 (a) is heated to 200° C. over a 1.5 hour period with nitrogen blowing and thereafter maintained between 200°-212° C. for 2.75 hours with continued nitrogen blowing.

(b) Subsequently, there are added to the ester-containing composition produced according to (a) above, 67 parts (1.61 equivalents) of a polyethylene polyamine mixture having an equivalent weight of about 41.2. This mass is maintained at a temperature of about 210°-215° C. for about one hour. A low viscosity mineral diluent oil (3070 parts) is added to the mass, and this material is filtered at a temperature of about 120° C. The filtrate is a 45% oil solution of an amine-modified carboxylic ester.

Example E-22

A mixture of 1000 parts of polyisobutene having a number average molecular weight of about 1000 and 108 parts (1.1 moles) of maleic anhydride is heated to about 190° C. and 100 parts (1.43 moles) of chlorine are added beneath the surface over a period of about 4 hours while maintaining the temperature at about 185°-190° C. The mixture then is blown with nitrogen at this temperature for several hours, and the residue is the desired polyisobutene-substituted succinic acylating agent.

A solution of 1000 parts of the above-prepared acylating agent in 857 parts of mineral oil is heated to about 150° C. with stirring, and 109 parts (3.2 equivalents) of pentaerythritol are added with stirring. The mixture is blown with nitrogen and heated to about 200° C. over a period of about 14 hours to form an oil solution of the desired carboxylic ester intermediate. To the intermediate, there are added 19.25 parts (0.46 equivalent) of a commercial mixture of ethylene polyamines having an average of about 3 to about 10 nitrogen atoms per molecule. The reaction mixture is stripped by heating at 205° C. with nitrogen blowing for 3 hours and filtered. The filtrate is an oil solution (45% oil) of the desired amine-modified carboxylic ester which contains 0.35% nitrogen.

Example E-23

A mixture of 1000 parts (0.495 mole) of polyisobutene having a number average molecular weight of 2020 and a weight average molecular weight of 6049 and 115 parts (1.17 moles) of maleic anhydride is heated to 184° C. over 6 hours, during which time 85 parts (1.2 moles) of chlorine are added beneath the surface. An additional 59 parts (0.83 mole) of chlorine are added over 4 hours at 184°-189° C. The mixture is blown with nitrogen at 186°-190° C. for 26 hours. The residue is a polyisobutene-substituted succinic anhydride having a total acid number of 95.3.

A solution of 409 parts (0.66 equivalent) of the substituted succinic anhydride in 191 parts of mineral oil is heated to 150° C. and 42.5 parts (1.19 equivalent) of pentaerythritol are added over 10 minutes, with stirring, at 145°-150° C. The mixture is blown with nitrogen and heated to 205°-210° C. over about 14 hours to yield an oil solution of the desired polyester intermediate.

Diethylene triamine, 4.74 parts (0.138 equivalent), is added over one-half hour at 160° C. with stirring, to 988 parts of the polyester intermediate (containing 0.69 equivalent of substituted succinic acylating agent and 1.24 equivalents of pentaerythritol). Stirring is continued at 160° C. for one hour, after which 289 parts of mineral oil are added. The mixture is heated for 16 hours at 135° C. and filtered at the same temperature, using a filter aid material. The filtrate is a 35% solution in mineral oil of the desired amine-modified polyester. It has a nitrogen content of 0.16% and a residual acid number of 2.0.

Example E-24

Following the procedure of Example E-23, 988 parts of the polyester intermediate of that example are reacted with 5 parts (0.138 equivalent) of triethylene tetramine. The product is diluted with 290 parts of mineral oil to yield a 35% solution of the desired amine-modified polyester. It contains 0.15% nitrogen and has a residual acid number of 2.7.

Example E-25

Pentaerythritol, 42.5 parts (1.19 equivalents) is added over 5 minutes at 150° C. to a solution in 208 parts of mineral oil of 448 parts (0.7 equivalent) of a polyisobutene-substituted succinic anhydride similar to that of Example E-23 but having a total acid number of 92. The mixture is heated to 205° C. over 10 hours and blown with nitrogen for 6 hours at 205°-210° C. It is then diluted with 384 parts of mineral oil and cooled to 165° C., and 5.89 parts (0.14 equivalent) of a commercial ethylene polyamine mixture containing an average of 3-7 nitrogen atoms per molecule are added over 30 minutes at 155°-160° C. Nitrogen blowing is continued for one hour, after which the mixture is diluted with an additional 304 parts of oil. Mixing is continued at 130°-135° C. for 15 hours after which the mixture is cooled and filtered using a filter aid material. The filtrate is a 35% solution in mineral oil of the desired amine-modified polyester. It contains 0.147% nitrogen and has a residual acid number of 2.07.

Example E-26

A solution of 417 parts (0.7 equivalent) of the polyisobutene-substituted succinic anhydride of Example E-23 in 194 parts of mineral oil is heated to 153° C. and 42.8 parts (1.26 equivalents) of pentaerythritol are added. The mixture is heated at 153°-228° C. for about 6 hours. It is then cooled to 170° C. and diluted with 375 parts of mineral oil. It is further cooled to 156°-158° C. and 5.9 parts (0.14 equivalent) of the ethylene polyamine mixture of Example E-25 are added over one-half hour. The mixture is stirred at 158°-160° C. for one hour and diluted with an additional 295 parts of mineral oil. It is blown with nitrogen at 135° C. for 16 hours and filtered at 135° C. using a filter aid material. The filtrate is the desired 35% solution in mineral oil of the amine-modified polyester. It contains 0.16% nitrogen and has a total acid number of 2.0.

Example E-27

Following substantially the procedure of Example E-26, a product is prepared from 421 parts (0.7 equivalent) of a polyisobutene-substituted succinic anhydride having a total acid number of 93.2, 43 parts (1.26 equivalents) of pentaerythritol and 7.6 parts (0.18 equivalent) of the commercial ethylene polyamine mixture. The initial oil charge is 196 parts and subsequent charges are 372 and 296 parts. The product (a 35% solution in mineral oil) contains 0.2% nitrogen and has a residual acid number of 2.0.

The lubricating oil compositions of the present invention also may contain, and preferably do contain, at least one friction modifier to provide the lubricating oil with the proper frictional characteristics. Various amines, particularly tertiary amines are effective friction modifiers. Examples of tertiary amine friction modifiers include N-fatty alkyl-N,N-diethanol amines, N-fatty alkyl-N,N-diethoxy ethanol amines, etc. Such tertiary amines can be prepared by reacting a fatty alkyl amine with an appropriate number of moles of ethylene oxide. Tertiary amines derived from naturally occurring substances such as coconut oil and oleoamine are available from Armour Chemical Company under the trade designation "Ethomeen". Particular examples are the Ethomeen-C and the Ethomeen-O series.

Sulfur-containing compounds such as sulfurized $C_{12-24}$ fats, alkyl sulfides and polysulfides wherein the alkyl groups contain from 1 to 8 carbon atoms, and sulfurized polyolefins also may function as friction modifiers in the lubricating oil compositions of the invention.

(F) Partial Fatty Acid Ester of Polyhydric Alcohols:

In one embodiment, a preferred friction modifier to be included in the lubricating oil compositions of the present invention is at least one partial fatty acid ester of a polyhydric alcohol, and generally, up to about 1% by weight of the partial fatty acid esters appears to provide the desired friction-modifying characteristics. The hydroxy fatty acid esters are selected from hydroxy fatty acid esters of dihydric or polyhydric alcohols or oil-soluble oxyalkylenated derivatives thereof.

The term "fatty acid" as used in the specification and claims refers to acids which may be obtained by the hydrolysis of a naturally occurring vegetable or animal fat or oil. These acids usually contain from about 8 to about 22 carbon atoms and include, for example, caprylic acid, caproic acid, palmitic acid, stearic acid, oleic acid, linoleic acid, etc. Acids containing from 10 to 22 carbon atoms generally are preferred, and in some embodiments, those acids containing from 16 to 18 carbon atoms are especially preferred.

The polyhydric alcohols which can be utilized in the preparation of the partial fatty acids contain from 2 to about 8 or 10 hydroxyl groups, more generally from about 2 to about 4 hydroxyl groups. Examples of suitable polyhydric alcohols include ethylene glycol, propylene glycol, neopentylene glycol, glycerol, pentaerythritol, etc. Ethylene glycol and glycerol are preferred. Polyhydric alcohols containing lower alkoxy groups such as methoxy and/or ethoxy groups may be utilized in the preparation of the partial fatty acid esters.

Suitable partial fatty acid esters of polyhydric alcohols include, for example, glycol monoesters, glycerol mono- and diesters, and pentaerythritol di- and/or triesters. The partial fatty acid esters of glycerol are preferred, and of the glycerol esters, monoesters, or mixtures of monoesters and diesters are often utilized. The partial fatty acid esters of polyhydric alcohols can be prepared by methods well known in the art, such as by direct esterification of an acid with a polyol, reaction of a fatty acid with an epoxide, etc.

It is generally preferred that the partial fatty acid ester contain olefinic unsaturation, and this olefinic unsaturation usually is found in the acid moiety of the ester. In addition to natural fatty acids containing olefinic unsaturation such as oleic acid, octeneoic acids, tetradeceneoic acids, etc., can be utilized in forming the esters.

The partial fatty acid esters utilized as friction modifiers (component (F)) in the lubricating oil compositions of the present invention may be present as components of a mixture containing a variety of other components such as unreacted fatty acid, fully esterified polyhydric alcohols, and other materials. Commercially available partial fatty acid esters often are mixtures which contain one or more of these components as well as mixtures of mono- and diesters of glycerol.

One method for preparing monoglycerides of fatty acids from fats and oils is described in Birnbaum U.S. Pat. No. 2,875,221. The process described in this patent is a continuous process for reacting glycerol and fats to provide a product having a high proportion of monoglyceride. Among the commercially available glycerol esters are ester mixtures containing at least about 30% by weight of monoester and generally from about 35% to about 65% by weight of monoester, about 30% to about 50% by weight of diester, and the balance in the aggregate, generally less than about 15%, is a mixture of triester, free fatty acid and other components. Specific examples of commercially available material comprising fatty acid esters of glycerol include Emery 2421 (Emery Industries, Inc.), Cap City GMO (Capital), DUR-EM 114, DUR-EM GMO, etc. (Durkee Industrial Foods, Inc.) and various materials identified under the mark MAZOL GMO (Mazer Chemicals, Inc.). Other examples of partial fatty acid esters of polyhydric alcohols may be found in K. S. Markley, Ed., "Fatty Acids", Second Edition, Parts I and V, Interscience Publishers (1968). Numerous commercially available fatty acid esters of polyhydric alcohols are listed by tradename and manufacturer in McCutcheons' Emulsifiers and Detergents, North American and International Combined Editions (1981).

The following example illustrates the preparation of a partial fatty acid ester of glycerol.

Example F-1

A mixture of glycerol oleates is prepared by reacting 882 parts of a high oleic-content sunflower oil which comprises about 80% oleic acid, about 10% linoleic acid and the balance saturated triglycerides, and 499 parts of glycerol in the presence of a catalyst prepared by dissolving potassium hydroxide in glycerol. The reaction is conducted by heating the mixture to 155° C. under a nitrogen sparge, and then heating under nitrogen for 13 hours at 155° C. The mixture is then cooled to less than 100° C., and 9.05 parts of 85% phosphoric acid are added to neutralize the catalyst. The neutralized reaction mixture is transferred to a 2-liter separatory funnel, and the lower layer is removed and discarded. The upper layer is the product which contains, by analysis, 56.9% by weight glycerol monooleate, 33.3% glycerol dioleate (primarily 1,2-) and 9.8% glycerol trioleate.

(G) Neutral and Basic Alkaline Earth Metal Salts:

The lubricating oil compositions of the present invention also may contain at least one neutral or basic alkaline earth metal salt of at least one acidic organic compound. Such salt compounds generally are referred to as ash-containing detergents. The acidic organic compound may be at least one sulfur acid, carboxylic acid, phosphorus acid, or phenol, or mixtures thereof.

Calcium, magnesium, barium and strontium are the preferred alkaline earth metals. Salts containing a mixture of ions of two or more of these alkaline earth metals can be used.

The salts which are useful as component (G) can be neutral or basic. The neutral salts contain an amount of alkaline earth metal which is just sufficient to neutralize the acidic groups present in the salt anion, and the basic salts contain an excess of the alkaline earth metal cation. Generally, the basic or overbased salts are preferred. The basic or overbased salts will have metal ratios of up to about 40 and more particularly from about 2 to about 30 or 40.

A commonly employed method for preparing the basic (or overbased) salts comprises heating a mineral oil solution of the acid with a stoichiometric excess of a metal neutralizing agent, e.g., a metal oxide, hydroxide, carbonate, bicarbonate, sulfide, etc., at temperatures above about 50° C. In addition, various promoters may be used in the neutralizing process to aid in the incorporation of the large excess of metal. These promoters include such compounds as the phenolic substances, e.g., phenol, naphthol, alkylphenol, thiophenol, sulfurized alkylphenol and the various condensation products of formaldehyde with a phenolic substance; alcohols such as methanol, 2-propanol, octyl alcohol, cellosolve carbitol, ethylene, glycol, stearyl alcohol, and cyclohexyl alcohol; amines such as aniline, phenylenediamine, phenothiazine, phenyl-beta-naphthylamine, and dodecyl amine, etc. A particularly effective process for preparing the basic salts comprises mixing the acid with an excess of the basic alkaline earth metal in the presence of the phenolic promoter and a small amount of water and carbonating the mixture at an elevated temperature, e.g., 60° C. to about 200° C.

As mentioned above, the acidic organic compound from which the salt of component (G) is derived may be at least one sulfur acid, carboxylic acid, phosphorus acid, or phenol or mixtures thereof. Some of these acidic organic compounds (sulfonic and carboxylic acids) previously have been described above with respect to the preparation of the alkali metal salts (component (C)), and all of the acidic organic compounds described above can be utilized in the preparation of the alkaline earth metal salts useful as component (G) by techniques known in the art. In addition to the sulfonic acids, the sulfur acids include thiosulfonic, sulfinic, sulfenic, partial ester sulfuric, sulfurous and thiosulfuric acids.

The pentavalent phosphorus acids useful in the preparation of component (G) may be represented by the formula

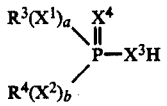

wherein each of $R^3$ and $R^4$ is hydrogen or a hydrocarbon or essentially hydrocarbon group preferably having from about 4 to about 25 carbon atoms, at least one of $R^3$ and $R^4$ being hydrocarbon or essentially hydrocarbon; each of $X^1$, $X^2$, $X^3$ and $X^4$ is oxygen or sulfur; and each of a and b is 0 or 1. Thus, it will be appreciated that the phosphorus acid may be an organophosphoric, phosphonic or phosphinic acid, or a thio analog of any of these.

The phosphorus acids may be those of the formula

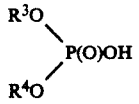

wherein $R^3$ is a phenyl group or (preferably) an alkyl group having up to 18 carbon atoms, and $R^4$ is hydrogen or a similar phenyl or alkyl group. Mixtures of such phosphorus acids are often preferred because of their ease of preparation.

Component (G) may also be prepared from phenols; that is, compounds containing a hydroxy group bound directly to an aromatic ring. The term "phenol" as used herein includes compounds having more than one hydroxy group bound to an aromatic ring, such as catechol, resorcinol and hydroquinone. It also includes alkylphenols such as the cresols and ethylphenols, and alkenylphenols. Preferred are phenols containing at least one alkyl substituent containing about 3–100 and especially about 6–50 carbon atoms, such as heptylphenol, octylphenol, dodecylphenol, tetrapropene-alkylated phenol, octadecylphenol and polybutenylphenols. Phenols containing more than one alkyl substituent may also be used, but the monoalkylphenols are preferred because of their availability and ease of production.

Also useful are condensation products of the above-described phenols with at least one lower aldehyde or ketone, the term "lower" denoting aldehydes and ketones containing not more than 7 carbon atoms. Suitable aldehydes include formaldehyde, acetaldehyde, propionaldehyde, the butyraldehydes, the valeraldehydes and benzaldehyde. Also suitable are aldehyde-yielding reagents such as paraformaldehyde, trioxane, methylol, Methyl Formcel and paraldehyde. Formaldehyde and the formaldehyde-yielding reagents are especially preferred.

The equivalent weight of the acidic organic compound is its molecular weight divided by the number of acidic groups (i.e., sulfonic acid or carboxy groups) present per molecule.

The amount of component (G) included in the lubricants of the present invention also may be varied over a wide range, and useful amounts in any particular lubricating oil composition can be readily determined by one skilled in the art. Component (G) functions as an auxiliary or supplemental detergent. The amount of component (G) contained in a lubricant of the invention may vary from about 0% to about 5% or more.

The following examples illustrate the preparation of neutral and basic alkaline earth metal salts useful as component (G).

Example G-1

A mixture of 906 parts of an oil solution of an alkyl phenyl sulfonic acid (having a number average molecular weight of 450, 564 parts mineral oil, 600 parts toluene, 98.7 parts magnesium oxide and 120 parts water is blown with carbon dioxide at a temperature of 78°–85° C. for 7 hours at a rate of about 3 cubic feet of carbon dioxide per hour. The reaction mixture is constantly agitated throughout the carbonation. After carbonation, the reaction mixture is stripped to 165° C./20 tor and the residue filtered. The filtrate is an oil solution (34% oil) of the desired overbased magnesium sulfonate having a metal ratio of about 3.

Example G-2

A polyisobutenyl succinic anhydride is prepared by reacting a chlorinated poly(isobutene) (having an average chlorine content of 4.3% and derived from a polyisobutene having a number average molecular weight of about 1150) with maleic anhydride at about 200° C. To a mixture of 1246 parts of this succinic anhydride and 1000 parts of toluene there is added at 25° C., 76.6 parts of barium oxide. The mixture is heated to 115° C. and 125 parts of water is added drop-wise over a period of one hour. The mixture is then allowed to reflux at 150° C. until all the barium oxide is reacted. Stripping and filtration containing the desired product.

Example G-3

A basic calcium sulfonate having a metal ratio of about 15 is prepared by carbonation, in increments, of a mixture of calcium hydroxide, a neutral sodium petroleum sulfonate, calcium chloride, methanol and an alkyl phenol.

Example G-4

A mixture of 323 parts of mineral oil, 4.8 parts of water, 0.74 parts of calcium chloride, 79 parts of lime, and 128 parts of methyl alcohol is prepared, and warmed to a temperature of about 50° C. To this mixture there is added 1000 parts of an alkyl phenyl sulfonic acid having a number average molecular weight of 500 with mixing. The mixture then is blown with carbon dioxide at a temperature of about 50° C. at the rate of about 5.4 pounds per hour for about 2.5 hours. After carbonation, 102 additional parts of oil are added and the mixture is stripped of volatile materials at a temperature of about 150°-155° C. at 55 mm. pressure. The residue is filtered and the filtrate is the desired oil solution of the overbased calcium sulfonate having calcium content of about 3.7% and a metal ratio of about 1.7.

Example G-5

A mixture of 490 parts (by weight) of a mineral oil, 110 parts of water, 61 parts of heptylphenol, 340 parts of barium mahogany sulfonate, and 227 parts of barium oxide is heated at 100° C. for 0.5 hour and then to 150° C. Carbon dioxide is then bubbled into the mixture until the mixture is substantially neutral. The mixture is filtered and the filtrate found to have a sulfate ash content of 25%.

Example G-6

A polyisobutene having a number average molecular weight of 50,000 is mixed with 10% by weight of phosphorus pentasulfide at 200° C. for 6 hours. The resulting product is hydrolyzed by treatment with steam at 160° C. to produce an acidic intermediate. The acidic intermediate is then converted to a basic salt by mixing with twice its volume of mineral oil, 2 moles of barium hydroxide and 0.7 mole of phenol and carbonating the mixture at 150° C. to produce a fluid product.

(H) Neutral and Basic Salts of Phenol Sulfides:

In one embodiment, the oils of the invention may contain at least one neutral or basic alkaline earth metal salt of an alkylphenol sulfide. The oils may contain from about 0 to about 2 or 3% of said phenol sulfides. More often, the oil may contain from about 0.01 to about 2% by weight of the basic salts of phenol sulfides. The term "basic" is used herein the same way in which it was used in the definition of other components above, that is, it refers to salts having a metal ratio of greater than 1. The neutral and basic salts of phenol sulfides are detergents and antioxidants in the oil compositions and also generally will improve the performance of the oils in Caterpillar testing.

The alkylphenols from which the sulfide salts are prepared generally comprise phenols containing hydrocarbon substituents with at least about 6 carbon atoms; the substituents may contain up to about 7000 aliphatic carbon atoms. Also included are substantially hydrocarbon substituents, as defined hereinabove. The preferred hydrocarbon substituents are derived from the polymerization of olefins such as ethylene, propene, 1-butene, isobutene, 1-hexene, 1-octene, 2-methyl-1-heptene, 2-butene, 2-pentene, 3-pentene and 4-octene. The hydrocarbon substituent may be introduced onto the phenol by mixing the hydrocarbon and the phenol at a temperature of about 50°-200° C. in the presence of a suitable catalyst such as aluminum trichloride, boron trifluoride, zinc chloride or the like. The substituent can also be introduced by other alkylation processes known in the art.

The term "alkylphenol sulfides" is meant to include di-(alkylphenol)monosulfides, disulfides, polysulfides, and other products obtained by the reaction of the alkylphenol with sulfur monochloride, sulfur dichloride or elemental sulfur. The molar ratio of the phenol to the sulfur compound can be from about 1:0.5 to about 1:1.5, or higher. For example, phenol sulfides are readily obtained by mixing, at a temperature above about 60° C., one mole of an alkylphenol and 0.5-1.5 moles of sulfur dichloride. The reaction mixture is usually maintained at about 100° C. for about 2-5 hours, after which time the resulting sulfide is dried and filtered. When elemental sulfur is used, temperatures of about 200° C. or higher are sometimes desirable. It is also desirable that the drying operation be conducted under nitrogen or a similar inert gas.

The basic salts of phenol sulfides are conveniently prepared by reacting the phenol sulfide with a metal base, typically in the presence of a promoter such as those enumerated for the preparation of component (G). Temperatures and reaction conditions are similar for the preparation of the three basic products involved in the lubricant of the present invention. Preferably, the basic salt is treated with carbon dioxide after it has been formed.

It is often preferred to use, as an additional promoter, a carboxylic acid containing about 1-100 carbon atoms or an alkali metal, alkaline earth metal, zinc or lead salt thereof. Especially preferred in this regard are the lower alkyl monocarboxylic acids including formic acid, acetic acid, propionic acid, butyric acid, isobutyric acid and the like. The amount of such acid or salt used is generally about 0.002-0.2 equivalent per equivalent of metal base used for formation of the basic salt.

In an alternative method for preparation of these basic salts, the alkylphenol is reacted simultaneously with sulfur and the metal base. The reaction should then be carried out at a temperature of at least about 150° C., preferably about 150°-200° C. It is frequently convenient to use as a solvent a compound which boils in this range, preferably a mono-(lower alkyl) ether of a polyethylene glycol such as diethylene glycol. The methyl and ethyl ethers of diethylene glycol, which are respectively sold under the trade names "Methyl Carbitol" and "Carbitol", are especially useful for this purpose.

Suitable basic alkyl phenol sulfides are disclosed, for example, in U.S. Pat. Nos. 3,372,116 and 3,410,798, which are hereby incorporated by reference.

The following examples illustrate methods for the preparation of these basic materials.

Example H-1

A phenol sulfide is prepared by reacting sulfur dichloride with a polyisobutenyl phenol in which the polyisobutenyl substituent has a number average molecular weight of about 330 in the presence of sodium acetate (an acid acceptor used to avoid discoloration of the product). A mixture of 1755 parts of this phenol sulfide, 500 parts of mineral oil, 335 parts of calcium hydroxide and 407 parts of methanol is heated to about 43°-50° C. and carbon dioxide is bubbled through the mixture for about 7.5 hours. The mixture is then heated to drive off volatile matter, an additional 422.5 parts of oil are added to provide a 60% solution in oil. This solution contains 5.6% calcium and 1.59% sulfur.

Example H-2

To 6072 parts (22 equivalents) of a tetrapropylene-substituted phenol (prepared by mixing, at 138° C. and in the presence of a sulfuric acid treated clay, phenol and tetrapropylene), there are added at 90°-95° C., 1134 parts (22 equivalents) of sulfur dichloride. The addition is made over a 4-hour period whereupon the mixture is bubbled with nitrogen for 2 hours, heated to 150° C. and filtered. To 861 parts (3 equivalents) of the above product, 1068 parts of mineral oil, and 90 parts of water, there are added at 70° C., 122 parts (3.3 equivalents) of calcium hydroxide. The mixture is maintained at 110° C. for 2 hours, heated to 165° C. and maintained at this temperature until it is dry. Thereupon, the mixture is cooled to 25° C. and 180 parts of methanol are added. The mixture is heated to 50° C. and 366 parts (9.9 equivalents) of calcium hydroxide and 50 parts (0.633 equivalent) of calcium acetate are added. The mixture is agitated for 45 minutes and is then treated at 50°-70° C. with carbon dioxide at a rate of 2-5 cubic feet per hour for 3 hours. The mixture is dried at 165° C. and the residue is filtered. The filtrate has a calcium content of 8.8%, a neutralization number of 39 (basic) and a metal ratio of 4.4.

Example H-3

To 5880 parts (12 equivalents) of a polyisobutene-substituted phenol (prepared by mixing, at 54° C. and in the presence of boron trifluoride, equimolar amounts of phenol and a polyisobutene having a number average molecular weight of about 350) and 2186 parts of mineral oil, there are added over 2.5 hours and at 90°-110° C., 618 parts (12 equivalents) of sulfur dichloride. The mixture is heated to 150° C. and bubbled with nitrogen. To 3449 parts (5.25 equivalents) of the above product, 1200 parts of mineral oil, and 130 parts of water, there are added at 70° C., 147 parts (5.25 equivalents) of calcium oxide. The mixture is maintained at 95°-110° C. for 2 hours, heated to and maintained at 160° C. for one hour and then cooled to 60° C. whereupon 920 parts of 1-propanol, 307 parts (10.95 equivalents) of calcium oxide, and 46.3 parts (0.78 equivalent) of acetic acid are added. The mixture is then contacted with carbon dioxide at a rate of 2 cubic feet per hour for 2.5 hours. The mixture is dried at 190° C. and the residue is filtered to give the desired product.

Example H-4

A mixture of 485 parts (1 equivalent) of a polyisobutene-substituted phenol wherein the substituent has a number average molecular weight of about 400, 32 parts (1 equivalent) of sulfur, 111 parts (3 equivalents) of calcium hydroxide, 16 parts (0.2 equivalent) of calcium acetate, 485 parts of diethylene glycol monomethyl ether and 414 parts of mineral oil is heated at 120°-205° C. under nitrogen for 4 hours. Hydrogen sulfide evolution begins as the temperature rises above 125° C. The material is allowed to distil and hydrogen sulfide is absorbed in a sodium hydroxide solution. Heating is discontinued when no further hydrogen sulfide absorption is noted; the remaining volatile material is removed by distillation at 95° C./10 mm pressure. The distillation residue is filtered. The product thus obtained is a 60% solution of the desired product in mineral oil.

(I) Sulfurized Olefins:

The oil compositions of the present invention also may contain (I) one or more sulfur-containing composition useful in improving the anti-wear, extreme pressure and antioxidant properties of the lubricating oil compositions. The oil compositions may include from about 0.01 to about 2% by weight of the sulfurized olefins. Sulfur-containing compositions prepared by the sulfurization of various organic materials including olefins are useful. The olefins may be any aliphatic, arylaliphatic or alicyclic olefinic hydrocarbon containing from about 3 to about 30 carbon atoms.

The olefinic hydrocarbons contain at least one olefinic double bond, which is defined as a non-aromatic double bond; that is, one connecting two aliphatic carbon atoms. In its broadest sense, the olefinic hydrocarbon may be defined by the formula $$R^7R^8C{=}CR^9R^{10}$$

wherein each of $R^7$, $R^8$, $R^9$ and $R^{10}$ is hydrogen or a hydrocarbon (especially alkyl or alkenyl) radical. Any two of $R^7$, $R^8$, $R^9$, $R^{10}$ may also together form an alkylene or substituted alkylene group; i.e., the olefinic compound may be alicyclic.

Monoolefinic and diolefinic compounds, particularly the former, are preferred, and especially terminal monoolefinic hydrocarbons; that is, those compounds in which $R^9$ and $R^{10}$ are hydrogen and $R^7$ and $R^8$ are alkyl (that is, the olefin is aliphatic). Olefinic compounds having about 3-20 carbon atoms are particularly desirable.

Propylene, isobutene and their dimers, trimers and tetramers, and mixtures thereof are especially preferred olefinic compounds. Of these compounds, isobutene and diisobutene are particularly desirable because of their availability and the particularly high sulfur-containing compositions which can be prepared therefrom.

The sulfurizing reagent may be, for example, sulfur, a sulfur halide such as sulfur monochloride or sulfur dichloride, a mixture of hydrogen sulfide and sulfur or sulfur dioxide, or the like. Sulfur-hydrogen sulfide mixtures are often preferred and are frequently referred to hereinafter; however, it will be understood that other sulfurization agents may, when appropriate, be substituted therefor.

The amounts of sulfur and hydrogen sulfide per mole of olefinic compound are, respectively, usually about 0.3–3.0 gram-atoms and about 0.1–1.5 moles. The preferred ranges are about 0.5–2.0 gram-atoms and about 0.5–1.25 moles respectively, and the most desirable ranges are about 1.2–1.8 gram-atoms and about 0.4–0.8 mole respectively.

The temperature range in which the sulfurization reaction is carried out is generally about 50°–350° C. The preferred range is about 100°–200° C., with about 125°–180° C. being especially suitable. The reaction is often preferably conducted under superatmospheric pressure; this may be and usually is autogenous pressure (i.e., the pressure which naturally develops during the course of the reaction) but may also be externally applied pressure. The exact pressure developed during the reaction is dependent upon such factors as the design and operation of the system, the reaction temperature and the vapor pressure of the reactants and products and it may vary during the course of the reaction.

It is frequently advantageous to incorporate materials useful as sulfurization catalysts in the reaction mixture. These materials may be acidic, basic or neutral, but are preferably basic materials, especially nitrogen bases including ammonia and amines, most often alkylamines. The amount of catalyst used is generally about 0.01–2.0% of the weight of the olefinic compound. In the case of the preferred ammonia and amine catalysts, about 0.0005–0.5 mole per mole of olefin is preferred, and about 0.001–0.1 mole is especially desirable.

Following the preparation of the sulfurized mixture, it is preferred to remove substantially all low boiling materials, typically by venting the reaction vessel or by distillation at atmospheric pressure, vacuum distillation or stripping, or passage of an inert gas such as nitrogen through the mixture at a suitable temperature and pressure.

A further optional step in the preparation of component (I) is the treatment of the sulfurized product, obtained as described hereinabove, to reduce active sulfur. An illustrative method is treatment with an alkali metal sulfide. Other optional treatments may be employed to remove insoluble by-products and improve such qualities as the odor, color and staining characteristics of the sulfurized compositions.

U.S. Pat. No. 4,119,549 is incorporated by reference herein for its disclosure of suitable sulfurized olefins useful in the lubricating oils of the present invention. Several specific sulfurized compositions are described in the working examples thereof. The following examples illustrate the preparation of two such compositions.

Example I-1

Sulfur (629 parts, 19.6 moles) is charged to a jacketed high-pressure reactor which is fitted with agitator and internal cooling coils. Refrigerated brine is circulated through the coils to cool the reactor prior to the introduction of the gaseous reactants. After sealing the reactor, evacuating to about 6 torr and cooling, 1100 parts (9.6 moles) of isobutene, 334 parts (9.8 moles) of hydrogen sulfide and 7 parts of n-butylamine are charged to the reactor. The reactor is heated, using steam in the external jacket, to a temperature of about 171° C. over about 1.5 hours. A maximum pressure of 720 psig is reached at about 138° C. during this heat-up. Prior to reaching the peak reaction temperature, the pressure starts to decrease and continues to decrease steadily as the gaseous reactants are consumed. After about 4.75 hours at about 171° C., the unreacted hydrogen sulfide and isobutene are vented to a recovery system. After the pressure in the reactor has decreased to atmospheric, the sulfurized product is recovered as a liquid.

Example I-2

Following substantially the procedure of Example I-1, 773 parts of diisobutene are reacted with 428.6 parts of sulfur and 143.6 parts of hydrogen sulfide in the presence of 2.6 parts of n-butylamine, under autogenous pressure at a temperature of about 150°–155° C. Volatile materials are removed and the sulfurized product is recovered as a liquid.

Sulfur-containing compositions characterized by the presence of at least one cycloaliphatic group with at least two nuclear carbon atoms of one cycloaliphatic group or two nuclear carbon atoms of different cycloaliphatic groups joined together through a divalent sulfur linkage also are useful in component (I) in the lubricating oil compositions of the present invention. These types of sulfur compounds are described in, for example, U.S. Pat. Re. No. 27,331, the disclosure which is hereby incorporated by reference. The sulfur linkage contains at least two sulfur atoms, and sulfurized Diels-Alder adducts are illustrative of such compositions.

In general, the sulfurized Diels-Alder adducts are prepared by reacting sulfur with at least one Diels-Alder adduct at a temperature within the range of from about 110° C. to just below the decomposition temperature of the adduct. The molar ratio of sulfur to adduct is generally from about 0.5:1 to about 10:1. The Diels-Alder adducts are prepared by known techniques by reacting a conjugated diene with an ethylenically or acetylenically unsaturated compound (dienophile). Examples of conjugated dienes include isoprene, methylisoprene, chloroprene, and 1,3-butadiene. Examples of suitable ethylenically unsaturated compounds include alkyl acrylates such as butyl acrylate and butyl methacrylate. In view of the extensive discussion in the prior art of the preparation of various sulfurized Diels-Alder adducts, it is believed unnecessary to lengthen this application by incorporating any further discussion of the preparation of such sulfurized products. The following examples illustrate the preparation of two such compositions.

Example I-3

(a) A mixture comprising 400 grams of toluene and 66.7 grams of aluminum chloride is charged to a two-liter flask fitted with a stirrer, nitrogen inlet tube, and a solid carbon dioxide-cooled reflux condenser. A second mixture comprising 640 grams (5 mole) of butylacrylate and 240.8 grams of toluene is added to the $AlCl_3$ slurry over a 0.25-hour period while maintaining the temperature within the range of 37°–58° C. Thereafter, 13 grams (5.8 moles) of butadiene are added to the slurry over a 2.75-hour period while maintaining the temperature of the reaction mass at 60°–61° C. by means of external cooling. The reaction mass is blown with nitrogen for about 0.33-hour and then transferred to a four-liter separatory funnel and washed with a solution of 150 grams of concentrated hydrochloric acid in 1100 grams of water. Thereafter, the product is subjected to two additional water washings using 1000 ml of water for each wash. The washed reaction product is subsequently distilled to remove unreacted butylacrylate and toluene. The residue of this first distillation step is subjected to further distillation at a pressure of 9–10 millimeters of mercury whereupon 785 grams of the desired adduct are collected over the temperature of 105°-115° C.

(b) The above-prepared adduct of butadiene-butylacrylate (4550 grams, 25 moles) and 1600 grams (50 moles) of sulfur flowers are charged to a 12 liter flask, fitted with stirrer, reflux condenser, and nitrogen inlet tube. The reaction mixture is heated at a temperature within the range of 150°-155° C. for 7 hours while passing nitrogen therethrough at a rate of about 0.5 cubic feet per hour. After heating, the mass is permitted to cool to room temperature and filtered, the sulfur-containing product being the filtrate.

Example I-4

(a) An adduct of isoprene and acrylonitrile is prepared by mixing 136 grams or isoprene, 172 grams of methylacrylate, and 0.9 gram of hydroquinone (polymerization inhibitor) in a rocking autoclave and thereafter heating for 16 hours at a temperature within the range of 130°-140° C. The autoclave is vented and the contents decanted thereby producing 240 grams of a light yellow liquid. This liquid is stripped at a temperature of 90° C. and a pressure of 10 millimeters of mercury thereby yielding the desired liquid product as the residue.

(b) To 255 grams (1.65 moles) of the isoprenemethacrylate adduct of (a) heated to a temperature of 110°-120° C., there are added 53 grams (1.65 moles) of sulfur flowers over a 45-minute period. The heating is continued for 4.5 hours at a temperature in the range of 130°-160° C. After cooling to room temperature, the reaction mixture is filtered through a medium sintered glass funnel. The filtrate consists of 301 grams of the desired sulfur-containing products.

(c) In part (b) the ratio of sulfur to adduct is 1:1. In this example, the ratio is 5:1. Thus, 640 grams (20 moles) of sulfur flowers are heated in a three-liter flask at 170° C. for about 0.3 hour. Thereafter, 600 grams (4 moles) of the isoprene-methacrylate adduct of (a) are added dropwise to the molten sulfur while maintaining the temperature at 174°-198° C. Upon cooling to room temperature, the reaction mass is filtered as above, the filtrate being the desired product.

Other extreme pressure agents and corrosion- and oxidation-inhibiting agents also may be included and are exemplified by chlorinated aliphatic hydrocarbons such as chlorinated wax; organic sulfides and polysulfides such as benzyl disulfide, bis(chlorobenzyl)disulfide, dibutyl tetrasulfide, sulfurized methyl ester of oleic acid, sulfurized alkylphenol, sulfurized dipentene, and sulfurized terpene; phosphosulfurized hydrocarbons such as the reaction product of a phosphorus sulfide with turpentine or methyl oleate; phosphrous esters including principally dihydrocarbon and trihydrocarbon phosphites such as dibutyl phosphite, diheptyl phosphite, dicyclohexyl phosphite, pentyl phenyl phosphite, dipentyl phenyl phosphite, tridecyl phosphite, distearyl phosphite, dimethyl naphthyl phosphite, oleyl 4-pentylphenyl phosphate, polypropylene (molecular weight 500)-substituted phenyl phosphite, diisobutyl-substituted phenyl phosphite; metal thiocarbamates, such as zinc dioctyldithiocarbomate, and barium heptylphenyl dithiocarbamate.

Pour point depressants are a particularly useful type of additive often included in the lubricating oils described herein. The use of such pour point depressants in oil-based compositions to improve low temperature properties of oil-based compositions is well known in the art. See, for example, page 8 of "Lubricant Additives" by C. V. Smalheer and R. Kennedy Smith Lezius-Hiles Co. publishers, Cleveland, Ohio, 1967.

Examples of useful pour point depressants are polymethacrylates; polycarylates; polyacrylamides; condensation products of haloparaffin waxes and aromatic compounds; vinyl carboxylate polymers; and terpolymers of dialkylfumarates, vinyl esters of fatty acids and alkyl vinyl ethers. Pour point depressants useful for the purposes of this invention, techniques for their preparation and their uses are described in U.S. Pat. Nos. 2,387,501; 2,015,748; 2,655,479; 1,815,022; 2,191,498; 2,666,746; 2,721,877; 2,721,878; and 3,250,715 which are hereby incorporated by reference for their relevant disclosures.

Anti-foam agents are used to reduce or prevent the formation of stable foam. Typical anti-foam agents include silicones or organic polymers. Additional anti-foam compositions are described in "Foam Control Agents" by Henry T. Kerner (Noyes Data Corporation, 1976), pages 125-162.

The lubricating oil compositions of the present invention also may contain, particularly when the lubricating oil compositions are formulated into multi-grade one or more commercially available viscosity modifiers. Viscosity modifiers generally are polymeric materials characterized as being hydrocarbon-based polymers generally having number average molecular weights between about 25,000 and 500,000 more often between about 50,000 and 200,000.

Polyisobutylene has been used as a viscosity modifier in lubricating oils. Polymethacrylates (PMA) are prepared from mixtures of methacrylate monomers having different alkyl groups. Most PMA's are viscosity-modifiers as well as pour point depressants. The alkyl groups may be either straight chain or branched chain groups containing from 1 to about 18 carbon atoms.

When a small amount of a nitrogen-containing monomer is copolymerized with alkyl methacrylates, dispersancy properties also are incorporated into the product. Thus, such a product has the multiple function of viscosity modification, pour point depressants and dispersancy. Such products have been referred to in the art as dispersant-type viscosity modifiers or simply dispersant-viscosity modifiers. Vinyl pyridine, N-vinyl pyrrolidone and N,N'-dimethylaminoethyl methacrylate are examples of nitrogen-containing monomers. Polyacrylates obtained from the polymerization or copolymerization of one or more alkyl acrylates also are useful as viscosity-modifiers.

Ethylene-propylene copolymers, generally referred to as OCP are prepared by copolymerizing ethylene and propylene in a hydrocarbon solvent using a Ziegler-Natta initiator. The ratio of ethylene to propylene in the polymer influences the oil-solubility, oil-thickening ability, low temperature viscosity, pour point depressant capability and engine performance of the product. The common range of ethylene content is 45-60% by weight and typically is from 50% to about 55% by weight. Some commercial OCP's are terpolymers of ethylene, propylene and a small amount of non-conjugated diene such as 1,4-hexadiene. In the rubber industry, such terpolymers are referred to as EPDM (ethylene propylene diene monomer). The use of OCP's as viscosity-modifiers in lubricating oils has increased rapidly since about 1970, and the OCP's are currently one of the most widely used viscosity modifiers for motor oils.

Esters obtained by copolymerizing styrene and maleic anhydride in the presence of a free radical initiator and thereafter esterifying the copolymer with a mixture of $C_{4-18}$ alcohols also are useful as viscosity-modifying additives in motor oils. The styrene esters generally are considered to be multi-functional premium viscosity-modifiers. The styrene esters in addition to their viscosity-modifying properties also are pour point depressants and exhibit dispersancy properties when the esterification is terminated before its completion leaving some unreacted anhydride or carboxylic acid groups. These acid groups can then be converted to imides by reaction with a primary amine.

Hydrogenated styrene-conjugated diene copolymers are another class of commercially available viscosity-modifiers for motor oils. Examples of styrenes include styrene, alpha-methyl styrene, ortho-methyl styrene, meta-methyl styrene, para-methyl styrene, para-tertiary butyl styrene, etc. Preferably the conjugated diene contains from four to six carbon atoms. Examples of conjugated dienes include piperylene, 2,3-dimethyl-1,3-butadiene, chloroprene, isoprene and 1,3-butadiene, with isoprene and butadiene being particularly preferred. Mixtures of such conjugated dienes are useful.

The styrene content of these copolymers is in the range of about 20% to about 70% by weight, preferably about 40% to about 60% by weight. The aliphatic conjugated diene content of these copolymers is in the range of about 30% to about 80% by weight, preferably about 40% to about 60% by weight.

These copolymers can be prepared by methods well known in the art. Such copolymers usually are prepared by anionic polymerization using, for example, an alkali metal hydrocarbon (e.g., sec-butyllithium) as a polymerization catalyst. Other polymerization techniques such as emulsion polymerization can be used.

These copolymers are hydrogenated in solution so as to remove a substantial portion of their olefinic double bonds. Techniques for accomplishing this hydrogenation are well known to those of skill in the art and need not be described in detail at this point. Briefly, hydrogenation is accomplished by contacting the copolymers with hydrogen at super-atmospheric pressures in the presence of a metal catalyst such as colloidal nickel, palladium supported on charcoal, etc.

In general, it is preferred that these copolymers, for reasons of oxidative stability, contain no more than about 5% and preferably no more than about 0.5% residual olefinic unsaturation on the basis of the total number of carbon-to-carbon covalent linkages within the average molecule. Such unsaturation can be measured by a number of means well known to those of skill in the art, such as infrared, NMR, etc. Most preferably, these copolymers contain no discernible unsaturation, as determined by the afore-mentioned analytical techniques.

These copolymers typically have number average molecular weights in the range of about 30,000 to about 500,000, preferably about 50,000 to about 200,000. The weight average molecular weight for these copolymers is generally in the range of about 50,000 to about 500,000, preferably about 50,000 to about 300,000.

The above-described hydrogenated copolymers have been described in the prior art. For example, U.S. Pat. No. 3,554,911 describes a hydrogenated random butadiene-styrene copolymer, its preparation and hydrogenation. The disclosure of this patent is incorporated herein by reference. Hydrogenated styrene-butadiene copolymers useful as viscosity-modifiers in the lubricating oil compositions of the present invention are available commercially from, for example, BASF under the general trade designation "Glissoviscal". A particular example is a hydrogenated styrene-butadiene copolymer available under the designation Glissoviscal 5260 which has a number average molecular eight of about 120,000. Hydrogenated styrene-isoprene copolymers useful as viscosity modifiers are available from, for example, The Shell Chemical Company under the general trade designation "Shellvis". Shellvis 40 from Shell Chemical Company is identified as a diblock copolymer of styrene and isoprene having a number average molecular weight of about 155,000, a styrene content of about 19 mole percent and an isoprene content of about 81 mole percent. Shellvis 50 is available from Shell Chemical Company and is identified as a diblock copolymer of styrene and isoprene having a number average molecular weight of about 100,000, a styrene content of about 28 mole percent and an isoprene content of about 72 mole percent.

The amount of polymeric viscosity modifier incorporated in the lubricating oil compositions of the present invention may be varied over a wide range although lesser amounts than normal are employed in view of the ability of the carboxylic acid derivative component (B) (and certain of the carboxylic ester derivatives (E)) to function as a viscosity modifier in addition to functioning as a dispersant. In general, the amount of polymeric viscosity-improver included in the lubricating oil compositions of the invention may be as high as 10% by weight based on the weight of the finished lubricating oil. More often, the polymeric viscosity-improvers are used in concentrations of about 0.2 to about 8% and more particularly, in amounts from about 0.5 to about 6% by weight of the finished lubricating oil.

The lubricating oils of the present invention may be prepared by dissolving or suspending the various components directed in a base oil along with any other additives which may be used. More often, the chemical components of the present invention are diluted with a substantially inert, normally liquid organic diluent such as mineral oil to form an additive concentrate. These concentrates usually comprise from about 0.01 to about 80% by weight of the additive components described above, and may contain, in addition, one or more of the other additives described above. Concentrations such as 15%, 20%, 30% or 50% or higher may be employed.

Typical lubricating oil compositions according to the present invention are exemplified in the following lubricating oil examples.

In the following lubricating oil Examples I to XVIII, the percentages are on a volume basis and the percentages indicate the amount of the normally oil diluted solutions of the indicated additives used to form the lubricating oil composition. For example, Lubricant I contains 6.5% by volume of the product of Example B-20 which is an oil solution of the indicated carboxylic derivative (B) containing 55% diluent oil.

TABLE I

| Components/Example (% vol) | LUBRICANTS I | II | III | IV | V | VI |
|---|---|---|---|---|---|---|
| Base Oil | (a) | (b) | (a) | (b) | (c) | (c) |
| Grade | 10W-30 | 5W-30 | 10W-30 | 10W-40 | 10W-30 | 30 |
| V.I. Type* | (1) | (1) | (1) | (m) | (1) | — |
| Product of Example B-20 | 6.5 | 6.5 | 6.5 | 6.5 | 6.5 | 6.5 |
| Product of Example C-2 | 0.25 | 0.25 | 0.25 | 0.25 | 0.25 | 0.25 |
| Product of Example D-1 | 0.75 | 0.75 | 0.75 | 0.75 | 0.75 | 0.75 |
| Product of Example D-18 (10% oil) | 0.06 | 0.06 | 0.06 | 0.06 | 0.06 | 0.06 |
| Basic magnesium alkylated benzene sulfonate (32% oil, MR of 14.7) | 0.20 | 0.20 | 0.20 | 0.20 | 0.20 | 0.20 |
| Product of Example G-1 | 0.45 | 0.45 | 0.45 | 0.45 | 0.45 | 0.45 |
| Basic calcium alkylated benzene sulfonate (48% oil, MR of 12) | 0.40 | 0.40 | 0.40 | 0.40 | 0.40 | 0.40 |
| Basic calcium phenol sulfide (38% oil, MR of 2.3) | 0.6 | 0.6 | — | 0.6 | — | — |
| Glycerol mono- and dioleate mixture** | — | 0.2 | — | — | — | — |
| Silicone anti-foam agent | 100 ppm | 100 ppm | 100 ppm | 100 ppm | 100 ppm | 100 ppm |

(a) Mid East Stock.
(b) North Sea Stock.
(c) Mid-Continent-hydrotreated.
(d) Mid-Continent-solvent refined.
(l) A diblock copolymer of styrene-isoprene; number average molecular weight of about 155,000.
(m) A polyisoprene, star polymer.
*The amount of polymeric VI included in each lubricant is an amount required to have the finished lubricant meet the requirements of the indicated multigrade.
**Emerest 2421.

TABLE II

| Components/Example (% vol) | LUBRICANTS VII | VIII | IX | X | XI | XII |
|---|---|---|---|---|---|---|
| Base Oil | (b) | (a) | (a) | (d) | (d) | (d) |
| Grade | 10W-30 | 5W-30 | 10W-40 | 10W-30 | 5W-30 | 10W-30 |
| V.I. Type* | (1) | (1) | (1) | (1) | (m) | (1) |
| Product of Example B-20 | 6.5 | 7.5 | 6.5 | 6.5 | 6.5 | 6.5 |
| Product of Example C-2 | 0.25 | 0.25 | 0.25 | 0.25 | 0.25 | 0.25 |
| Product of Example D-1 | 0.75 | 0.75 | 0.75 | 0.75 | 0.75 | 0.75 |
| Product of Example D-18 (10% oil) | 0.06 | 0.06 | 0.06 | 0.06 | 0.06 | 0.06 |
| Basic magnesium alkylated benzene sulfonate (32% oil, MR of 14.7) | 0.20 | 0.20 | 0.20 | 0.20 | 0.20 | 0.20 |
| Product of Example G-1 | 0.45 | 0.77 | 0.45 | 1.76 | 0.45 | 0.45 |
| Basic calcium alkylated benzene sulfonate (48% oil, MR of 12) | 0.40 | 0.40 | 0.40 | 0.40 | 0.40 | 0.40 |
| Basic calcium phenol sulfide (38% oil, MR of 2.3) | — | 0.6 | 0.6 | 0.6 | 0.6 | — |
| Calcium phenol sulfide (55% oil, MR of 1.1) | — | — | — | — | 1.0 | — |
| Glycerol mono- and dioleate mixture** | — | 0.2 | — | — | 0.2 | — |
| Reaction product of alkyl phenol reacted with sulfur dichloride | 0.6 | 0.15 | 0.61 | — | — | — |
| Product of Example I-3 | 0.45 | — | — | — | — | — |
| Silicone anti-foam agent | 100 ppm | 100 ppm | 100 ppm | 100 ppm | 100 ppm | 100 ppm |

(a) Mid East Stock.
(b) North Sea Stock.
(c) Mid-Continent-hydrotreated.
(d) Mid-Continent-solvent refined.
(l) A diblock copolymer of styrene-isoprene; number average molecular weight of about 155,000.
(m) A polyisoprene, star polymer.
*The amount of polymeric VI included in each lubricant is an amount required to have the finished lubricant meet the requirements of the indicated multigrade.
**Emerest 2421.

TABLE III

| Components/Example (% vol) | LUBRICANTS XIII |
|---|---|
| Base Oil | (d) |
| Grade | 10W-30 |
| V.I. Type* | (n) |
| Product of Example B-20 | 6.5 |

TABLE III-continued

| Components/Example (% vol) | LUBRICANTS XIII |
|---|---|
| Product of Example C-2 | 0.25 |
| Product of Example D-1 | 0.75 |
| Product of Example D-18 (10% oil) | 0.06 |

TABLE III-continued

| LUBRICANTS | |
|---|---|
| Components/Example (% vol) | XIII |
| Basic magnesium alkylated benzene sulfonate (32% oil, MR of 14.7) | 0.20 |
| Product of Example G-1 | 0.45 |
| Basic calcium alkylated benzene sulfonate (48% oil, MR of 12) | 0.40 |
| Basic calcium phenol sulfide (38% oil, MR of 2.3) | 0.6 |
| Silicone anti-foam agent | 100 ppm |

[d]Mid-Continent-solvent refined.
[n]An ethylene-propylene copolymer (OCP).
*The amount of polymeric VI included in each lubricant is an amount required to have the finished lubricant meet the requirements of the indicated multi-grade.

| | % w |
|---|---|
| Example XIV | |
| Product of Example B-1 | 6.2 |
| Product of Example C-1 | 0.50 |
| 100 Neutral Paraffinic Oil | remainder |
| Example XV | |
| Product of Example B-32 | 6.8 |
| Product of Example C-2 | 0.50 |
| 100 Neutral Paraffinic Oil | remainder |
| Example XVI | |
| Product of Example B-32 | 5.5 |
| Product of Example C-2 | 0.40 |
| Product of Example D-1 | 0.80 |
| 100 Neutral Paraffinic Oil | remainder |
| Example XVII | |
| Product of Example B-29 | 4.8 |
| Product of Example C-5 | 0.4 |
| Product of Example D-1 | 0.75 |
| Product of Example G-1 | 0.45 |
| Product of Example G-3 | 0.30 |
| 100 Neutral Paraffinic Oil | remainder |
| Example XVIII | |
| Product of Example B-21 | 4.7 |
| Product of Example C-4 | 0.3 |
| Product of Example D-6 | 0.8 |
| Product of Example G-1 | 0.5 |
| Product of Example G-3 | 0.2 |
| 100 Neutral Paraffinic Oil | remainder |

The lubricating oil compositions of the present invention exhibit a reduced tendency to deteriorate under conditions of use and thereby reduce wear and the formation of such undesirable deposits as varnish, sludge, carbonaceous materials and resinous materials which tend to adhere to the various engine parts and reduce the efficiency of the engines. Lubricating oils also can be formulated in accordance with this invention which result in improved fuel economy when used in the crankcase of a passenger automobile. In one embodiment, lubricating oils can be formulated within this invention which can pass all of the tests required for classification as an SG oil.

The performance characteristics of the lubricating oil compositions of the present invention are evaluated by subjecting lubricating oil compositions to a number of engine oil tests which have been designed to evaluate various performance characteristics of engine oils. As mentioned above, in order for a lubricating oil to be qualified for API Service Classification SG, the lubricating oils must pass certain specified engine oil tests. However, lubricating oil compositions passing one or more of the individual tests also are useful in certain applications.

The ASTM Sequence, IIIE engine oil test has been recently established as a means of defining the high-temperature wear, oil thickening, and deposit protection capabilities of SG engine oils. The IIIE test, which replaces the Sequence IIID test, provides improved discrimination with respect to high-temperature camshaft and lifter wear protection and oil-thickening control. The IIIE test utilizes a Buick 3.8L V-6 model engine which is operated on leaded fuel at 67.8 bhp and 3000 rpm for a maximum test length of 64 hours. A valve spring load of 230 pounds is used. A 100% glycol coolant is used because of the high engine operating temperatures. Coolant outlet temperature is maintained at 118° C., and the oil temperature is maintained at 149° C. at an oil pressure of 30 psi. The air-to-fuel ratio is 16.5, and the blow-by rate is 1.6 cfm. The initial oil charge is 146 ounces.

The test is terminated when the oil level reaches 28 ounces low at any of the 8-hour check intervals. When the tests are concluded before 64 hours because of low oil level, the low oil level has generally resulted from hang-up of the heavily oxidized oil throughout the engine and its inability to drain to the oil pan at the 49° C. oil check temperature. Viscosities are obtained on the 8-hour oil samples, and from this data, curves are plotted of percent viscosity increase versus engine hours. A maximum 375% viscosity increase measured at 40° C. at 64 hours is required for API classification SG. The engine sludge requirement is a minimum rating of 9.2, the piston varnish a minimum of 8.9, and the ring land deposit a minimum of 3.5 based on the CRC merit rating system. Details of the current Sequence IIIE Test are contained in the "Sequence IIID Surveillance Panel Report on Sequence III Test to the ASTM Oil Classification Panel", dated Nov. 30, 1987, revised Jan. 11, 1988.

The results of the Sequence IIIE test conducted on lubricant XII are summarized in the following Table IV.

TABLE IV

| ASTM Sequence III-E Test | | | | | |
|---|---|---|---|---|---|
| | Test Results | | | | |
| Lubricant | % Vis Increase | Engine Sludge | Piston Varnish | Ring Land Deposit | VTW[a] Max/Ave |
| XII | 152 | 9.6 | 8.9 | 6.7 | 8/4 |

[a]In ten-thousandth of an inch.

The Ford Sequence VE test is described in the "Report of the ASTM Sludge and Wear Task Force and the Sequence VD Surveillance Panel--Proposed PV2 Test", dated Oct. 13, 1987.

The test uses a 2.3 liter (140 CID) 4-cylinder overhead cam engine equipped with a multi-point electronic fuel injection system, and the compression ratio is 9.5:1. The test procedure uses the same format as the Sequence VD test with a four-hour cycle consisting of three different stages. The oil temperatures (°F.) in Stages I, II and III are 155/210/115, and the water temperatures (°F.) in three stages are 125/185/115, respectively. The test oil charge volume is 106 oz., and the rocker cover is jacketed for control of upper engine temperature. The speeds and loads of the three stages have not been changed from the VD test. The blow-by rate in Stage I is increased to 2.00 CFM from 1.8 CFM, and the test length is 12 days. The PCV valves are replaced every 48 hours in this test.

At the end of the test, engine sludge, rocker cover sludge, piston varnish, average varnish and valve train wear are rated.

The results of the Ford Sequence VE test conducted on lubricating oil IV of the present invention are summarized in the following Table V. The performance requirements for SG classification are as follows: engine sludge, 9.0 min.; rocker cover sludge, 7.0 min.; average varnish, 5.0 min.; piston varnish, 6.5 min.; VTW 15/5 max.

TABLE V

| | Ford Sequence VE Test Test Results | | | | |
|---|---|---|---|---|---|
| Lubricant | Engine Sludge | Rocker Cover Sludge | Average Varnish | Piston Varnish | VTW[a] Max/Ave |
| IV | 9.2 | 8.3 | 5.5 | 7.2 | 6.3/2.2 |

[a]In mils or thousandth of an inch.

The CRC L-38 test is a test developed by the Coordinating Research Council. This test method is used for determining the following characteristics of crankcase lubricating oils under high temperature operating conditions: antioxidation, corrosive tendency, sludge and varnish-producing tendency, and viscosity stability. The CLR engine features a fixed design, and is a single cylinder, liquid-cooled, spark-ignition engine operating at a fixed speed and fuel flow. The engine has a one-quart crankcase capacity. The procedure requires that the CLR single cylinder engine be operated at 3150 rpm, approximately 5 bhp, 290° F. oil gallery temperature and 200° F. coolant-out temperature for 40 hours. The test is stopped every 10 hours for oil sampling and topping up. The viscosities of these oil samples are determined, and these numbers are reported as part of the test result.

A special copper-lead test bearing is weighed before and after the test to determine the weight loss due to corrosion. After the test, the engine also is rated for sludge and varnish deposits, the most important of which is the piston skirt varnish. The primary performance criteria for API Service Classification SG are bearing weight loss, mg, max of 40 and a piston skirt varnish rating (minimum) of 9.0.

The following Table VI summarizes the results of the L-38 test using two lubricants of the invention.

TABLE VI

| | L-38 Test | |
|---|---|---|
| Lubricant | Bearing Wt. Loss (mg) | Piston Skirt Varnish Rating |
| I | 9.6 | 9.4 |
| V | 10.4 | 9.7 |

The Oldsmobile Sequence IID test is used to evaluate the rusting and corrosion characteristics of motor oils. The test and test conditions are described in ASTM Special Technical Publication 315H (Part 1). The test relates to short trip service under winter driving conditions as encountered in the United States. The sequence IID uses an Oldsmobile 5.7 liter (350 CID) V-8 engine run under low speed (1500 rpm), low load conditions (25 bhp) for 28-hours with engine coolant-in at 41° C. and coolant-out at 43° C. Following this, the test operates for two hours at 1500 rpm with coolant-in at 47° C. and the coolant-out at 49° C. After a carburetor and spark plug change, the engine is operated for the final two hours under high-speed (3600 rpm), moderate load conditions (100 bhp) with coolant-in at 88° C. and the coolant-out at 93° C. Upon completion of the test (32 hours), the engine is inspected for rust using CRC rating techniques. The number of stuck valve lifters also is recorded which gives an indication of the magnitude of rust. The minimum average rust rating in order to pass the IID test is 8.5. When the lubricating oil composition identified above as lubricant XIII is used in the sequence IID test, the average CRC rust rating is 8.5.

The Caterpillar 1H2 Test described in ASTM Special Technical Publication 509A, Part II, is used for determining the effect of lubricating oils on ring-sticking, ring and cylinder wear and accumulation of piston deposit in a Caterpillar engine. The test involves the operation of the special super-charged, single-cylinder diesel test engine for a total of 480 hours at a fixed speed of 1800 rpm and fixed heat input. The heat input-high heat valve is 4950 btu/min, and the heat input-low heat valve is 4647 btu/min. The test oil is used as a lubricant, and the diesel fuel is conventionally refined diesel fuel containing 0.37 to 0.43 weight percent of natural sulfur.

Upon completion of the test, the diesel engine is examined to determine whether any stuck rings are present, the degree of cylinder, liner and piston ring wear, and the amount and nature of piston deposits present. In particular, the top groove filling (TGF), and the weighted total demerits (WTD) based on coverage and location of deposits are recorded as primary performance criteria of the diesel lubricants in this test. The target values for the 1H2 test are a TGF maximum of 45 (% by volume) and a maximum WTD rating of 140 after 480 hours.

The results of the Caterpillar 1H2 test conducted on several lubricating oil compositions of the present invention are summarized in the following Table VII.

TABLE VII

| | Caterpillar 1H2 Test | | |
|---|---|---|---|
| Lubricant | Hours | Top Groove Filing | Weighted Total Demerits |
| V | 120 | 39 | 65 |
| | 480 | 44 | 90 |
| VII | 120 | 7 | 105 |
| | 480 | 24 | 140 |
| VIII | 120 | 37 | 68 |
| | 480 | 33 | 69 |
| XI | 480 | 42 | 114 |

The advantage and improved performance resulting from the use of the lubricating oil compositions of the present invention, particularly with respect to the use of component (B) is demonstrated by carrying out the Caterpillar 1H2 test on a control lubricating oil composition which is identical to lubricant VIII above with the exception that the product of Example B-20 is replaced by an equivalent amount of a prior art carboxylic derivative which is the same as B-20 except that the acylating agent to nitrogen equivalent ratio is 1:1. In Example B-20, the ratio is 6:5. The control lubricant failed the Caterpillar 1H2 test in 120 hours. The top groove filling (TGF) was 57 and the Weighted Total Demerits (WTD) rating was 221. In contrast, lubricant VIII ratings were acceptable even after 480 hours. See Table VII.

Whereas the Caterpillar 1H2 Test is considered to be a test suitable for light-duty diesel applications (API Service Classification CC), the Caterpillar 1G2 Test described in the ASTM Special Technical Publication 509A, Part I relates to heavier duty applications (API Service Classification CD). The IG2 test is similar to the Caterpillar 1H2 test except that the conditions of the test are more demanding. The heat input-high heat valve is 5850 btu/min, and the heat input-low heat valve is 5490 btu/min. The engine is run at 42 bhp. Running temperatures also are higher: water from the cylinder head is at about 88° C. and oil to bearings is about 96° C. Inlet air to engine is maintained at about 124° C. and the exhaust temperature is 594° C. In view of the severity of this diesel test, the target values are higher than in the 1H2. The maximum allowable top groove filling is 80 and the maximum WTD is 300.

The results of the Caterpillar 1G2 Test conducted using Composition IX of the present invention are summarized in the following Table VIII.

TABLE VIII

| | Caterpillar 1G2 Test | | |
|---|---|---|---|
| Lubricant | Hours | Top Groove Filing | Weighted Total Demerits |
| IX | 120 | 72 | 171 |
| | 480 | 79 | 298 |

The Sequence VI test is a test utilized to qualify passenger car and light-duty truck oils in the API/SAE/ASTM Energy Conserving Category. In this test, a General Motors 3.8L V-6 engine is operated under tightly controlled conditions, enabling precise measurements of the Brake Specific Fuel Consumption (BSFC), to indicate the lubricant-related friction present within the engine. A state-of-the-art microprocessor control and data acquisition/processing system are employed to achieve maximum precision.

Every test is preceded by an engine/system calibration using the following special ASTM oils: SAE 20W-30 moly-amine friction modified (FM), SAE 50 (LR), and SAE 20W-30 high-reference (HR). After confirming the proper precision and calibration, a candidate oil is flushed into the engine without shut-down to undergo a 40-hour aging period at moderate temperature, light load, steady state conditions. At the conclusion of the aging, replicate BSFC measurements are taken at each of two test stages with temperatures ranging from low (150° F.) to high (275° F.), all at 1500 rpm, 8 bhp. These BSFC data are compared to corresponding measurements obtained with fresh (unaged) reference oil HR which is flushed into the engine directly after the aged candidate oil measurements are recorded.

To minimize effects of additive carry-over from the candidate oil, an abnormally high detergent flush oil (FO) is briefly run in the engine prior to the HR. Flush oil also is used during the pre-test engine calibration. Test duration is about 3.5 days, 65 operating hours.

The fuel consumption reduction provided by the candidate oil is expressed as a weighted average of the individual stage percent change (delta) (at 150° F. and 275° F.). Based on the overall correlation of the weighted test results with Five Car test results, a transform equation is used to express results in equivalent fuel economy improvement (EFEI).

The transform equation used is as follows:

The transform equation used is as follows:

-continued $$EFEI = \frac{[0.65(\text{stage 150 delta}) + 0.35(\text{stage 275 delta})] - 0.61}{1.38}$$

For example, if a 3% improvement is observed at stage 150 and a 6% improvement at stage 275, the EFEI using the above transform equation is 2.49%.

The results of the Sequence VI Fuel Efficient Engine Oil Dynamometer Test conducted utilizing lubricating oil compositions of the present invention (lubricants V, X and XI) are summarized in the following Table VIII. The target of 1.5% is the established minimum rating for Fuel Economy designation, and the target of 2.7% is the minimum improvement in Fuel Economy required for the API/SAE/ASTM Energy Conserving Category.

TABLE IX

| | Sequence VI Test | |
|---|---|---|
| Lubricant | Fuel Economy Increase (%) | Target |
| V | 2.3 | 1.5 |
| X | 2.1 | 1.5 |
| XI | 3.2 | 2.7 |

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

We claim:

1. A lubricating oil composition for internal combustion engines which comprises (A) at least about 60% by weight of oil of lubricating viscosity, (B) at least about 2.0% by weight of at least one carboxylic derivative composition produced by reacting (B-1) at least one substituted succinic acylating agent with (B-2) from about 0.70 equivalent up to less than one equivalent, per equivalent of acylating agent, of at least one amine compound characterized by the presence within its structure of at least one HN< group, and wherein said substituted succinic acylating agent consists of substituent groups and succinic groups wherein the substituent groups are derived from a polyalkene, said polyalkene being characterized by an $\overline{M}n$ value of about 1300 to about 5000 and an $\overline{M}w/\overline{M}n$ value of about 1.5 to about 4.5, said acylating agents being characterized by the presence within their structure of an average of at least 1.3 succinic groups for each equivalent weight of substituent groups, and (C) from about 0.01 to about 2% by weight of at least one basic alkali metal salt of a sulfonic or carboxylic acid.

2. The oil composition of claim 1 containing at least about 2.5% by weight of the carboxylic derivative composition (B).

3. The oil composition of claim 1 containing at least about 3.0% of the carboxylic derivative composition (B).

4. The oil composition of claim 1 wherein from about 0.75 to about 0.95 equivalent of amine compound (B-2) is reacted per equivalent of acylating agent.

5. The oil composition of claim 1 wherein the value of $\overline{M}n$ in (B-1) is at least about 1500.

6. The oil composition of claim 1 wherein the value of $\overline{M}w/\overline{M}n$ in (B-1) is from about 2.0 to about 4.5.

7. The oil composition of claim 1 wherein the substituent groups in (B-1) are derived from one or more polyalkenes selected from the group consisting of homopolymers and interpolymers of terminal olefins of from 2 to about 16 carbon atoms with the proviso that said interpolymers can optionally contain up to about 25% of polymer units derived from internal olefins of up to about 16 carbon atoms.

8. The oil composition of claim 1 wherein the substituent groups in (B-1) are derived from a member selected from the group consisting of polybutene, ethylene-propylene copolymer, polypropylene, and mixtures of two or more of any of these.

9. The oil composition of claim 1 wherein the substituent groups in (B-1) are derived from polybutene in which at least about 50% of the total units derived from butenes is derived from isobutene.

10. The oil composition of claim 1 wherein the amine (B-2) is an aliphatic, cycloaliphatic or aromatic polyamine.

11. The oil composition of claim 1 wherein the amine (B-2) is a hydroxy-substituted monoamine, polyamine, or mixtures thereof.

12. The oil composition of claim 1 wherein the amine (B-2) is characterized by the general formula

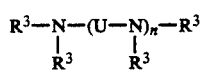

$$R^3-\underset{\underset{R^3}{|}}{N}-(U-\underset{\underset{R^3}{|}}{N})_n-R^3 \quad \text{(VIII)}$$

wherein n is from 1 to about 10; each $R^3$ is independently a hydrogen atom, a hydrocarbyl group, or a hydroxy-substituted or amino-substituted hydrocarbyl group having up to about 30 atoms, with the proviso that at least one $R^3$ group is a hydrogen atom and U is an alkylene group of about 2 to about 10 carbon atoms.

13. The oil composition of claim 1 wherein the salt (C) is a salt of an organic sulfonic acid.

14. The oil composition of claim 1 wherein the basic alkali metal salt (C) is a sodium salt of an organic sulfonic acid.

15. The oil composition of claim 1 wherein the metal salt (C) is characterized as having a ratio of equivalents of alkali metal to equivalents of sulfonic or carboxylic acid of at least about 2:1.

16. The oil composition of claim 13 wherein the organic sulfonic acid is a hydrocarbyl-substituted aromatic sulfonic acid, or an aliphatic sulfonic acid represented by Formulae IX and X, respectively

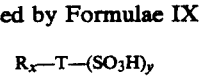

$$R_x-T-(SO_3H)_y \quad \text{(IX)}$$

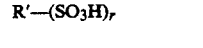

$$R'-(SO_3H)_r \quad \text{(X)}$$

wherein R and R' are each independently an aliphatic group containing up to about 60 carbon atoms, T is an aromatic hydrocarbon nucleus, x is a number of 1 to 3, and r and y are numbers of 1 to 2.

17. The oil composition of claim 16 wherein the sulfonic acid is an alkylated benzenesulfonic acid.

18. The oil composition of claim 1 also containing (D) at least one metal dihydrocarbyl dithiophosphate characterized by the formula

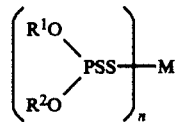

$$\left(R^1O\diagdown PSS\diagup R^2O\right)_n-M \quad \text{(XI)}$$

wherein $R^1$ and $R^2$ are each independently hydrocarbyl groups containing from 3 to about 13 carbon atoms, M is a metal, and n is an integer equal to the valence of M.

19. The oil composition of claim 18 wherein at least one of the hydrocarbyl groups of the dithiophosphate (D) is attached to the oxygen atoms through a secondary carbon atom.

20. The oil composition of claim 18 wherein each of the hydrocarbyl groups of (D) is attached to the oxygen atoms through a secondary carbon atom.

21. The oil composition of claim 18 wherein one of the hydrocarbyl groups is an isopropyl group and the other hydrocarbyl group is a primary hydrocarbyl group.

22. The oil composition of claim 18 wherein the metal in Formula XI is a Group II metal, aluminum, tin, iron, cobalt, lead, molybdenum, manganese, nickel or copper.

23. The oil composition of claim 18 wherein the metal in Formula XI is zinc or copper.

24. The oil composition of claim 1 also containing (E) at least one carboxylic ester derivative composition produced by reacting (E-1) at least one substituted succinic acylating agent with (E-2) at least one alcohol of the general formula

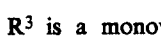

$$R_3(OH)m \quad \text{(XII)}$$

wherein $R^3$ is a monovalent or polyvalent organic group joined to the —OH groups through a carbon bond, and m is an integer of from 1 to about 10.

25. The oil composition of claim 24 wherein m is at least 2.

26. The oil composition of claim 24 wherein the composition obtained by reacting the acylating agent (E-1) with the alcohol (E-2) is further reacted with (E-3) at least one amine containing at least one HN< group.

27. The oil composition of claim 26 wherein the amine (E-3) is a polyamine.

28. The oil composition of claim 24 wherein the substituted succinic acylating agent (E-1) consists of substituent groups and succinic groups wherein the substituent groups are derived from a polyalkene, said polyalkene being characterized by an $\overline{M}n$ value of about 1300 to about 5000 and an $\overline{M}w/\overline{M}n$ value of about 1.5 to about 4.5, said acylating agents being characterized by the presence within their structure of at least about 1.3 succinic groups for each equivalent weight of substituent group.

29. The oil composition of claim 1 also containing (F) up to about 1% by weight of at least one partial fatty acid ester of a polyhydric alcohol.

30. The oil composition of claim 29 wherein the fatty acid ester of the polyhydric alcohol is a partial fatty acid ester of glycerol.

31. The oil composition of claim 29 wherein the fatty acid contains from about 10 to about 22 carbon atoms.

32. The oil composition of claim 1 also containing (G) at least one neutral or basic alkaline earth metal salt of at least one acidic organic compound.

33. The oil composition of claim 32 wherein the acidic organic compound is a sulfur acid, carboxylic acid, phosphorus acid, phenol, or mixtures thereof.

34. A lubricating oil composition for internal combustion engines which comprises (A) at least about 60% by weight of oil of lubricating viscosity, (B) at least about 2.5% by weight of at least one carboxylic derivative composition produced by reacting (B-1) at least one substituted succinic acylating agent with (B-2) from about 0.70 equivalent up to less than one equivalent, per equivalent of acylating agent, of at least one amine compound characterized by the presence within its structure of at least one HN< group, and wherein said substituted succinic acylating agent consists of substituent groups and succinic groups wherein the substituent groups are derived from a polyalkene, said polyalkene being characterized by an $\overline{M}n$ value of about 1300 to about 5000 and an $\overline{M}w/\overline{M}n$ value of about 1.5 to about 4.5, said acylating agents being characterized by the presence within their structure of an average of at least 1.3 succinic groups for each equivalent weight of substituent groups, (C) from about 0.01 to about 2% by weight of at least one basic sodium or potassium hydrocarbyl sulfonate, and (D) from about 0.05 to about 2% by weight of at least one metal dihydrocarbyl dithiophosphate of the formula

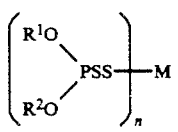

(XI)

wherein $R^1$ and $R^2$ are each independently hydrocarbon groups containing from 3 to about 13 carbon atoms, M is a Group II metal, aluminum, tin, iron, cobalt, lead, molybdenum, manganese, nickel or copper, and n is an integer equal to the valence of M.

35. The oil composition of claim 34 wherein (C) is at least one basic sodium hydrocarbyl sulfonate.

36. The oil composition of claim 34 wherein the metal in (D) is zinc or copper.

37. The oil composition of claim 34 wherein at least one of the hydrocarbyl groups in (D) is attached to the oxygen through a secondary carbon atom.

38. The oil composition of claim 34 wherein both hydrocarbyl groups of (D) are attached to the oxygen atom through a secondary carbon atom.

39. The oil composition of claim 38 wherein the hydrocarbyl groups contain from 6 to about 10 carbon atoms.

40. The oil composition of claim 34 also containing (E) at least one carboxylic ester derivative composition produced by reacting (E-1) at least one substituted succinic ester acylating agent with (E-2) at least one alcohol of the general formula $$R_3(OH)_m \qquad \text{(XII)}$$

wherein $R_3$ is a monovalent or polyvalent organic group joined to the —OH groups through a carbon bond, and m is an integer of from 1 to about 10.

41. The oil composition of claim 40 wherein the carboxylic derivative composition (E) is further reacted with (E-3) at least one amine compound containing at least one HN< group.

42. The oil composition of claim 41 wherein the amine compound (E-3) is an alkylene polyamine.

43. The oil composition of claim 34 also containing (F) up to about 1% by weight of at least one partial fatty acid ester of a polyhydric alcohol.

44. The oil composition of claim 43 wherein the fatty acid ester is a partial fatty acid ester of glycerol.

45. The oil composition of claim 44 wherein the fatty acid contains from about 10 to about 22 carbon atoms.

46. The oil composition of claim 34 also containing (G) from about 0.01 to 5% by weight of at least one neutral or basic alkaline earth metal salt of at least one acidic organic compound.

47. The oil composition of claim 46 wherein the acidic organic compound is a sulfur acid, carboxylic acid, phosphorus acid, phenol, or mixtures thereof.

48. An oil composition for internal combustion engines which comprises (A) at least about 60% by weight of oil of lubricating viscosity, (B) at least about 2.5% by weight of at least one carboxylic derivative composition produced by reacting (B-1) at least one substituted succinic acylating agent with (B-2) from about 0.70 equivalent up to less than one equivalent, per equivalent of acylating agent, of at least one polyamine compound characterized by the presence within its structure of at least one HN< group wherein said substituted succinic acylating agent consists of substituent groups and succinic groups wherein the substituent groups are derived from a polyalkene, said polyalkene being characterized by an $\overline{M}n$ value of about 1300 to about 5000 and an $\overline{M}w/\overline{M}n$ value of about 2 to about 4.5, said acylating agents being characterized by the presence within their structure of an average of at least 1.3 succinic groups for each equivalent weight of substituent groups, (C) from about 0.01 to about 2% by weight of at least one basic sodium salt of an organic sulfonic acid having a metal ratio of from about 4 to about 30, (D) from about 0.05 to about 2% by weight of at least one metal dihydrocarbyl dithiophosphate characterized by the formula

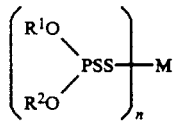

(XI)

wherein $R^1$ and $R^2$ are each independently hydrocarbon groups containing from 3 to about 13 carbon atoms and at least one of the hydrocarbon groups is attached to the oxygen atom through a secondary carbon atom, M is zinc or copper, and n is a number equal to the valence of M, and (G) from about 0.1 to about 3% by weight of at least one neutral or basic alkaline earth metal salt of at least one organic sulfonic acid, carboxylic acid, phosphorus acid, or phenol.

49. The oil composition of claim 48 wherein the oil composition contains at least about 3% by weight of the carboxylic derivative composition (B).

50. The oil composition of claim 48 wherein the polyamine compound (B-2) is an alkylene polyamine.

51. The oil composition of claim 48 wherein from about 0.75 to 0.90 equivalent of the polyamine compound (B-2) is utilized per equivalent of acylating agent (B-1).

52. The oil composition of claim 48 wherein hydrocarbyl groups $R^1$ and $R^2$ in (D) are both attached to the oxygen atoms through secondary carbon atoms.

53. The oil composition of claim 48 wherein the basic sodium salt (C) is an oil-soluble dispersion prepared by the method which comprises contacting at a temperature between the solidification temperature of the reaction mixture and its decomposition temperature, (C-1) at least one acidic gaseous material selected from the group consisting of carbon dioxide, hydrogen sulfide, sulfur dioxide, and mixtures thereof, with (C-2) a mixture comprising (C-2-a) at least one oil-soluble sulfonic acid, or derivative thereof susceptible to overbasing;

(C-2-b) at least one of sodium, or one or more basic compounds thereof selected from the group consisting of hydroxides, alkoxides, hydrides, or amides;

(C-2-c) at least one lower aliphatic alcohol selected from monohydric alcohols or dihydric alcohols, or at least one alkyl phenol or sulfurized alkyl phenol; and (C-2-d) at least one oil-soluble carboxylic acid or functional derivative thereof.

54. The oil composition of claim 53 wherein the acidic gaseous material (C-1) is carbon dioxide.

55. The oil composition of claim 53 wherein the sulfonic acid (C-2-a) is a hydrocarbyl-substituted aromatic sulfonic acid, or an aliphatic sulfonic acid represented by Formulae IX and X, respectively $$R_x—T—(SO_3H)_y \quad (IX)$$

$$R'—(SO_3H)_r \quad (X)$$

wherein R and R' are each independently an aliphatic group containing up to about 60 carbon atoms, T is an aromatic hydrocarbon nucleus, x is a number of 1 to 3, and r and y are numbers of 1 to 2.

56. The oil composition of claim 53 wherein the basic salt (C) has a metal ratio of from about 6 to about 30.

57. The oil composition according to claim 53 wherein component (C-2-d) is at least one hydrocarbon-substituted succinic acid or functional derivative thereof and the reaction temperature is in the range of about 25°-200° C.

58. The oil composition according to claim 53 wherein component (C-2-a) is an alkylated benzenesulfonic acid.

59. The oil composition according to claim 53 wherein component (C-2-c) is at least one of methanol, ethanol, propanol, butanol and pentanol and component (C-2-d) is at least one of polybutenyl succinic acid and polybutenyl succinic anhydride wherein the polybutenyl group comprises principally isobutene units and has an Mn between about 700 and about 10,000.

60. A lubricating oil composition for internal combustion engines which comprisess (A) at least about 60% by weight of oil of lubricating viscosity, (B) at least about 2.0% by weight of a carboxylic derivative composition prepared by the process comprising reacting (B-1) a polyisobutene-substituted succinic acid or anhydride wherein the polyisobutene substituent has an Mn of from about 1500 to about 2400 and an $\overline{M}w/\overline{M}n$ value of from about 2.0 to about 4.5, with (B-2) from about 0.75 to about 0.95 equivalent, per equivalent of succinic acid or anhydride, of at least one alkylene polyamine having up to about 11 amino groups, said substituted succinic acid or anhydride being further characterized by the presence of an average of from about 1.3 to about 2.5 succinic groups for each equivalent weight of polyisobutene groups, (C) from about 0.05 to about 2% by weight of an overbased sodium alkylbenzene sulfonate having a metal ratio of from about 4 to about 30, (D) from about 0.05 to about 2% by weight of at least one zinc or copper dihydrocarbyl dithiophosphate wherein the hydrocarbyl groups contain from about 3 to about 13 carbons and the hydrocarbyl groups are attached to the oxygen atoms through secondary carbon atoms, and (G) from about 0.1 to about 3% by weight of at least one basic alkaline earth metal salt of at least one acidic organic compound selected from the group consisting of sulfonic acids, carboxylic acids, phosphorus acids and phenols.

61. The oil composition of claim 60 containing at least about 2.5% of (B).

62. The oil composition of claim 60 wherein the alkylene polyamine in (B-2) is an ethylene polyamine.

63. The oil composition of claim 60 wherein in (B) the succinic acid or anhydride is reacted with 0.80 to 0.90 equivalent of polyamine per equivalent of acid or anhydride.

64. The oil composition of claim 60 wherein (C) is a dispersion prepared by the process of reacting at about 25°-200° C. for a time sufficient to form the dispersion, (C-1) carbon dioxide with (C-2) a mixture of (C-2-a) at least one oil-soluble alkylated benzenesulfonic acid or a derivative thereof susceptible to overbasing, (C-2-b) sodium hydroxide, (C-2-c) a monohydric alcohol, an alkyl phenol, or a sulfurized alkyl phenol, (C-2-d) at least one oil-soluble polybutenyl-substituted succinic acid or its anhydride wherein the polybutenyl substituent has an $\overline{M}n$ value of 700–5000, the ratios of equivalents of components (C-2) being:

(C-2-b)/(C-2-a) between about 6:1 and 30:1

(C-2-c)/(C-2-a) between about 2:1 and 50:1

(C-2-d)/(C-2-a) between about 1:2 and 1:10.

65. The oil composition of claim 60 wherein (D) is at least one zinc dihydrocarbyl dithiophosphate wherein the hydrocarbyl groups are derived from a mixture of isopropyl alcohol and a secondary alcohol containing about 6 to 10 carbon atoms.

66. The oil composition of claim 60 wherein (G) comprises a mixture of basic alkaline earth metal salts of organic sulfonic acids and carboxylic acids.

67. The oil composition of claim 60 also containing from about 0.05 to 0.5% by weight of a mixture of glycerol monooleate and glycerol dioleate.

68. The oil composition of claim 60 containing sufficient amounts of (B), (C), (D) and (G) to pass the performance requirements of API Service Classification SG.

* * * * *